US007347715B2

(12) United States Patent
Kobayashi et al.

(10) Patent No.: US 7,347,715 B2
(45) Date of Patent: Mar. 25, 2008

(54) CONNECTOR DEVICE

(75) Inventors: Yutaka Kobayashi, Yokkaichi (JP); Yuuichi Nankou, Yokkaichi (JP); Yutaka Noro, Yokkaichi (JP); Satoru Nishide, Yokkaichi (JP); Masahiro Noda, Yokkaichi (JP); Keiichi Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/397,360

(22) Filed: Apr. 4, 2006

(65) Prior Publication Data

US 2006/0223383 A1 Oct. 5, 2006

(30) Foreign Application Priority Data

| | | |
|---|---|---|
| Apr. 5, 2005 | (JP) | 2005-108737 |
| Apr. 8, 2005 | (JP) | 2005-112500 |
| Apr. 8, 2005 | (JP) | 2005-112501 |
| Dec. 20, 2005 | (JP) | 2005-366752 |

(51) Int. Cl.
*H01R 13/64* (2006.01)

(52) U.S. Cl. ..... 439/376; 439/248

(58) Field of Classification Search ..... 349/372, 349/374, 140, 157; 439/372, 374, 140, 157, 439/376, 248

See application file for complete search history.

(56) References Cited

U.S. PATENT DOCUMENTS

| | | | | |
|---|---|---|---|---|
| 6,296,502 | B1 | 10/2001 | Takata et al. | |
| 6,544,054 | B2 * | 4/2003 | Ishikawa et al. | 439/157 |
| 6,692,274 | B2 * | 2/2004 | Maegawa | 439/157 |
| 6,848,925 | B2 * | 2/2005 | Nishide | 439/247 |
| 6,896,531 | B2 * | 5/2005 | Bakker et al. | 439/140 |
| 7,134,901 | B2 * | 11/2006 | Okura | 439/372 |
| 2002/0168895 | A1 | 11/2002 | Suzuki | |
| 2003/0008537 | A1 * | 1/2003 | Nishide | 439/157 |
| 2003/0109167 | A1 | 6/2003 | Maegawa | |
| 2004/0147158 | A1 * | 7/2004 | Hobbs et al. | 439/378 |
| 2005/0003689 | A1 | 1/2005 | Nishide | |
| 2005/0059280 | A1 * | 3/2005 | Hobbs et al. | 439/140 |

FOREIGN PATENT DOCUMENTS

| | | |
|---|---|---|
| JP | 2000-91018 | 3/2000 |

* cited by examiner

*Primary Examiner*—Hae Moon Hyeon
*Assistant Examiner*—Harshad C Patel
(74) *Attorney, Agent, or Firm*—Gerald E. Hespos; Anthony J. Casella

(57) ABSTRACT

A female housing (10) is mounted into a male housing (30) in a direction substantially normal to a connecting direction of the two housings (10, 30), and is inserted from this mount position toward the back side of a receptacle along the connecting direction. A moving plate (40) is assembled inside the receptacle (34), has an opening (61A) that is open toward a side from which the female housing (10) is mounted, and is formed with a guiding wall (61) for positioning the female housing (10) before the connection is started by being brought into contact with the upper surface and the opposite side surfaces of the female housing (10) reaching the mount position through the opening (61A).

8 Claims, 51 Drawing Sheets

CONNECTOR DEVICE

BACKGROUND OF THE INVENTION

1. Field of the Invention

The present invention relates to a connector device.

2. Description of the Related Art

U.S. Patent Application Publication No. 2002/0168895 discloses a connector with male and female housings. The male housing has a receptacle and tabs of male terminals projecting into the receptacle. The female housing is inserted into the receptacle from the front, and both housings are connected properly by pushing the female housing towards the back side of the receptacle along an inserting direction.

An operator must position the two housings opposite to one another prior to starting a connecting operation. However, the male housing may be located at an inner distant position. In this situation, the operator must stretch his or her arm to position the two housings, thereby complicating the assembly.

U.S. Pat. No. 6,296,502 discloses a connector with first and second housings. The first housing is accommodated in a casing. The housings are engaged by inserting the second housing into the casing from above. The first housing is moved sideways by a cam mechanism formed between the first housing and the casing to be pulled towards the second housing. The two housings are connected properly when the second housing is accommodated completely into the casing. Accordingly, approaching directions of the two housings and actual connecting directions thereof are substantially normal to each other. Thus, the operator can complete a connecting operation merely by pushing the second housing toward the back side, even if the first housing is at an inner position and difficult to reach.

Frictional resistance occurs while connecting male and female terminals, and the frictional resistance becomes large as the number of terminals of the connector is increased. Thus, an excessive operating force may be required to push the second housing of the connector disclosed in U.S. Pat. No. 6,296,502, thereby presenting a large operational burden.

Some connectors use a lever to assist the connecting operation. However, the prior art lever cannot be operated in the above-described connector where at least one of the housings is at an inner position difficult to reach by the hand.

Japanese Unexamined Patent Publication No. 2000-91018 discloses a connector with a waiting-side housing and a movable-side housing. The waiting-side housing is fixed by being inserted through a through hole in a dashboard of an automotive vehicle. The movable-side housing is brought closer to the waiting-side housing from an engine compartment to connect the two housings in an instrument panel. However, a partition wall or the like in the engine compartment becomes a barrier and complicates movement of the movable-side connector housing towards the dashboard, thereby presenting assembly difficulties.

The invention was developed in view of the above problems, and an object thereof is to improve assembly efficiency of a connector.

SUMMARY OF THE INVENTION

The invention relates to a connector device with first and second housings. The first housing has a receptacle for receiving the second housing. The second housing is to be mounted into the first housing in a direction at an angle and preferably substantially normal to a connecting direction of the two housings and is inserted from a mount position towards the back side of the receptacle substantially along the connecting direction. At least one guiding wall is formed before an opening edge of the receptacle and has an opening that is open towards a side from which the second housing is to be mounted. The second housing reaches the mount position through the opening. Thus, the guiding wall positions the second housing before the connection is started by contacting the front surface with respect to a mounting direction and the opposite side surfaces of the second housing. Accordingly, the connector facilitates an operation of positioning the housings before starting a connecting operation, thereby improving operational efficiency.

A moving plate preferably is assembled in the receptacle. The moving plate has insertion holes for receiving tabs of male terminals and is movable toward the back side of the receptacle while causing the tabs to project through the insertion holes as the two housings are connected. The guiding wall preferably is formed on the moving plate. The moving plate performs two functions, namely, protecting the tabs in the receptacle and guiding the connection. Thus, the construction can be simplified.

A covering wall preferably projects forward from the opening edge of the receptacle, and the guiding wall is arranged inside the covering wall. Thus, the guiding wall and the second housing are protected by the covering wall.

The guiding wall preferably has an engageable portion resiliently engageable with at least one lock on the covering wall. The moving plate is locked partly by a locking action of the engageable portion and the lock.

The second housing preferably has a disengaging portion for contacting and deforming one of the lock and the engageable portion for disengaging the lock and the engageable portion from one another as the second housing reaches the mount position. Thus, the partly locked state of the lock and the engageable portion is canceled to permit movement of the moving plate. More particularly, the partly locked state of the moving plate is canceled by the mounting operation of the second housing. Therefore, it is not necessary to separately cancel the partly locked state.

At least one engaging projection is formed on one of the second housing and the guiding wall, and an engaging recess is formed in the other. The engaging projection and the engaging recess engage each other as the second housing reaches the mount position.

The moving plate preferably moves together with the second housing while the engaging projection and the engaging recess are kept engaged with each other when the second housing is pushed towards the back side of the receptacle. Therefore, a mechanism for moving the moving plate takes advantage of the mounting operation of the second housing.

The first and second housings preferably are connectable with each other while being at least partly accommodated in a casing. A slide is assembled to the casing and is movable towards and away from the casing at an angle and preferably substantially normal to a connecting direction of the housings. At least one movable member is mounted movably on one of the slide and the casing. The movable member has at least one operating-cam engageable with at least one operating-cam receiving portion in the other of the slide and the casing. The operating-cam has at least one cam receiving portion engageable with at least one corresponding cam on the first housing. The movable member is operated by pushing the slide into the casing to achieve a leverage or cam action with a point of force at an engaged position of the operating-cam and the operating-cam receiving portion and a point of action at an engaged position of the cam and the cam receiving portion. The cam is moved substantially along the cam receiving portion as the movable member is operated to displace the first housing relative to the casing and to pull the second housing into engagement with the first housing towards due to a cam mechanism between the casing and the second housing. Accordingly, the force required to connect the two housings is reduced and the overall operational efficiency of the connector is improved.

The movable member preferably comprises at least one lever rotatably mounted on one of the slide and the casing. The operating-cam is distanced from the center of rotation of the lever and the cam receiving portion preferably is closer to the center of rotation than the operating-cam.

The casing preferably is formed with a second opening through which the second housing is received. A protection wall substantially faces or is adjacent to the second opening and at least partly covers the front surface of the second housing entering the casing through the second opening with respect to a mounting direction of the second housing. Thus, the front surface of the second housing is covered at least partly by the protection wall. Accordingly, the second housing is less likely to interfere with external matter and less likely to move inadvertently in the casing.

At least one guide preferably projects from one of the first housing and the casing, and at least one guiding groove preferably is formed in the other of the first housing and the casing. The guiding groove extends at an angle and preferably substantially normal to the connecting direction. The guide is moved along the guiding groove to displace the first housing relative to the casing at an angle to the connecting direction and preferably a right angle. The two housings are connected in this state. Thus, the connected position of the first housing is prevented from being displaced along the connecting direction.

The guiding groove preferably is formed in the casing. The lever or other movable member preferably is formed with a resilient lock for keeping the movable member at an operation starting position. The resilient lock is normally engaged with a wall of the guiding groove and interferes with the guide to cancel a locked state as the first housing is mounted into the casing. Thus, movement of the lever or other such movable member is permitted.

The first housing preferably has at least one detector that projects from the casing. At least one operating surface of the slide has a detection window through which the detector projects when the two housings are connected properly. Thus, the connected state of the two housings can be detected e.g. by visually confirming whether the detector projects into the detection window by looking at the operating surface of the slide.

The projecting end of the detector preferably is either substantially flush with the opening of the detection window or projecting from the opening when the two housings are connected properly. Thus, visibility is assured.

At least one protection rib preferably is formed on the operating surface of the slide and stands adjacent the end of the detector that projects in or through the opening of the detection window.

The connected state of the two housings easily can be detected visually by comparing the height of the end of the detector projecting from the opening of the detection window and the height of the end of the protection rib on the operating surface of the slide. Any part of the detector that projects from the opening of the detection window is protected by the protection rib.

One of the slide and the casing preferably has at least one resiliently deformable casing-lock projecting therefrom and the other of the slide and the casing preferably has at least one casing-lock receiving portion. The casing-lock is resiliently engageable with the casing-lock receiving portion when the two housings are connected properly to hold the slide and the casing together. Therefore, the two housings do not need locking means.

The casing-lock preferably contacts an abutting surface in the process of pushing the slide into the casing. The abutting surface is before an engaged position with the casing-lock receiving portion and hence interrupts the pushing operation. The casing-lock preferably disengages from the abutting surface in response to an operating force that exceeds a resistance between the abutment and the slide. Thus, the slide is moved at a stroke by inertial force. Therefore, the slide and the casing can be brought securely to a proper locked position and the two housings will not be left insufficiently connected.

The cam mechanism preferably includes at least one guiding cam groove in one of the casing and the second housing, and at least one respective guiding cam projecting from the other thereof. At least one temporarily holding portion is formed at the guiding cam for interfering with the guiding cam portion and restricting movement of the second housing towards the first housing by before the two housings are connected. Thus, the second housing will not move inadvertently towards the first housing along the guiding cam groove before the two housings are connected.

The guiding cam preferably includes rotation-preventing surfaces for contacting opposite side surfaces of the guiding cam groove over a long distance (preferably more than about half of the extension thereof, more preferably more than about two thirds of the extension thereof in an extending direction of the guiding cam groove. Thus, the second housing will not pivot due to the rotation of the guiding cam in the guiding cam groove.

A plurality of substantially parallel guiding cam grooves preferably extend substantially parallel to each other along a moving direction of the second housing and correspond to a plurality of guiding cams. Thus, the second housing can be moved in a substantially stable posture.

The guiding cams preferably fit into the corresponding guiding cam grooves after resiliently moving over edges of the guiding cam grooves in the process of mounting the second housing into the casing. The projecting height of guiding cam located more forward with respect to a mounting direction of the second housing into the casing preferably is lower than the one located more backward. As a result, an operator will not feel a resistance accompanying the contact of the guiding cams and the edges of the guiding cam grooves until a final stage of mounting the second housing into the casing, thereby improving operability upon mounting the second housing.

The second housing is moved at an angle to the connecting direction for engagement with the first housing. Accordingly, the first housing preferably has a substantially gate- or bridge- or frame-shaped guiding wall that is open at a side from which the second housing is received, and the second housing can fit inside the guiding wall. The guiding wall enables the second housing to be located at a position where the connection with the first housing can be started.

Two levers preferably are arranged at opposite widthwise sides of the casing. The slide preferably has an operating portion and slide mounting portions project from opposite ends of the operating portion. The slide preferably is mounted to substantially straddle or span the casing with the levers arranged between the slide mounting portions and the casing. Thus, the connector is well-balanced to improve operability upon pushing the slide.

The levers preferably couple the slide integrally to the casing. Thus, the number of parts can be reduced and the connector can be handled better.

The second housing preferably is movable relative to the casing between an initial position and an end position and is properly connectable with the first housing at the end position. The first housing is displaceable relative to the casing in a direction intersecting with a moving direction of the second housing, and is engaged with the second housing in the displacing process. The first housing includes at least one contact portion and the second connector housing includes at least one resting portion substantially facing the contact portion in a returning direction of the second housing from the end position towards or to the initial position. The resting portion preferably is deflected by contact portion as the first connector housing is displaced upon separating the two housings. Thus, the second housing is returned easily towards the initial position. Accordingly, the connector is suitable for repeated and continuous use, thereby improving operability.

The contact portion preferably is at the opening edge of the receptacle of the first housing, and the resting portion preferably projects substantially towards the first housing for insertion into the receptacle when the two housings are engaged. Thus, a moving stroke of the second housing can be varied by changing a projecting amount of the resting portion.

The casing preferably has at least one stopper wall that can contact the front surface of the second housing with respect to the returning direction thereof to the initial position. The stopper wall has springiness to receive the second housing while being resiliently deformed when the resting portion is deflected slightly more than necessary by the contact portion. Thus, a deviation of an actual moving stroke of the second housing from a set value can be accommodated. Further, the second housing can reach the initial position as the stopper wall is restored.

The receptacle preferably has plate locks for engaging lock receiving portions on the moving plate for preventing a backward movement of the moving plate. The plate locks and the lock receiving portions preferably are at diagonal positions at the opposite sides of the center of the moving plate. Thus, the moving plate can be moved in a stable posture and is less likely to incline in a direction intersecting an axial direction, as compared to a case where one lock is set in the center of the moving plate. As a result, the tabs of the male terminals can be connected in stable postures, and the connection reliability is improved.

The lever preferably has at least one resilient lock extending substantially tangent to a rotating direction of the lever. The resilient lock is resiliently deformable along the thickness direction thereof. A rotation-preventing surface is formed near the free end of the resilient lock for contacting a lever receiving portion on the casing in the rotating direction of the lever for holding the lever at a rotation starting position. Therefore, the locked state achieved by the resilient lock is not likely to be canceled inadvertently when the lever is at the rotation starting position.

The connector device may comprise a waiting-side module that includes the first housing, and a movable-side module that includes a second housing. The movable-side module is displaceable between an initial position where the movable-side module is opposed to and spaced from the waiting-side module and a connected position reached by pushing the movable-side module towards the waiting-side module to connect the first and second housings. The movable-side module is formed with at least one temporarily holding portion engaged with a holding member fixed to a mounting surface for temporarily holding the movable-side module at the initial position.

The movable-side module and the waiting-side module initially are positioned substantially opposite to each other. The movable-side module then is moved closer toward the waiting-side module while canceling the temporarily held state. Thus, the first and second housings are connected. Panels and the like can be assembled at a movable side and a waiting side beforehand to improve operational efficiency. Further, a displacement that can occur between the two modules can be corrected while the movable-side module is moved.

The temporary holding portion preferably is exposed at a pushable surface of the movable-side module. The temporary holding portion is constructed to cancel a temporarily held state between the temporary holding portion and the holding member by pushing the temporary holding portion. Thus, the movable-side module can be moved from the initial position to the connected position. As a result, an operation of canceling the temporarily held state and an operation of moving the movable-side module can be performed easily by one motion.

The holding member preferably includes a mounting piece for guiding a movement of the movable-side module by extending a pushing direction of the movable-side module. The movable-side module is formed with a mounting-piece inserting portion for receiving the mounting piece. The mounting piece is insertable into and withdrawable from the mounting-piece inserting portion as the movable-side module is moved. A loose-movement preventing portion is provided for engaging the mounting piece to prevent loose movement of the movable-side module. The loose-movement preventing portion preferably is formed by inner walls of the mounting-piece inserting portion. Further, the movable-side module can correct a displacement with respect to the waiting-side module within a range permitting a loose movement of the movable-side module by the mounting piece retreating from the loose-movement preventing portion to be disengaged therefrom when the movable-side module is engaged with the waiting-side module.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
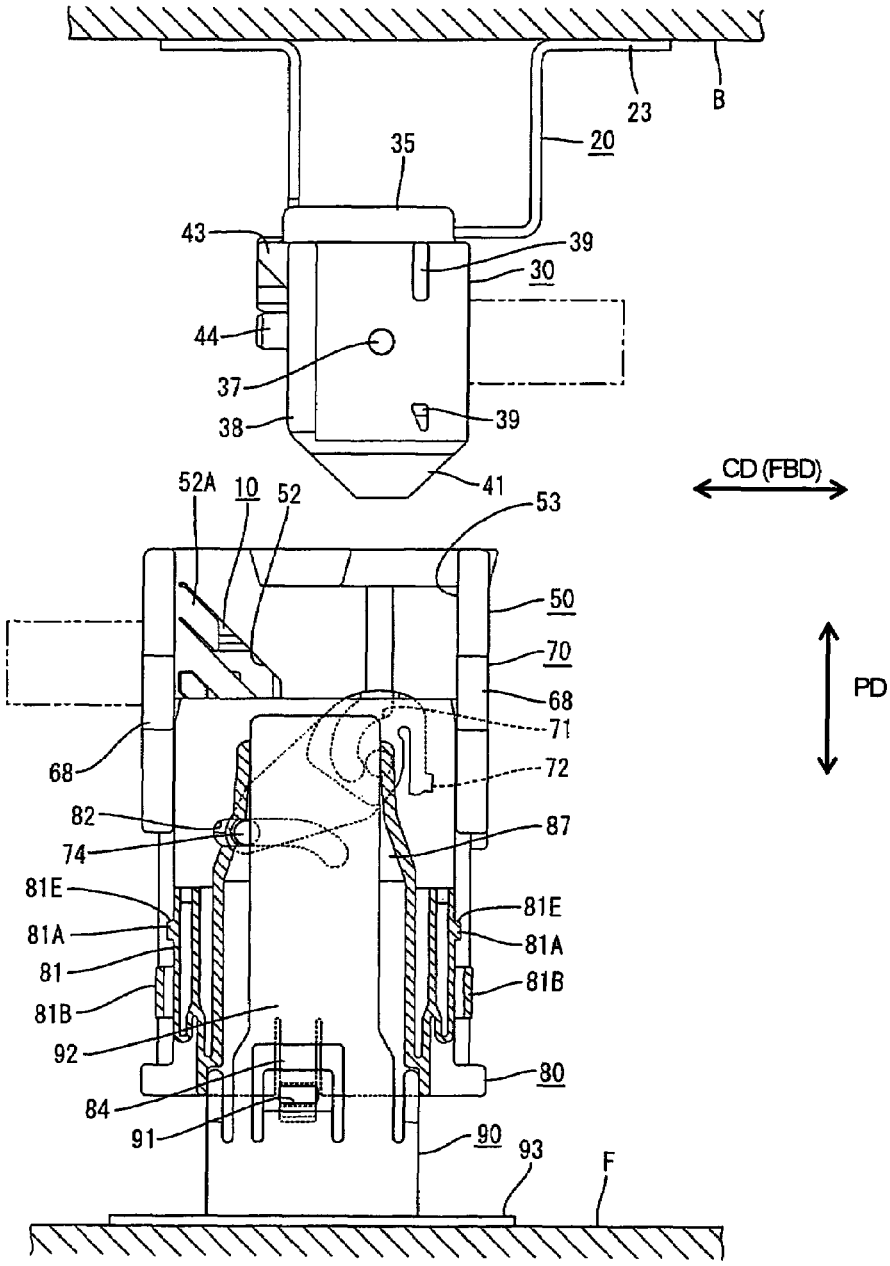
FIG. 1 is a side view of a connector device according to one embodiment of the invention with an essential portion shown in section, showing a state where a slide is held temporarily held on a fitting.

A connector according to a first embodiment is illustrated in FIGS. 1 to 33. The connector has a female housing 10 and a male housing 30 that are connectable with one another along a connecting direction CD. The two housings 10, 30 are accommodated in a casing 50 and a slide 80 is mountable movably to the casing 50. Levers 70 are provided for reducing an operating force of the slide 80 and assisting a connecting operation of the two housings 10, 30. A moving plate 40 is mounted into the male housing 30. The slide 80 is to be arranged near a mounting surface F of a dashboard of an automotive vehicle, and the male housing 30 is to be fixed to a mounting surface B of an engine compartment substantially facing to the mounting surface F. The female housing 10 initially is mounted in the casing 50. The male housing 30 then is mounted in the casing 50. The slide 80 then is pushed towards the engine compartment. As a result, the two housings 10, 30 are brought closer together in directions substantially normal to a pushing direction PD of the slide 80 for connecting the two housings 10, 30. The female housing 10, the casing 50, the levers 70 and the slide 80 define a cockpit-side module or "movable-side module", whereas the male housing 30 defines a vehicle-side module or "waiting-side module". In the following, mating sides of the connectors 10, 30 will be referred to as front or front sides.

Figure 17:
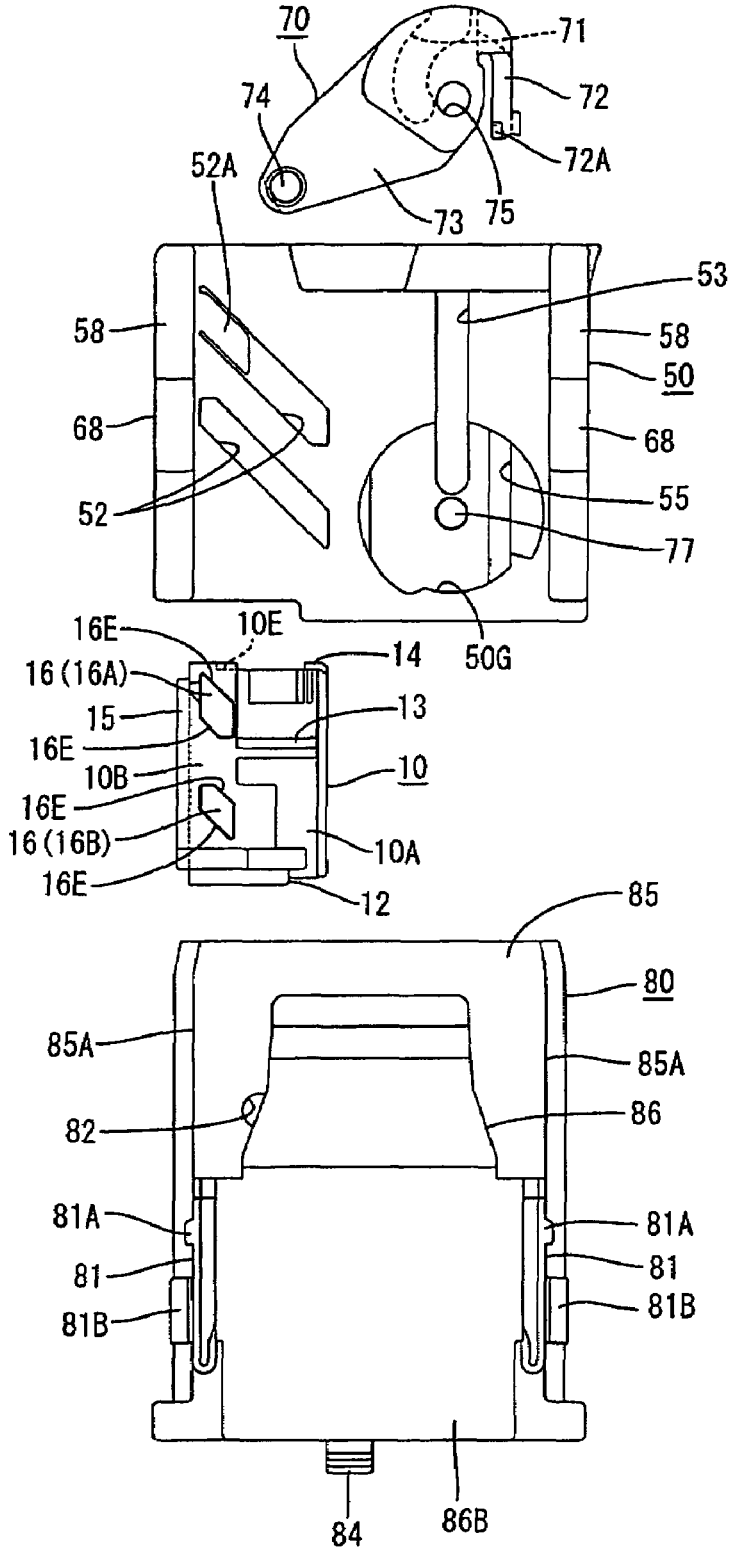
FIG. 17 is an exploded side view of the cockpit-side module.
Figure 21:
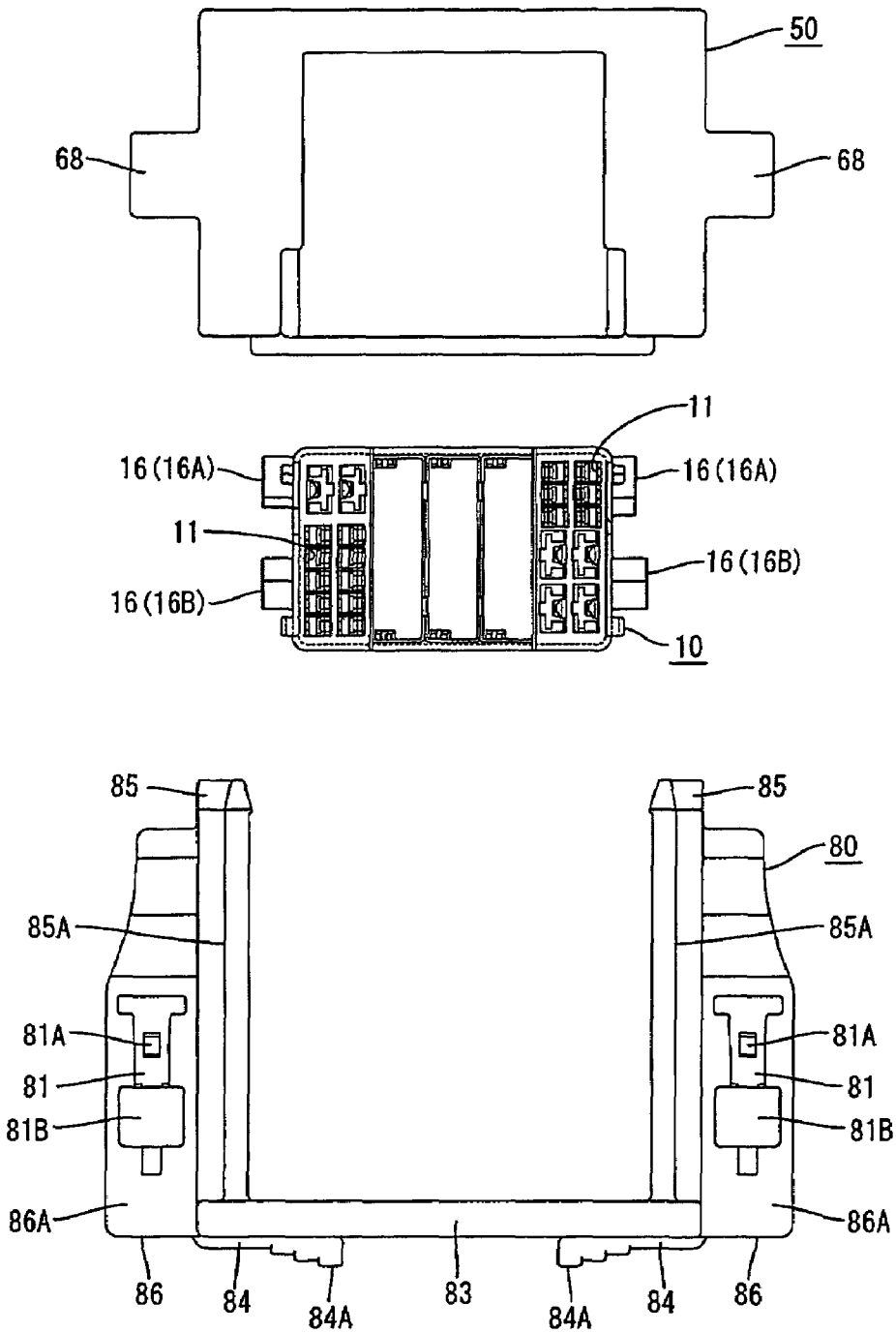
FIG. 21 is an exploded front view of the cockpit-side module.

As shown in FIG. 21, the female housing 10 is substantially a block made e.g. of a synthetic resin. Cavities 11 are formed in the female housing 10 for receiving female terminals connected with ends of unillustrated wires. As shown in FIG. 17, a front half 10A of the female housing 10 is narrowed slightly relative to a rear half 10B via a diverging surface 12 between the front and rear halves 10A, 10B. Two engaging guide ribs 13 are formed on the opposite side surfaces of the front half 10A and extend in forward and backward directions FBD and along the connecting direction CD. The engaging guide ribs 13 are inserted into engaging guide grooves 31 formed in the male housing 30 to guide the connection of the two housings 10, 30. Two disengaging projections 14 are formed at the opposite sides of the front end of the upper surface of the female housing 10, and are engageable with resilient locking pieces 32 in the male housing 30.

Two mount-guides 15 project back at the opposite lateral ends of the rear of the female housing 10. The mount-guides 15 slide in contact with mount-guide receiving portions formed in the casing 50 to guide a mounting operation of the female housing 10. Two guiding cams 16 project on the opposite side surfaces of the rear half 10B of the female housing 10 and are spaced vertically from each other. The guiding cams 16 enter guiding cam grooves 52 in the casing 50 and move along the guiding cam grooves 52 to bring the female housing 10 closer to the male housing 30 along the connecting direction CD. The guiding cams 16 have substantially polygonal cross sections. More particularly, the upper guiding cams 16A have a shorter projecting height than the lower guiding cams 16B. Front and rear surfaces of the guiding cams 16 are substantially upright and normal to the connecting direction CD. However, the upper and lower surfaces thereof are sloped down toward the front with respect to the connecting direction CD and substantially parallel to each other. The upper and lower surfaces of the guiding cams 16 contact the opposite side surfaces of the guiding cam grooves 52 along their extending directions in a long range to prevent the guiding cams 16 from tilting in the guiding cam grooves 52. The upper and lower surfaces of the guiding cams 16 function as rotation-preventing surfaces 16E to prevent the female housing 10 from pivoting in the casing 50.

Figure 7:
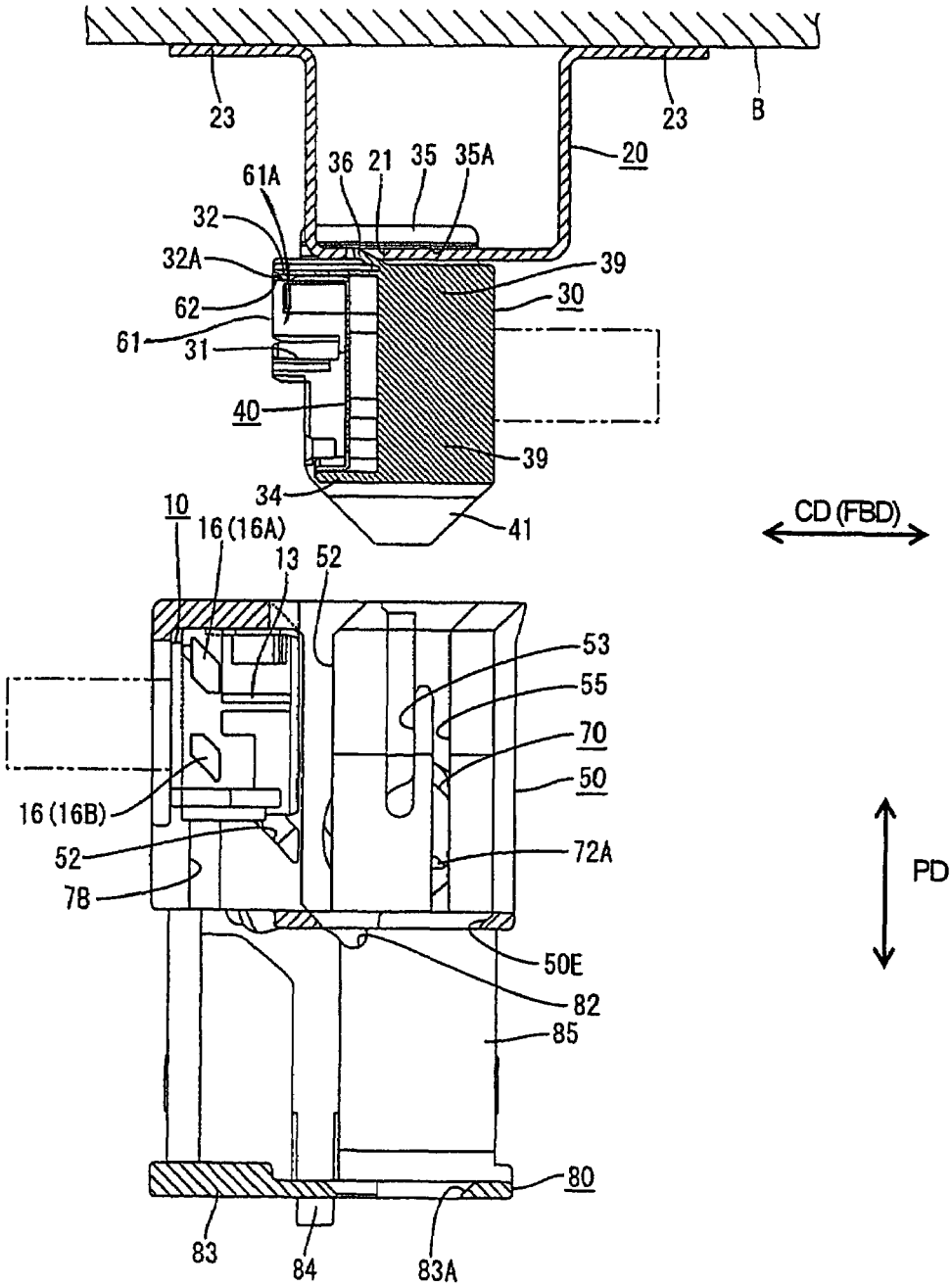
FIG. 7 is a side view in section showing the state where the cockpit-side module and the vehicle-side module are opposed to each other.
Figure 8:
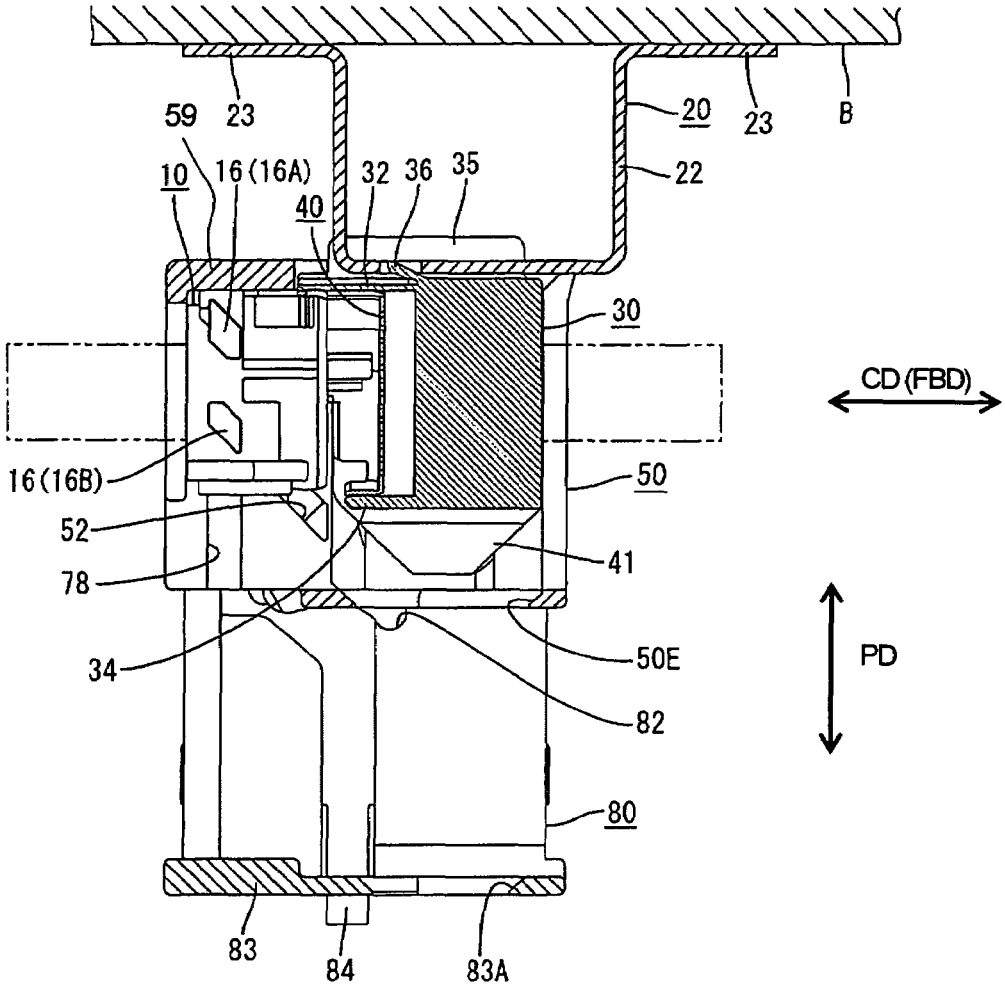
FIG. 8 is a side view in section showing a state where the male housing is inserted in the casing.

The male housing 30 has a terminal accommodating portion 33 and a receptacle 34 projects forward from the front surface of the terminal accommodating portion 33, as shown in FIG. 7. Two rails 35 are formed at the opposite ends of the upper surface of the male housing 30 and extend in forward and backward directions FBD. The surfaces of both rails 35 facing each other are recessed to form mounting grooves 35A for slidably receiving a mounting member 20 to fix the male housing 30 removably to the mounting surface B via the mounting member 20. A resilient piece 36 cantilevers obliquely up to the front in a substantially middle part of the upper surface of the male housing 30, and is engageable with an opening edge of a mount opening 21 in the mounting member 20, as shown In FIG. 8. The base end of the resilient piece 36 is at a boundary between the receptacle 34 and the terminal accommodating portion 33.

Figure 24:
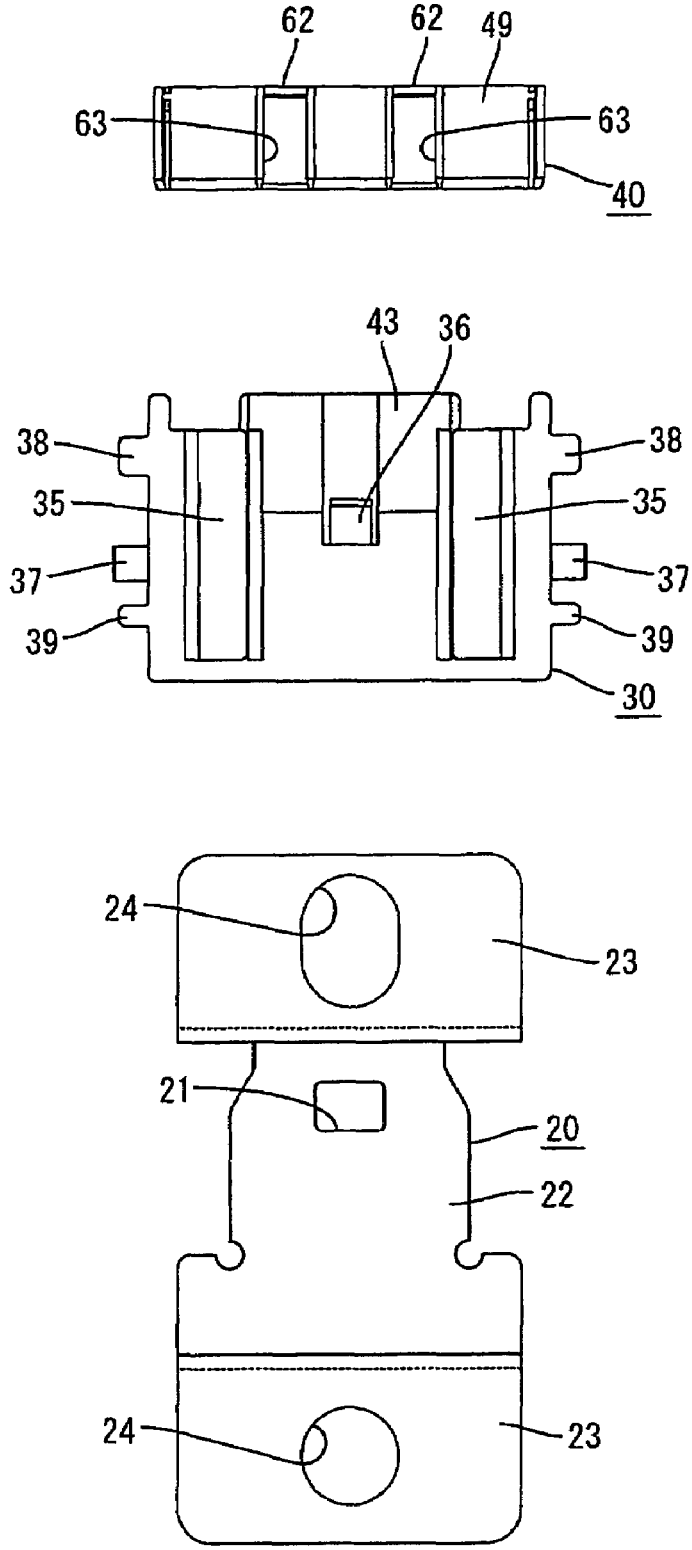
FIG. 24 is an exploded plan view of the vehicle-side module.
Figure 25:
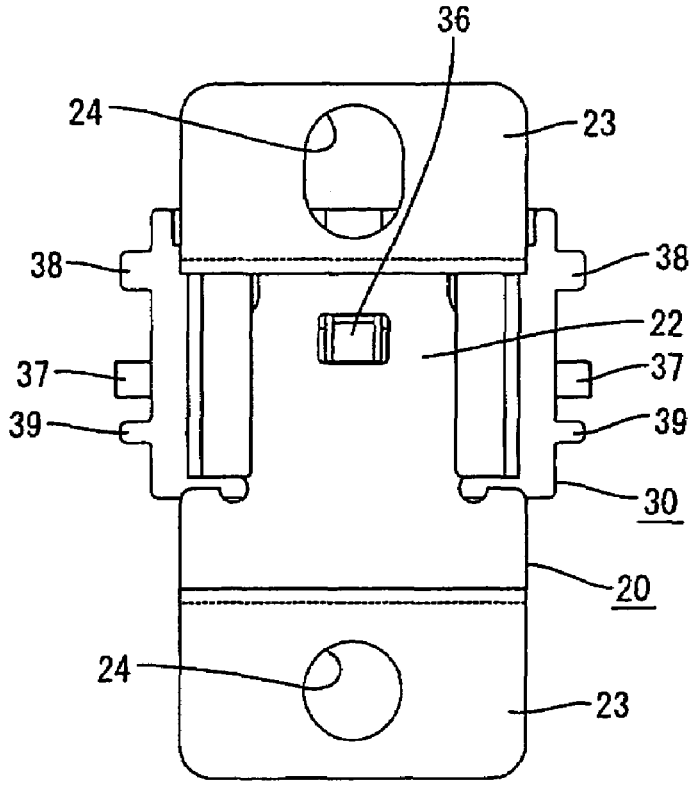
FIG. 25 is a plan view showing a state where the vehicle-side module is assembled.

The mounting member 20 is made of a rigid material, preferably of a metal, and an intermediate part 22 is bent into a substantially U-shape to bulge out and away from the mounting surface B. A mount opening 21 is formed in the bottom wall of the intermediate part 22. Two flanges 23 are formed as the upper wall of the mounting member 20, and each flange has a bolt inserting hole 24, as shown in FIG. 24. Bolts can be inserted through the bolt inserting holes 24 to fasten the mounting member 20 to the mounting surface B. One of the two bolt inserting holes 24 is oblong and has a long axis that extends substantially along forward and backward directions FBD.

Figure 6:
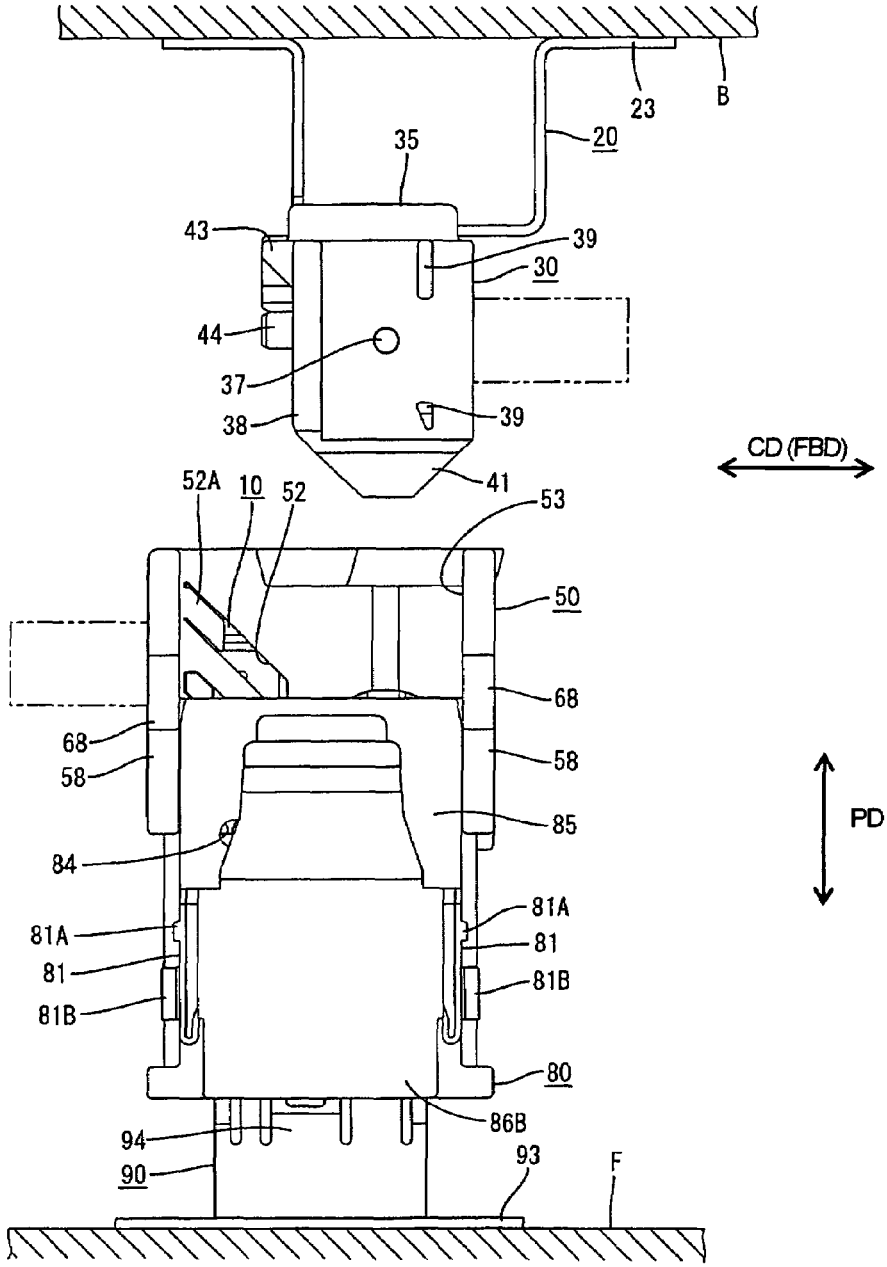
FIG. 6 is a side view showing a state where a cockpit-side module and a vehicle-side module are opposed to each other.

As shown in FIG. 6, two cams 37 project substantially in the centers of the opposite side surfaces of the male housing 30. The cams 37 are introduced through cam introducing grooves 53 in the casing 50 to engage cam receiving portions 71 in the levers 70. The cams 37 are moved relatively along the cam receiving portions 71 as the levers 70 are rotated.

Guide ribs 38 are formed at the front edges of the opposite side surfaces of the male housing 30 and extend over the entire vertical range along the pushing direction PD and substantially normal to the connecting direction CD. The guide ribs 38 are movable along guide receiving grooves 54 in the casing 50. Two vertically spaced guides 39 are near the rear end of each of the opposite side surfaces of the male housing 30. Similar to the guide ribs 38, the guides 39 are movable along guiding grooves 55 in the casing 50. Thus, the male housing 30 is movable relative to the casing 50 substantially vertically along the pushing direction PD and substantially normal to the connecting direction CD. The male housing 30 is to be fixed to the mounting surface B. Thus, the casing 50 moves vertically on the mounting surface B.

The lower guides 39A engage resilient locks 72 on the levers 70 in the guiding grooves 55 to deform the resilient locks 72 in the unlocking direction. Thus, the levers 70 held at rotation starting positions are released from a locked state. Slanted disengagement guiding surfaces 39A are formed on the lower surfaces of the lower guides 39 for generating smooth resilient deformation of the resilient locks 72.

Figure 26:
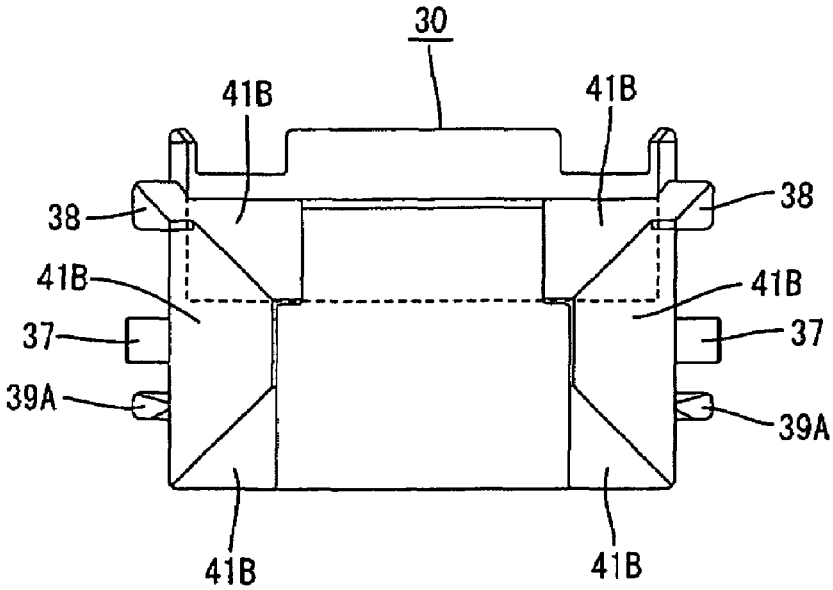
FIG. 26 is a rear view of the male housing.
Figure 27:
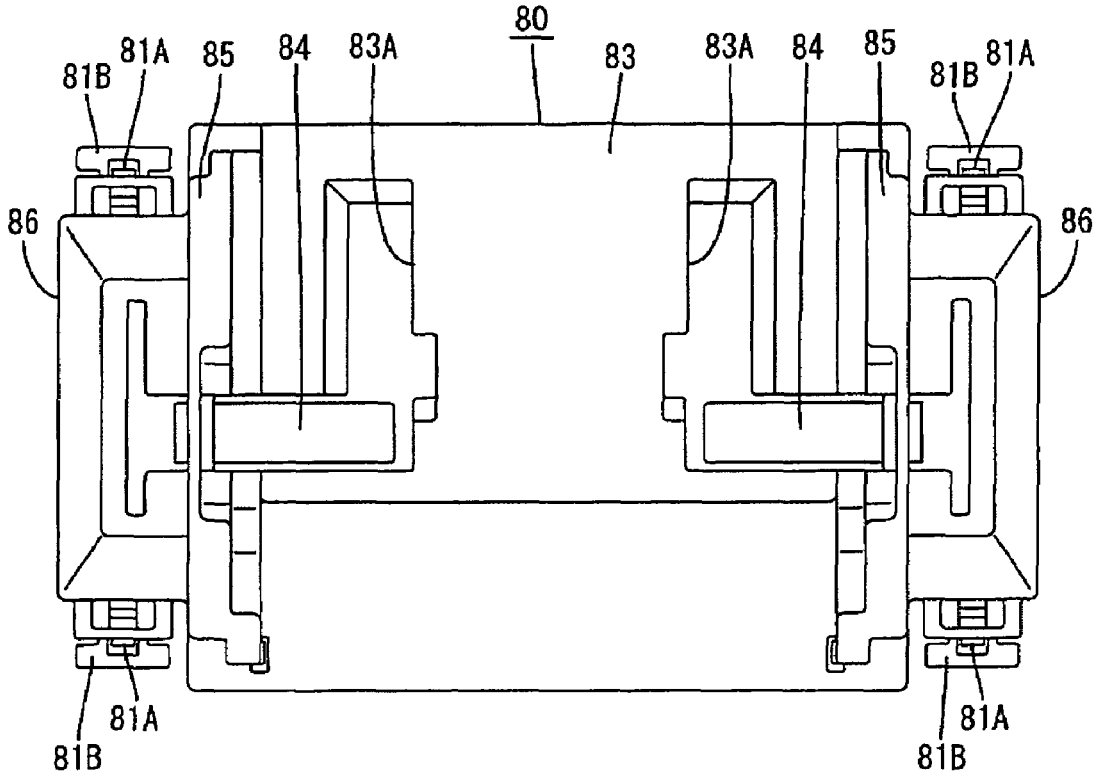
FIG. 27 is a plan view of the slide.

Two detectors 41 project at the opposite lateral sides at the bottom surface of the male housing 30. Each detector 41 is substantially a rectangular block that is united unitarily with the corresponding lateral ends of the bottom surface of the male housing 30 over substantially the entire length along forward and backward directions FBD. Each detector 41 is tapered towards the projecting end to reduce the length and the width thereof. More specifically, each detector 41 has three slanted surfaces 41B as shown in FIG. 26. The slanted surfaces 41B are brought substantially into engagement with a corresponding guiding surface 50B in the casing 50. Thus, the male housing 30 is or can be guided into the casing 50.

Figure 22:
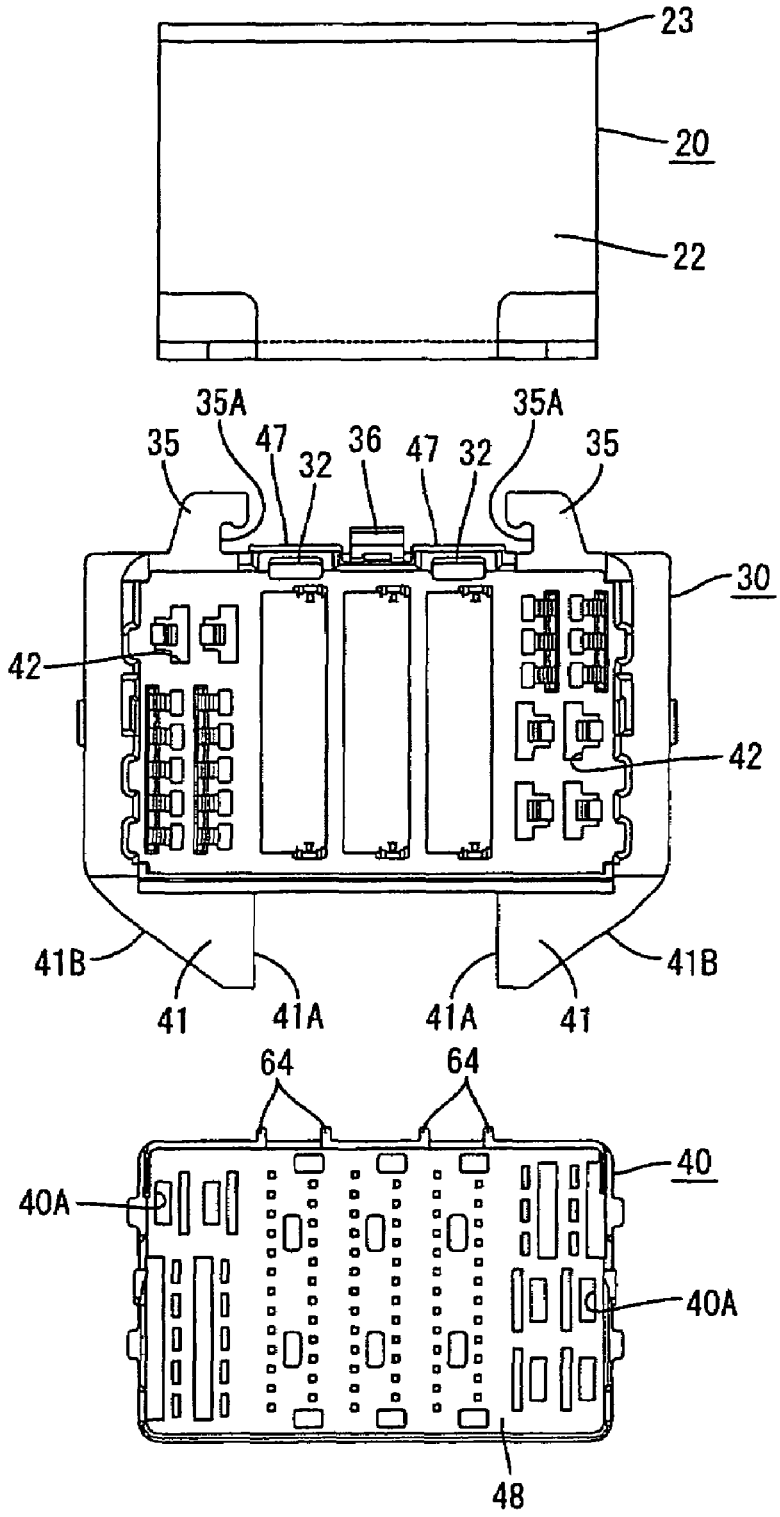
FIG. 22 is an exploded front view of the vehicle-side module.
Figure 23:
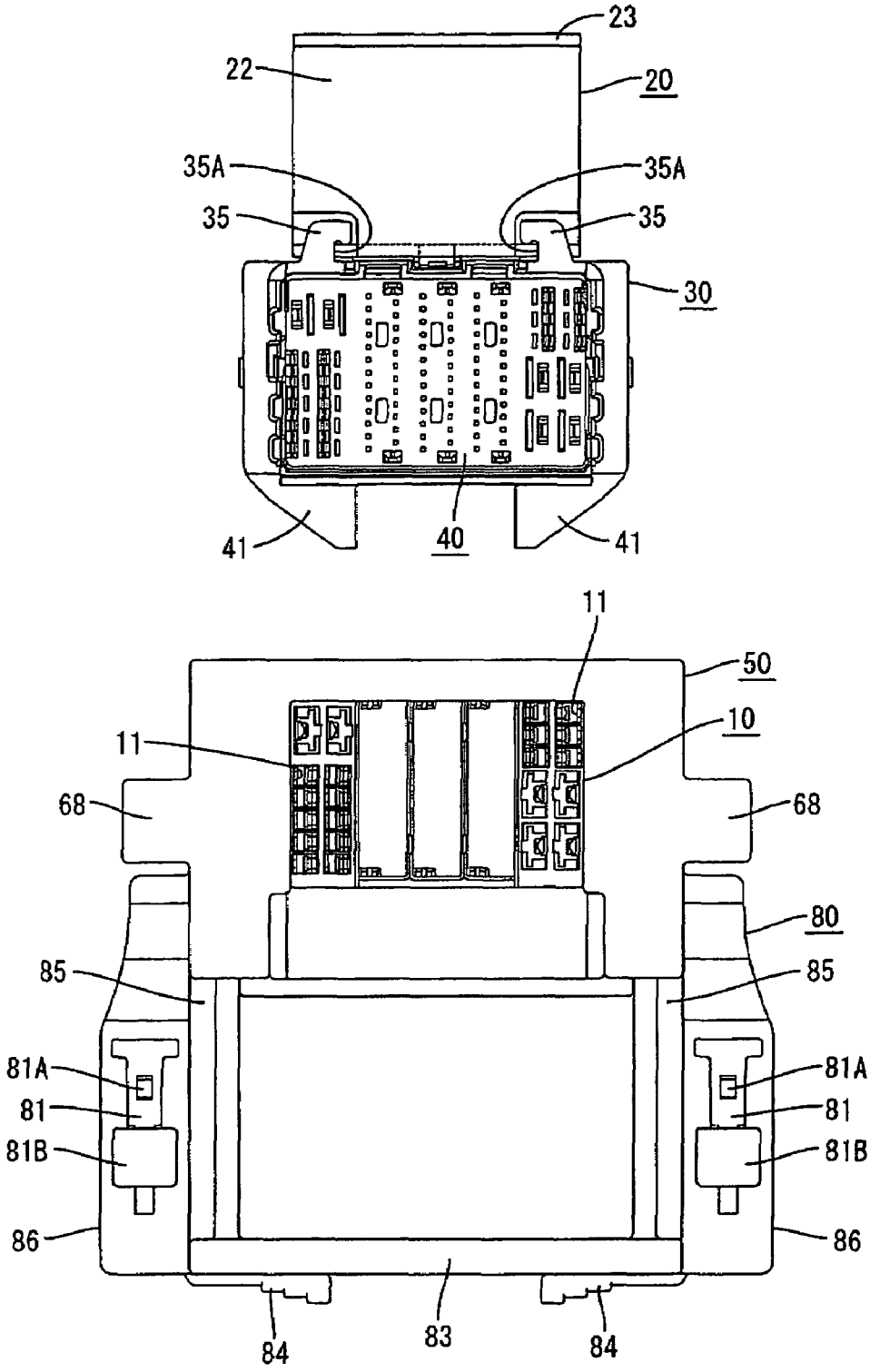
FIG. 23 is a front view showing a state where the cockpit-side module and the vehicle-side module are opposed to each other.

The terminal accommodating portion 33 includes cavities 42 for receiving male terminals connected with ends of unillustrated wires. The cavities 42 are at positions corresponding to the cavities 11 of the female housing 10, as shown in FIG. 22. The receptacle 34 is a substantially rectangular tube, and tabs of the male terminals project into the receptacle 34. A covering wall 43 projects from the upper wall and the opposite side walls of the receptacle 34 and has a front end more forward than the front end of the bottom wall of the receptacle 34. Thus, the front end of the upper wall of the receptacle 34 is more forward than the front end of the bottom wall of the receptacle 34, and the covering wall 43 extends from the projecting part of the upper wall to the opposite side walls.

As shown particularly in FIGS. 15 and 16, the covering wall 43 is substantially in the form of a frame having an open bottom end, and the female housing 10 inserted from below can be received inside the covering wall 43. More specifically, the covering wall 43 is comprised of an area projecting forward from the upper wall of the receptacle 34 and areas projecting forward from the opposite side walls of the receptacle 34. Clearances are defined between these areas, and the front end surfaces of the rails 35 face these clearances. The lower surfaces of the areas projecting forward from the opposite side walls of the receptacle 34 are sloped up toward the front.

The female housing 10 can be pressed against the inner side of the covering wall 43 before the two housings 10, 30 are connected, and engages with the male housing 30 with the exposed outer wall surfaces thereof covered by the covering wall 43. Two engagement guides 44 project forward from the front edges of the opposite side walls of the receptacle 34. The engagement guides 44 preferably are arranged substantially side by side below the covering wall 43 and project substantially the same distance as portions of the covering wall 43 formed at the opposite side walls. Plate guiding recesses 46 are formed inside the engagement guiding portions 44 and are engageable with plate guiding projections 45 of the moving plate 40.

The upper wall of the receptacle 34 has a double-plate structure area consisting of upper and lower plates. Two resiliently deformable locking pieces 32 are formed on the lower plate and are capable of locking the moving plate 40. The resilient locking pieces 32 cantilever forward from the front end surface of the terminal accommodating portion 33, and are resiliently deformable up and down towards and away from the receptacle 34. Locking projections 32A project down at the leading ends of the resilient locking pieces 32. The upper plate has bulges 47 that cover the respective resilient locking pieces 32 from above or outside while defining deformation permitting spaces for the resilient locking pieces 32, as shown in FIG. 22. The resilient piece 36 is arranged at the rear end of the bottom of a groove defined between the two side by side bulges 47. It should be noted that the front ends of both rails 35 are behind the front end of the covering wall 43.

Figure 15:
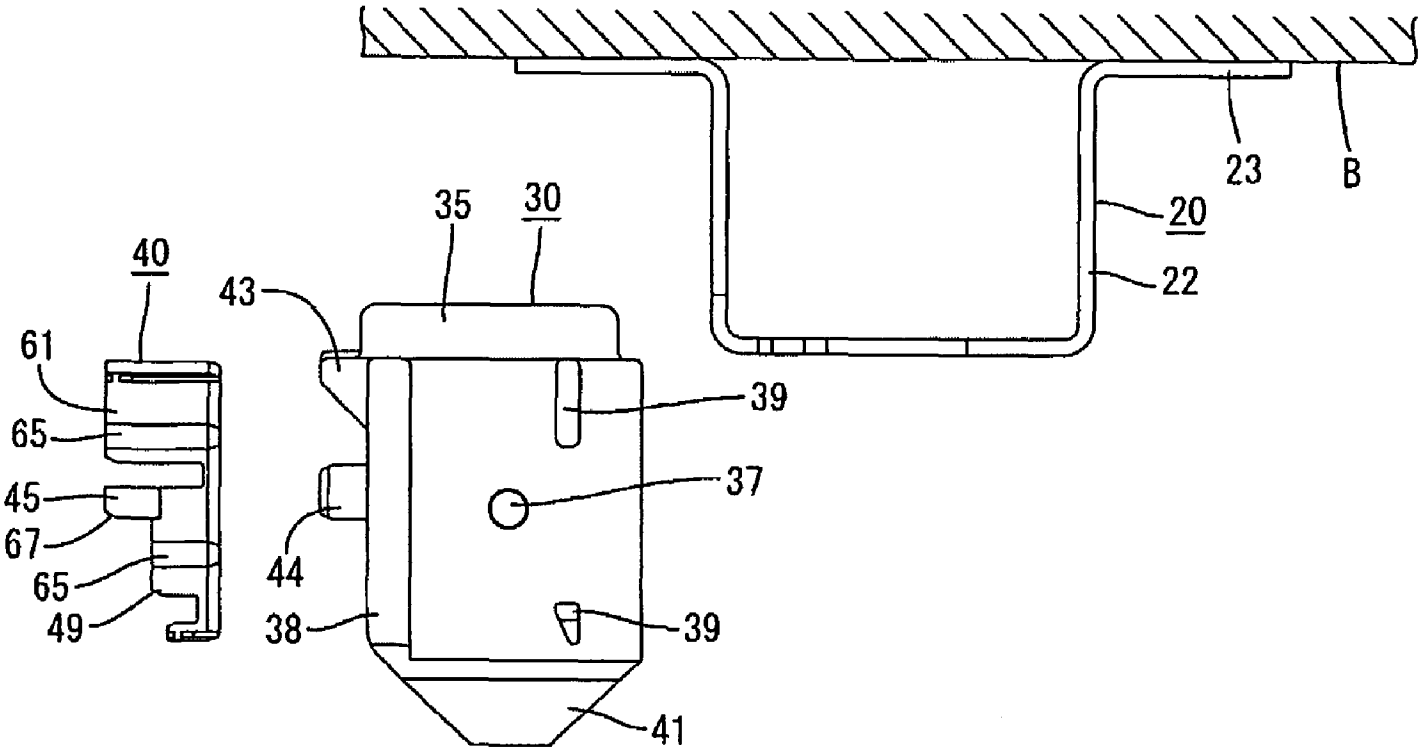
FIG. 15 is an exploded side view of the vehicle-side module.

As shown in FIGS. 15 and 22, the moving plate 40 has a substantially rectangular plate main body 48 and a fittable tube 49 projects forward along the connecting direction CD from the outer periphery of the plate main body 48. The plate main body 48 is dimensioned to substantially close the receptacle 34 and is arranged substantially normal to the connecting direction CD. Insertion holes 40A penetrate the plate main body 48 and are disposed to the respective tabs of the male terminals.

The upper portion of the fittable tube 49 projects more forward than that of the lower portion thereof to define a guiding wall 61 that includes the upper wall and parts of the opposite side walls of the fittable tube 49. The guiding wall 61 is inside the covering wall 43 when the moving plate 40 is mounted in the male housing 30. An opening 61A is formed in the guiding wall 61 and is configured for receiving the female housing 10. Thus, the female housing 10 can be mounted through the opening 61A to a mount position with respect to the male housing 30. The female housing 10 having reached the mount position faces the opening of the receptacle 34 of the male housing 30 while being embraced by the guiding wall 61, and the connecting operation of the female and male housings 10, 30 is started from this position. In other words, the female housing 10 may be fit inside the guiding wall 61 from below and may be brought to a position where connection with the male housing 30 can be started.

Two engageable portions 62 are formed at the front ends of intermediate portions of the upper wall of the fittable tube 49 and are supported at both ends. Through holes 63 are formed behind the engageable portions 62, as shown in FIG. 16. The locking projections 32A of the resilient locking pieces 32 are engageable with the rear surfaces of the engageable portions 62 so that the moving plate 40 is locked partly in the receptacle 34.

The female housing 10 can be inserted into the receptacle 34 from below and advanced to the mount position. As a result, the disengaging portions 14 of the female housing 10 enter the through holes 63 of the moving plate 40 to push the locking projections 32A up and to release the moving plate 40 from the partly locked state. Plate guiding ribs 64 stand at the opposite widthwise edges of the through holes 63 (FIG. 24). The plate guiding ribs 64 enter into clearances between the bulges 47 and the respective resilient locking pieces 32 to guide a movement of the moving plate 40.

Figure 16:
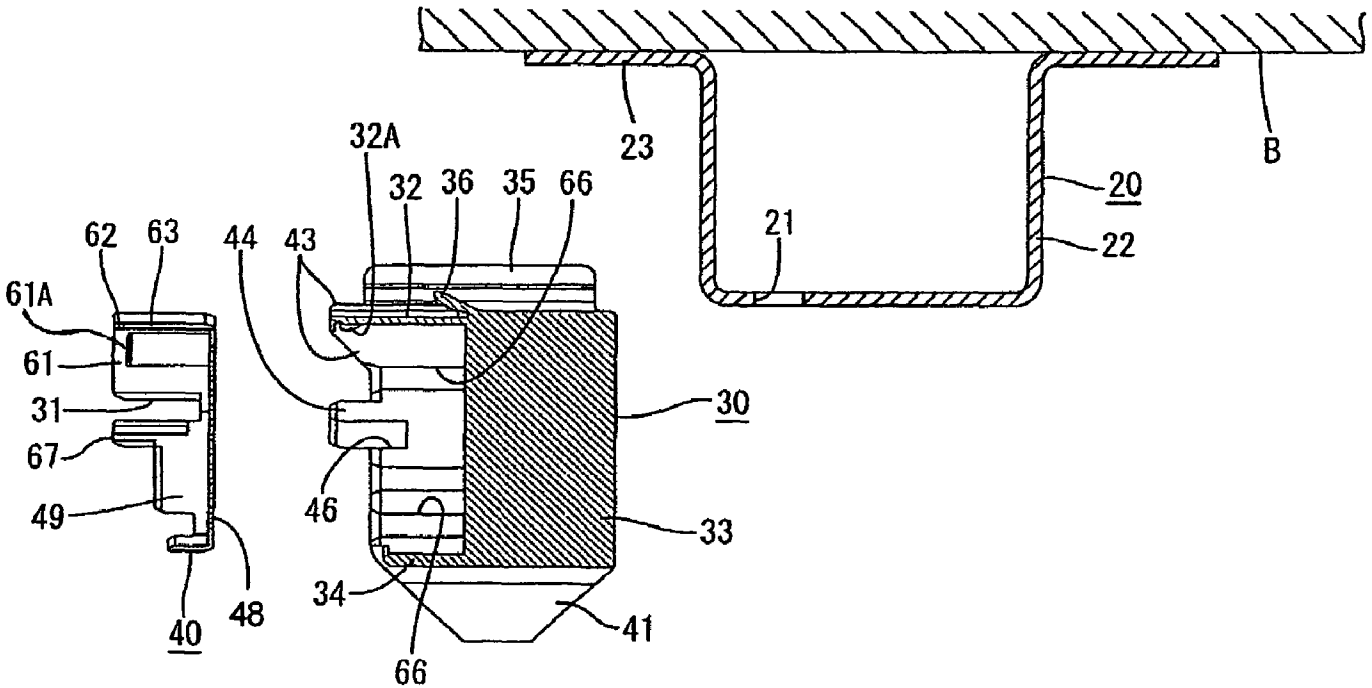
FIG. 16 is an exploded side sectional view of the vehicle-side module.

Two forwardly open engagement guiding grooves 31 are formed in the opposite side walls of the fittable tube 49 and extend in forward and backward directions FBD (FIG. 16). The engagement guiding ribs 13 of the female housing 10 can be inserted into the engagement guiding grooves 31 from the front. Two plate guiding projections 65 (FIG. 15) extend in forward and backward directions FBD at positions above and below the engagement guiding groove 31 on the outer surface of each side wall of the fittable tube 49. The plate guiding projections 65 fittable into the respective plate guiding grooves 66 in the inner side surfaces of the receptacle 34 to guide a movement of the moving plate 40.

Two plate resilient pieces 67 (FIG. 15) are formed immediately below the engagement guiding grooves 31 and are resiliently deformable in and out. Plate guiding protrusions 45 are formed on the outer surfaces of the plate resilient pieces 67 and are engageable with the respective plate guiding recesses 46 of the receptacle 34 to guide a movement of the moving plate 40, similar to the plate guiding projections 65. The moving plate 40 may be locked partly in the receptacle 34 before the housings 10, 30 are connected. The moving plate 40 is released from the partly locked state to be permitted to move when the female housing 10 is fit into the receptacle 34 and moves towards the back side of the receptacle 34 as the two housings 10, 30 are connected. Thus, the tabs gradually project through the insertion holes 40A.

Figure 32:
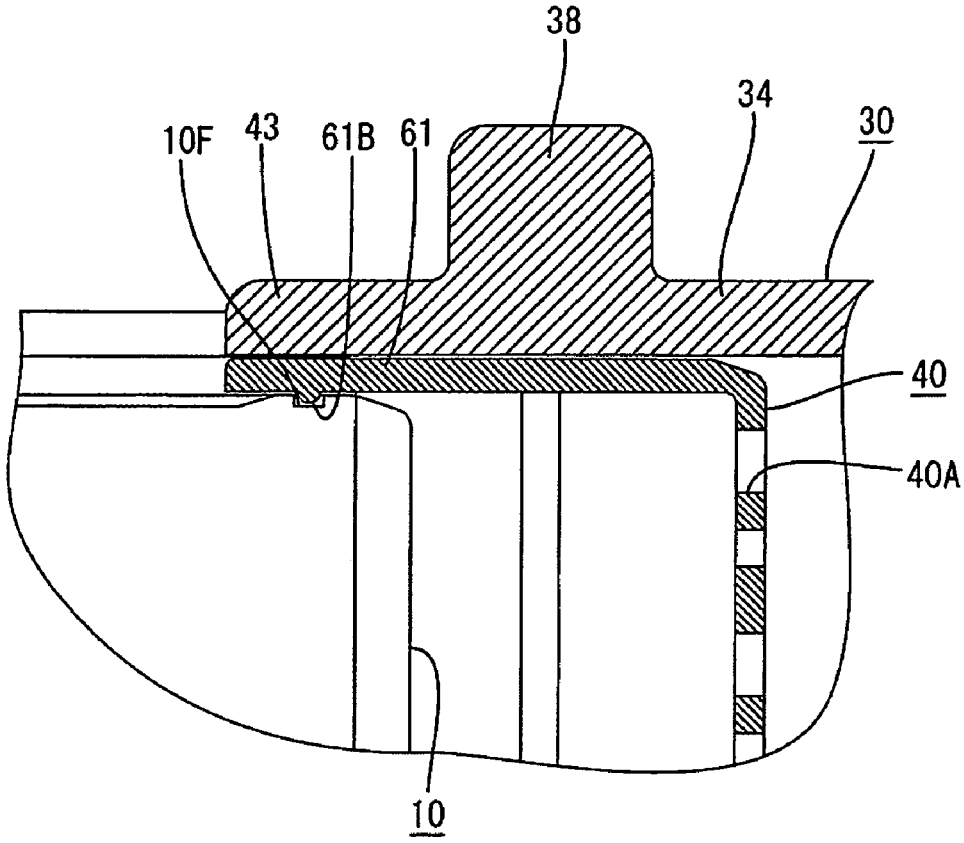
FIG. 32 is an enlarged horizontal section showing an essential portion of an engaging projection and an engaging recess engaged together.

Vertically extending rib-shaped engaging projections 61B are formed on the opposite side walls of the fittable tube 49 at the rear ends of the inner side surfaces, as shown in FIG. 32. Vertically extending groove-shaped engaging recesses 10F are formed substantially at the front end of the opposite outer side surfaces of the female housing 10 at positions corresponding to the engaging projections 61B. The engaging recesses 10F engage the engaging recesses 61B when the female housing 10 reaches the mount position and remain engaged as the female housing 10 is inserted towards the back of the receptacle 34. As a result, the moving plate 40 moves together with the female housing 10. The moving plate 40 is stopped by the contact of the back surface of the receptacle 34 during the movement of the female housing 10. The engaging projections 61B disengage from the engaging recesses 10F when the female housing 10 is pushed further from this position. Additionally, the tabs gradually project from the insertion hole 40A of the plate main body 48 as the moving plate 40 moves towards the back side of the receptacle 34.

Figure 18:
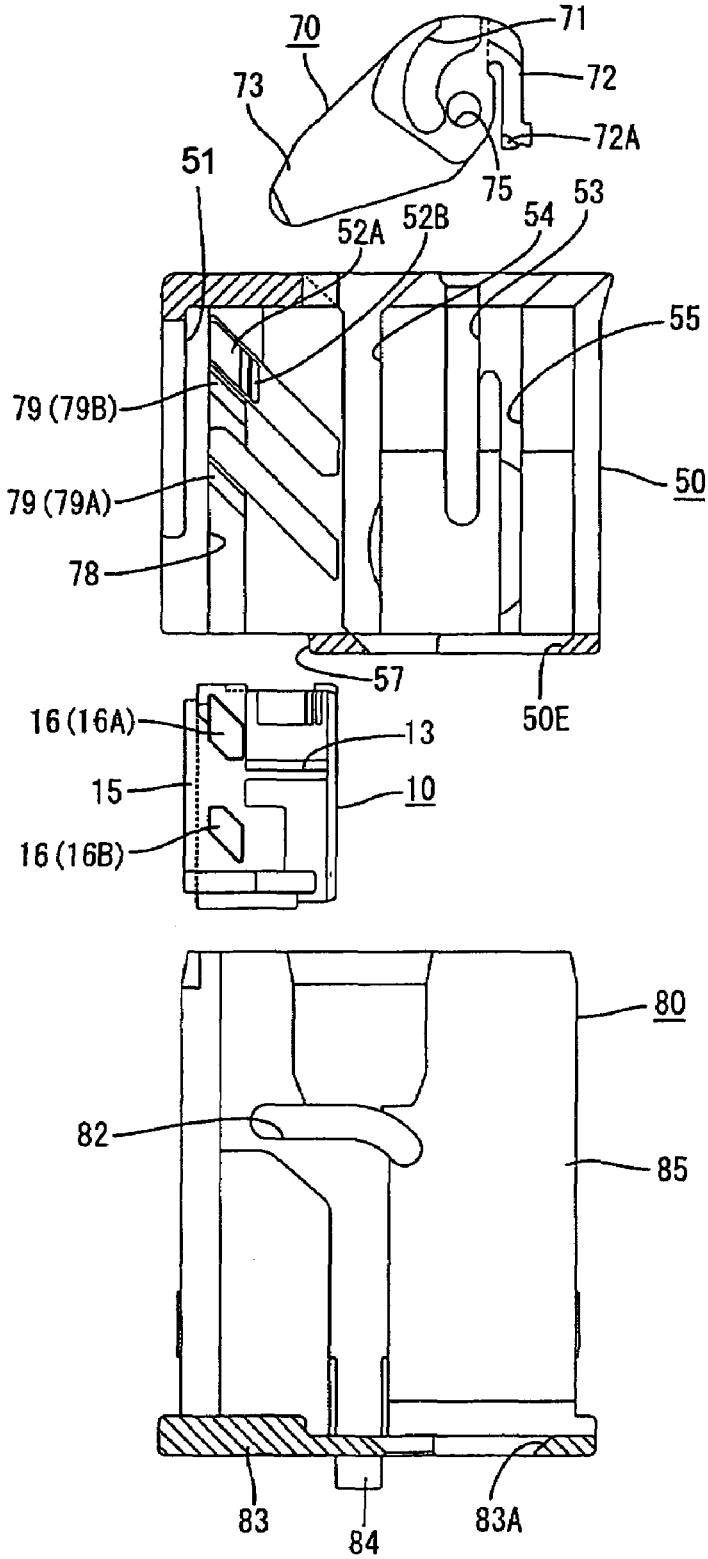
FIG. 18 is an exploded side sectional view of the cockpit-side module.
Figure 29:
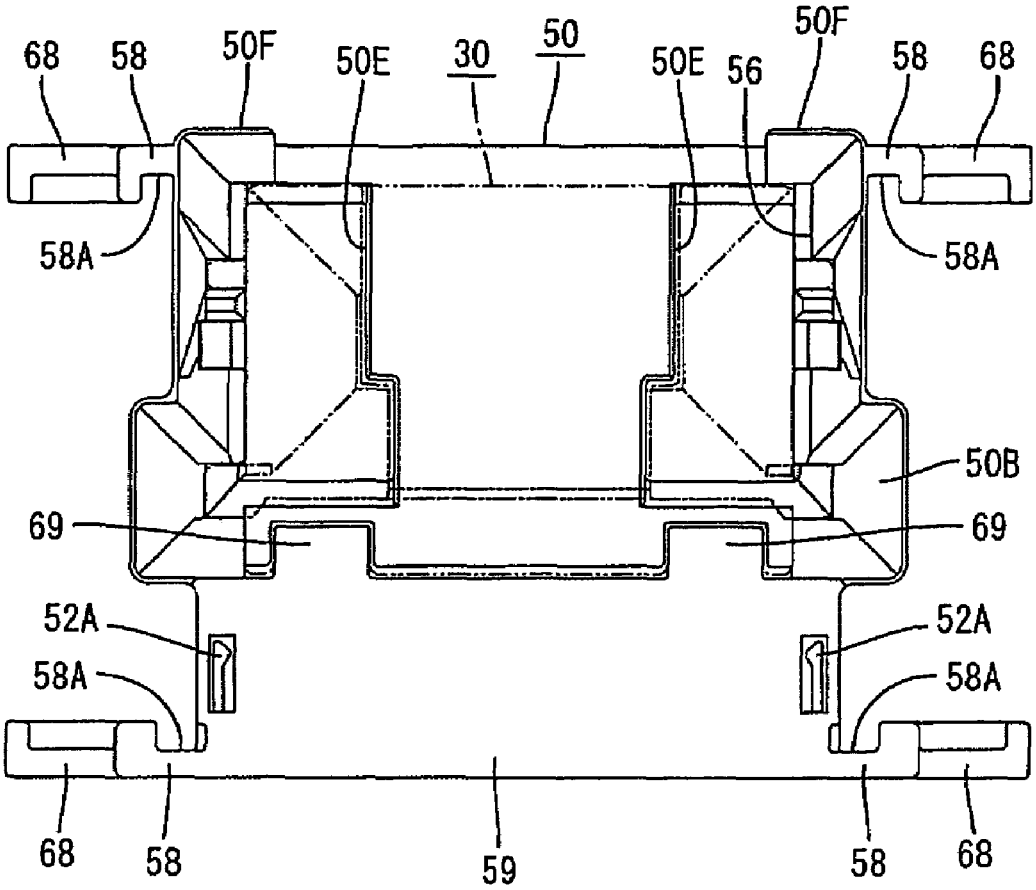
FIG. 29 is a plan view of the casing.

The casing 50 is made e.g. of a synthetic resin and is substantially in the form of a box having open front and rear surfaces, an open portion on the upper surface and an open rear portion on the bottom surface. The male housing 30 is inserted from above through a first opening 56 in the front portion of the upper surface, and the female housing 10 is inserted through a second opening 57 in the rear portion of the bottom surface, as shown in FIGS. 18 and 29. Two slide guides 58 project out over substantially the entire vertical range at both front and rear ends of each of the opposite side surfaces of the casing 50. Surfaces of the slide guides 58 are recessed to form slide-guide grooves 58A along which the slide 80 is vertically movable.

Casing-lock receiving portions 68 project laterally out at intermediate parts of the slide guides 58 with respect to the vertical direction. The casing-lock receiving portions 68 are shallow boxes with open upper surfaces at a side opposite to the side where the slide 80 is received. Resiliently deformable casing-locks 81 are formed on the slide 80 and are inserted into the casing-lock receiving portions 68, which then are locked resiliently by the casing-locks 81 to lock the slide 80 into the casing 50.

An accommodation space for the female housing 10 is formed in the rear half of the casing 50 and is defined by the upper wall and the rear portion of the opposite side walls. A protection wall 59 (FIGS. 18 and 29) is formed at the upper surface of the casing 50 and is arranged to cover the outer surface of the female housing 10 mounted into the casing 50 through the second opening 57. The lower surface of the protection wall 59 contacts the upper surface of the female housing 10 when the female housing 10 reaches a mount position.

Two substantially rectangular engaging pieces 69 (FIG. 29) project forward at the opposite sides of the front end of the upper wall of the casing 50. The engaging pieces 69 fit into respective receiving grooves 10E in the rear portion 10B of the female housing 10.

The forwardly open vertically aligned mount-guide receiving portions 51 are formed in the inner surfaces of the rear ends of the opposite side walls of the casing 50, and are engageable with the mount-guides 15 of the female housing 10 while mounting the female housing 10.

Two guiding cam grooves 52 are formed in the rear of each of the opposite side walls of the casing 50 and slope down from the rear to the front. The guiding cam grooves 52 in each pair preferably are substantially parallel to each other, and the corresponding guiding cam portions 16 of the female housing 10 fit in and move along the guiding cam grooves 52 to displace the female housing 10 obliquely down to the front relative to the casing 50.

Temporary holding arms 52A are formed in the upper guiding cam grooves 52 and are cantilevered down from the upper ends of the grooves edges. The temporary holding arms 52A are resiliently deformable out and in with their base ends as supports of resilient deformation. A temporarily holding projection 52B is at the inner side of the extending end of each temporary holding arm 52A. The guiding cams 16 interfere with the rear surfaces of the temporary holding projections 52B to have their movements restricted. However, pushing forces are given as the levers 70 are rotated, and the temporary holding arms 52A are moved out to disengage the guiding cams 16 from the temporary holding projections 52B. The guiding cams 16 move over the temporary holding projections 52B and the temporary holding arms 52A restore resiliently when the female housing 10 moves along the guiding cam grooves 52.

The inner side surface of the rear half of each of the opposite side walls of the casing 50 is recessed to form an escaping groove 78 that extends substantially vertically and that crosses the two guiding cam grooves 52. The escaping grooves 78 permit the escape of the guiding cams 16 of the female housing 10 that have entered through the second opening 57. Supporting ribs 79 are formed in portions of the escaping grooves 78 at the edges of the guiding cam grooves 52 and support the guiding cams 16 that have fit into the guiding cam grooves 52. After passing the escaping grooves 78, the guiding cams 16 resiliently move over the supporting ribs 79 and fit into the guiding cam grooves 52. The lower supporting ribs 79A have projecting heights less than the upper supporting ribs 79B. Thus, the lower guiding cams 16A of the female housing 10 do not interfere with the supporting ribs 79A upon passing the lower supporting ribs 79A. Accordingly, the guiding cams 16 can be fit into the guiding cam grooves 52 only by moving over the corresponding supporting ribs 79, thereby reducing interference resistance between the female housing 10 and the casing 50 and reducing an operational burden upon mounting the female housing 10.

An accommodation space for the male housing 30 is defined by the bottom wall and the front halves of the opposite side walls inside the front portion of the casing 50. Through holes 50E are formed at the opposite lateral sides of the bottom wall of the casing 50 for receiving the detectors 41 of the male housing 30. Two attached walls 50F (FIG. 29) project inward towards each other from portions of the opposite side walls of the casing 50 near the front. The upper surfaces of the attached walls 50F and those of the opposite side walls define the first opening 56 for receiving the male housing 30, and the guiding surface 50B slopes down toward the inner side over substantially the entire periphery of the first opening 56. The slanted surfaces 41B of the detectors 41 slide in contact with the guiding surface 50B as the male housing 30 is mounted to correct a mounting posture of the male housing 30.

As shown in FIG. 17, substantially circular lever mounting portions 50G are slightly recessed with respect to surrounding areas in the outer side surfaces of the front portions of the opposite side walls of the casing 50 where main bodies 70A of the levers 70 are mountable. A substantially cylindrical supporting pin 77 for rotatably supporting the corresponding lever 70 projects substantially in the center of the bottom surface of each lever mounting portion 50G, and the lever 70 can be rotated about the supporting pin 77.

The cam introducing grooves 53 penetrate the front portions of the opposite side walls of the casing 50 and extend substantially vertically above the supporting pins 77 up to the upper end surfaces. The cams 37 of the male housing 30 are insertable into the cam introducing grooves 53 from above. The cams 37 are near the entrances of the cam receiving portions 71 in the levers 70 when the male housing 30 is mounted in the casing 50 to an unlocking position where the locked states of the levers 70 are canceled. Further, the inner side surfaces of the front portions of the opposite side walls of the casing 50 are recessed to form the guiding grooves 55 extending over the entire vertical range substantially in parallel with the cam introducing grooves 53. The guides 39 of the male housing 30 are insertable into the guiding grooves 55 from above. Parts of the guiding grooves 55 that vertically cross the lever mounting portions 50G are through holes, and the resilient locks 72 formed on the levers 70 are engaged with the lateral edges of these through holes from the outer sides.

Figure 30:
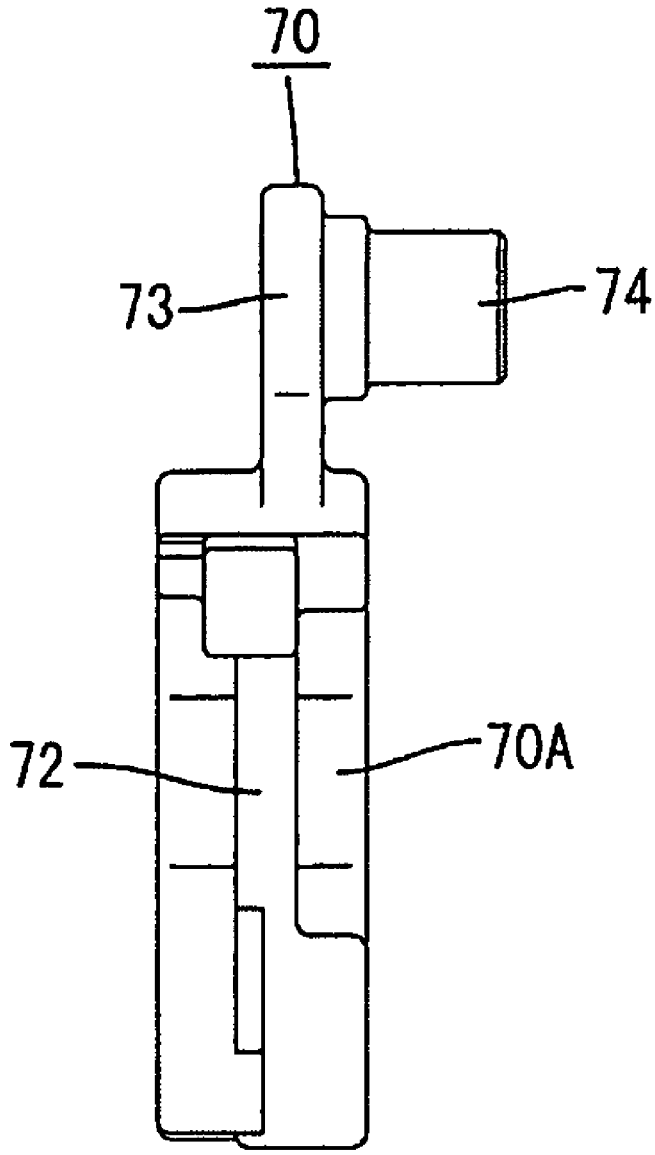
FIG. 30 is front view of a lever.
Figure 31:
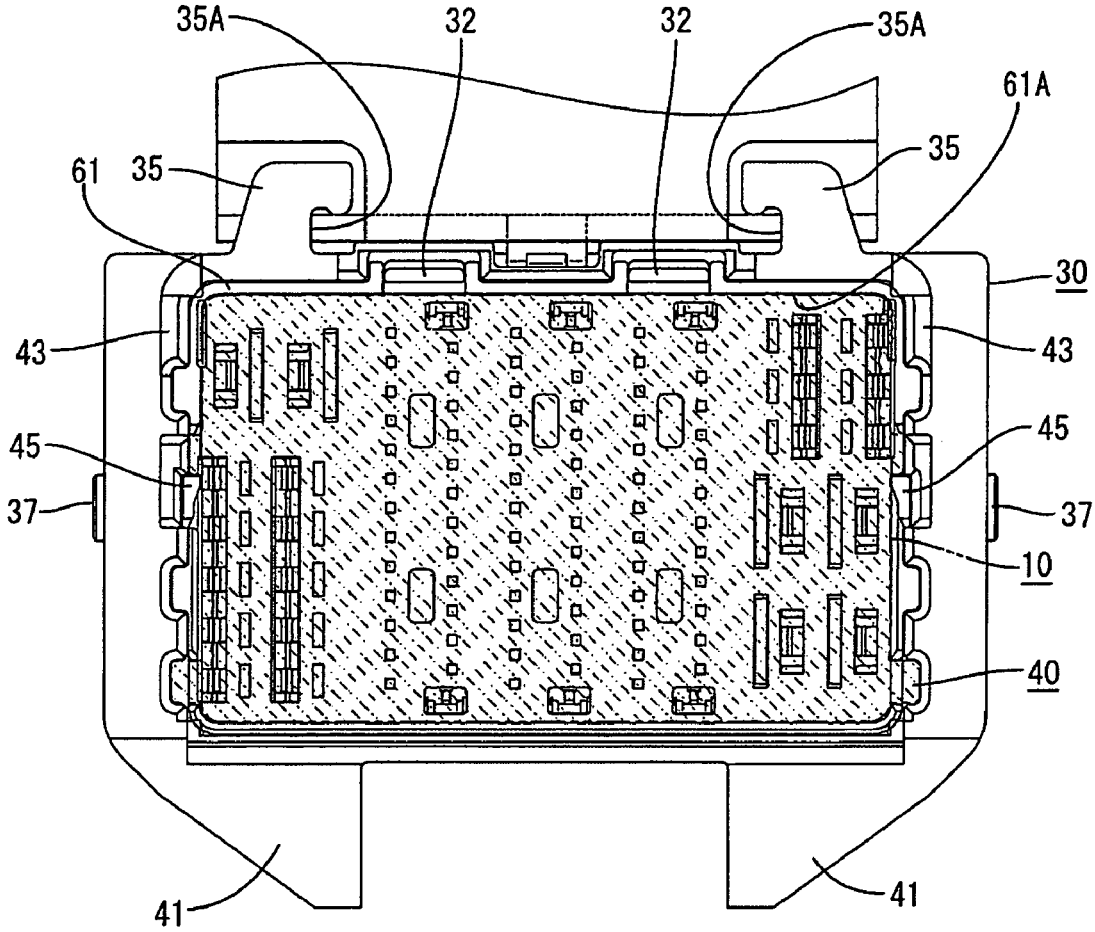
FIG. 31 is a front view of the male housing having the female housing mounted therein.

Each lever 70 is made e.g. of a synthetic resin, and includes a plate-like arm 73, as shown in FIGS. 17 and 30. A thick lever main body 70A is formed adjacent the arm 73. A cam receiving portion 71 is formed by recessing the inner surface of the lever main body 70A and extends in a curved or spiral manner in a specified direction. A substantially circular bearing 75 is formed by recessing at a position near the cam receiving portion 71 and is engageable with the corresponding supporting pin 77. A resiliently deformable lock 72 is cantilevered at the bottom end of the arm 73 and a slit-shaped deformation permitting space is defined between the arm 73 and the resilient lock 72. A substantially T-shaped resilient locking projection 72A is formed at the extending end of the resilient lock 72 and bulges out substantially toward the opposite lateral sides. The levers 70 are positioned at the rotation starting positions by the resilient engagement of the resilient locking projections 72A and the lateral edges of the corresponding guiding grooves 55 in the rotating directions of the levers 70. On the other hand, the resilient locking projections 72A interfere with the guides 39 of the male housing 30 and deform out when the male housing 30 is mounted to the unlocking position. As a result, the resilient locking projections 72A and the lateral edges of the guiding grooves 55 disengage from each other to permit rotation of the levers 70.

A substantially cylindrical operating-cam 74 projects from the outer surface of the upper end of each arm 73. The operating-cams 74 engage substantially constantly with operating-cam receiving portions 82 in the slide 80 and are relatively movable along the extending direction of the operating-cam receiving portions 82. The resilient locks 72 keep the levers 70 at the rotation starting positions with respect to the casing 50 before the male housing 30. In this case, the lever 70 has a fulcrum at the engaged position of the supporting pin 77 and the bearing 75, a point of action at the engaged position of the cam 37 and the cam receiving portion 71, a point of force at the engaged position of the operating-cam 74 and the operating-cam receiving portion 82, and is rotatable based on this leverage. Specifically, the slide 80 can be pushed towards the casing 50 with the cam 37 at the entrance of the cam receiving portion 71. As a result, the operating-cam 74 moves along the operating-cam receiving portion 82 and the lever 70 is rotated about the supporting pin 77. The cam 37 relatively moves along the cam receiving portion 71 when the lever 70 is rotated. As a result, the male housing 30 is displaced down relative to the casing 50 to be mounted properly into the casing 50 and the female and male housings 10, 30 are connected.

The slide 80 is made e.g. of a synthetic resin, and is substantially gate-shaped as a whole by having an operating portion 83 and a pair of a slide mounting portions 85 projecting from the opposite lateral ends of the operating portion 83, as shown in FIG. 21. The slide 80 is to be movably supported on a fitting 90 to be mounted on a slide mounting portion 85.

Figure 28:
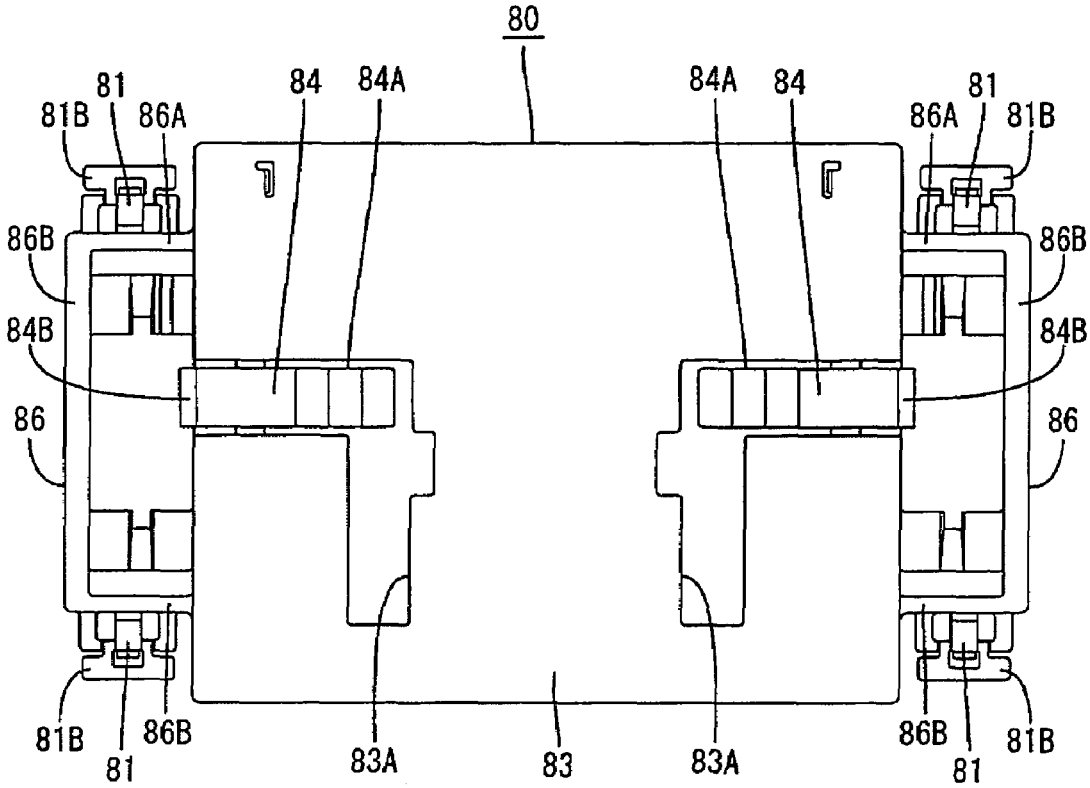
FIG. 28 is a rear view of the slide.

As shown in FIG. 28, two detection windows 83A through which the detecting portions 41 of the male housing 30 introduced through the through holes 50E of the casing 50 project are formed at substantially opposite sides of the operating portion 83. The detection windows 83A are substantially rectangular and the detecting portions 41 project from an operating surface through the openings of the detection windows 83A. Resiliently deformable resilient arms 84 are cantilevered at the substantially opposite lateral ends of the operating portion 83 and extend substantially inwardly towards each other. The extending ends of the resilient arms 84 are lifted to be located on the operating surface of the operating portion 83, and step-shaped disengaging portions 84A are formed there to cover the ends of the detection windows 83A at one side from the outer side. Particularly, the detection windows 83A preferably are substantially rectangular and the detecting portions 41 project from a pushable surface 83B of the operating portion 83 at least partly through the openings of the detection windows 83A. The cantilevered and resiliently deformable arms 84 are formed at the opposite lateral ends of the operating portion 83 and extend in towards each other. The resilient arms 84 are lifted up or deflected to be located on the pushable surface 83B of the operating portion 83, and step-shaped disengaging portions 84A are formed at the extending ends thereof to at least partly cover the ends of the detection windows 83A from the outer side.

Figure 19:
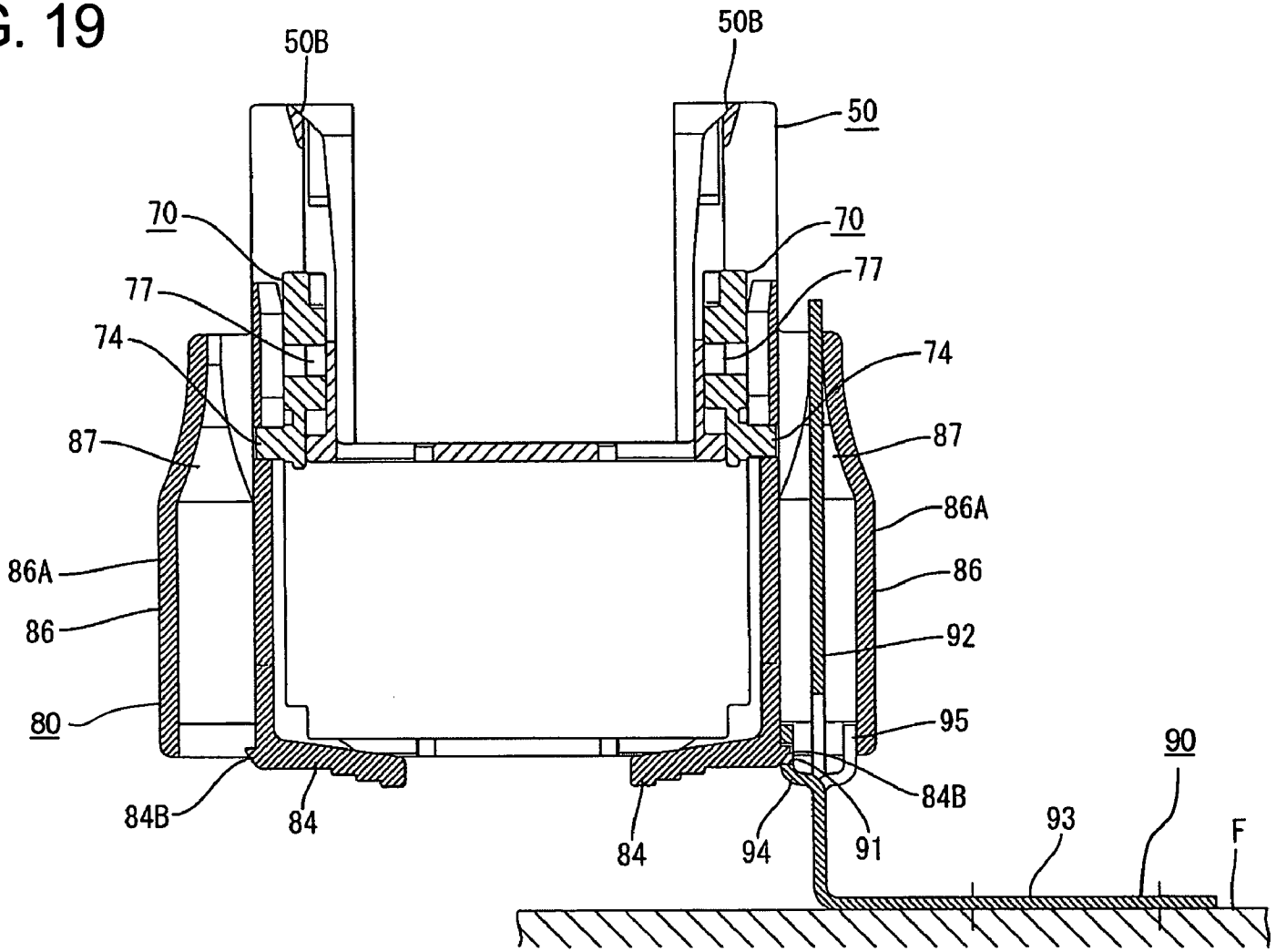
FIG. 19 is a side view in section showing a locking construction for the fitting and the slide.

Holding projections 84B are formed at the base ends of the resilient arms 84 to project sideways from the opposite lateral edges of the operating portion 83, as shown in FIG. 19, and these holding projections 84B are resiliently engageable with the projection receiving portion 91 formed on the fitting 90 to keep the slide 80 at a temporarily held position. The resilient arm 84 is deformed resiliently by pressing the disengaging portion 84A of the resilient arm portion 84 arranged on the operating surface of the operating portion 83 upon pushing the slide 80. Thus, the resilient arm portion 84 disengages the holding projection 84B from the projection receiving portion 91, with the result that the slide 80 can be moved from the temporarily held position.

The opposite front and rear edges of the slide mounting portions 85 have the outer surfaces thereof cut off in a stepped manner to form thinner slide-guide receiving portions 85A. The slide 80 can be moved substantially towards and away from the casing 50 by vertically moving the slide-guide receiving portions 85A substantially along the slide-guide grooves 58A. As shown in FIG. 18, the operating-cam receiving portion 82 engageable with the operating-cam 74 of the lever 70 at least partly penetrates each slide mounting portion 85 while being curved in a specified direction. The slide 80 and the casing 50 are coupled to each other via the levers 70 by keeping the operating-cams 74 and the operating-receiving portions 82 engaged with each other.

A substantially tunnel-shaped mounting box 86 bulges out or projects from the outer surface of each slide mounting portion 85 to at least partly cover the outer side of the operating-cam receiving portion 82. As shown in FIG. 28, the mounting box 86 is comprised of standing walls 86A standing substantially at right angle from the substantially opposite) front and rear ends of the outer surface of the corresponding slide mounting portion 85 and a wide covering wall 86B spanning between the projecting ends of both standing walls 86A. The fitting 90 can be accommodated in the mounting box 86. As shown in FIG. 19, the inner space of the mounting box 86 is tapered toward the upper end, and the leading end of the fitting 90 is held in a narrower space 87 defined at the tapered end of the mounting box 86 when the slide 80 is at the temporarily held position. On the other hand, in the process of pushing the slide 80 into the casing 50, the leading end of the fitting 90 exits from the narrower space 87, thereby releasing the fitting 90 and the slide 80 from the engaged state. A mounting piece 92 of the holding member 90 can be accommodated in the mounting box 86. As shown in FIG. 19, the inner space of the mounting box 86 is tapered toward the upper end, and the leading end of the mounting piece 92 is fit in a narrowed section 87 defined at the tapered end of the mounting box 86 when the slide 80 is at the temporarily held position. A widened section 88 extends right below the narrowed section 87, and the leading end of the mounting piece 92 having exited the narrowed section 87 is accommodated in the widened section 88 so as to be loosely movable.

On the other hand, when the slide 80 is pushed into the casing 50 and the bottom surface of the male housing 30 reaches a position to face the first opening 56 of the casing 50, the leading end of the mounting piece 92 exits from the narrowed section 87, thereby releasing the holding member 90 and the slide 80 from the engaged state.

Further, resiliently deformable casing-locks 81 are formed on both standing walls 86A of each mounting box 86. Two casing-locks 81 are provided for each mounting box 86, i.e. two pairs may be provided in total. One end of each casing-lock 81 is connected unitarily with the upper end of the corresponding standing wall 86A, and/or the other end thereof is connected unitarily at a position near the bottom end of this standing wall 86A, with the result that the casing-lock 81 is supported at both ends. Further, each casing-lock 81 has a casing-lock projection 81A and an unlocking portion 81B formed on the outer surface thereof, the unlocking portion 81B being located below the casing-lock projection 81A. As shown in FIG. 1, the bottom ends of the casing-locks 81 are curved, so that the casing-locks 81 can be smoothly resiliently deformed. When the slide 80 is assembled properly into the casing 50, the casing-locks 81A resiliently move over the bottom walls of the casing-lock receiving portions 68 to be engaged with the upper surfaces of these bottom walls. Thus, the slide 80 is locked so as not to come out of the casing 50. In order to cancel this locked state, the unlocking portions 81B are pressed to resiliently deform the casing-locks 81 and, in this state, the slide 80 may be pulled out of the casing 50.

Here, the upper surfaces of the casing-lock projections 81A are colliding surfaces 81E at a substantially right angle to the outer surfaces of the casing-locks 81. In the process of pushing the slide 80 into the casing 50, the colliding surfaces 81E of the casing-lock projections 81A strike against the lower surfaces of the bottom walls of the casing-lock receiving portions 68 to temporarily stop the pushing operation of the slide 80. By giving an operating force exceeding a resistance resulting from this abutment to the slide 80, the casing-locks 81 move over the lower surfaces of the bottom walls of the casing-lock receiving portions 68 and the slide 80 is pushed at a stroke substantially by an inertial force. In other words, the casing-locks 81 function as a so-called inertial lock, which can securely bring the slide 80 to a substantially proper locking position and, in its turn, can securely bring the two housings 10, 30 to a proper connected position.

Figure 2:
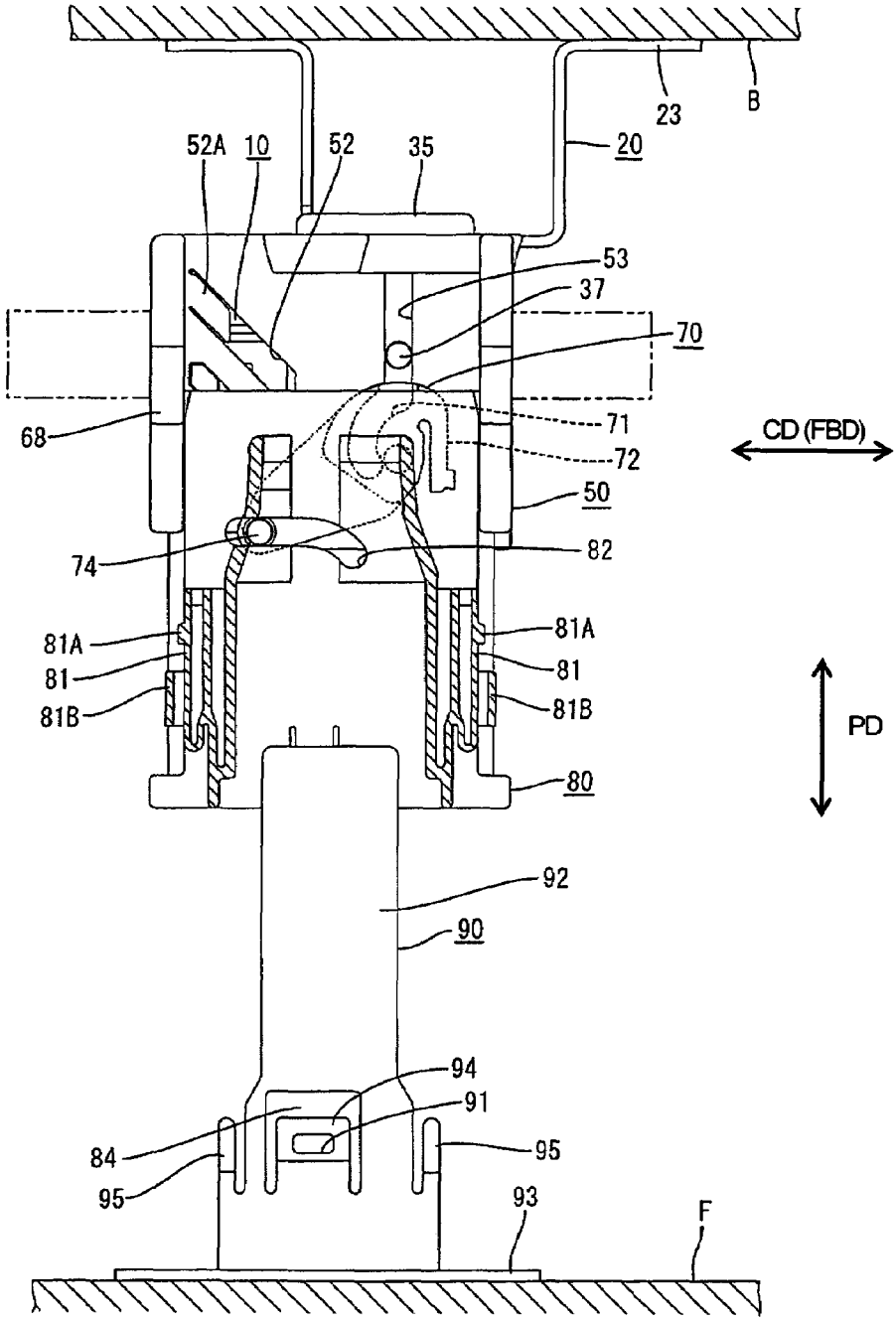
FIG. 2 is a side view with an essential portion shown in section, showing a state where the slide is detached from the fitting.

The fitting 90 preferably is made of a metal or steel, and is comprised of a substantially plate-like mounting piece 92 insertable into the mounting box 86 and a substantially plate-like fixing piece 93 at a substantially right angle to one end of the mounting piece 92, as shown in FIGS. 2 and 19, wherein the fixing piece 93 is to be fixed to the mounting surface F e.g. of the dashboard. The mounting piece 92 is formed preferably by cutting and bending with an engaging portion 94 resiliently engageable with the holding projection 84B of the resilient arm 84, and the holding projection 84B is fit into a projection receiving portion 91 formed in this engaging portion 94. Jutting portions 95 are formed at the opposite front and rear ends of the mounting piece 92. The jutting portions 95 are formed by cutting and bending to jut out in a direction substantially opposite to the bending direction of the engaging portion 94. When the slide 80 is at the temporarily held position, the engaging portion 94 and the jutting portions 95 are pressed against the front and rear inner surfaces of the mounting box 86. Thus, the mounting strength of the slide 80 at the temporarily held position is increased and the slide 80 is retained at the temporarily held position.

Prior to connecting the female and male housings 10, 30, a vehicle-side module and a cockpit-side module are assembled. For the vehicle-side module, the mounting member 20 is fixed to the mounting surface B of the engine compartment by fastening bolts; the male housing 30 is slid from the front relative to the intermediate portion 22 of the mounting member 20; and the resilient piece 36 of the male housing 30 is engaged resiliently with the opening edge of the mount opening 21 of the mounting member 20, thereby fixing the male housing 30. Further, the moving plate 40 is partly locked in the receptacle 34 of the male housing 30.

On the other hand, for the cockpit-side module, the female housing 10 is inserted into the casing 50 from below along the mount-guide receiving portions 51; the guiding cams 16 are fit into the corresponding guiding cam grooves 52 to hold the female housing 10 temporarily; the casing 50 and the slide 80 are coupled integrally via the levers 70; and thereafter the slide 80 is kept at the temporarily held position with respect to the fitting 90 fixed to the mounting surface F of the dashboard. Thus, the slide 80 is movably supported. At this time, the levers 70 are kept at the operation starting positions by the resilient locks 72, and the entrances of the cam receiving portions 71 are located to face the cam introducing grooves 53, thereby setting a state where the cams 37 of the male housing 30 can be received. In this way, as shown in FIGS. 1, 6 and 7, the vehicle-side module and the cockpit-side module are opposed to each other along an opposing direction (vertical direction) at an angle substantially normal to the connecting direction CD of the two housings 10, 30 while being spaced apart.

Figure 20:
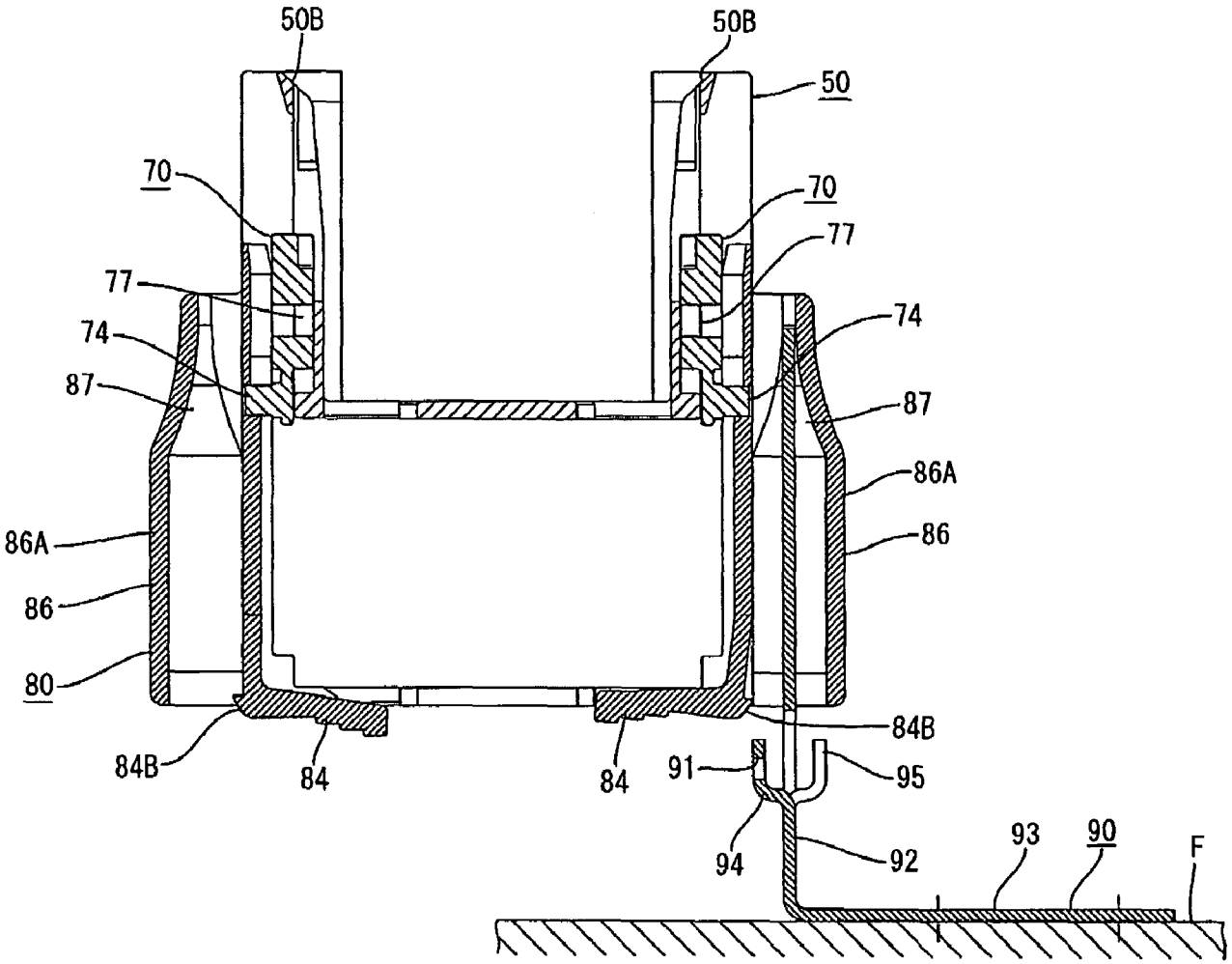
FIG. 20 is a side view in section showing a state where the fitting and slide are released from a locked state.

Next, the operation of connecting the female and male housings 10, is described. First, as shown in FIGS. 19 and 20, the disengaging portion 84A of the resilient arm 84 projecting on the operating surface or the pushable surface 83B of the slide 80 is pressed to cancel the temporarily held state of the slide 80 and, in this state, the slide 80 is moved toward the vehicle side and male housing 30 together with the casing 50. Then, as the slide 80 is pushed further, the leading end of the mounting piece 92 of the fitting 90 gradually retreats in the narrower space 87 of the mounting box 86. However, with the leading end of the mounting piece 92 of the fitting 90 engagingly locked in the narrower space 87, a loose movement of the slide 80 relative to the fitting 90 is prevented and, in its turn, a loose movement of the casing 50 is prevented. Thus, the casing 50 and the male housing 30 can be positioned securely within formation ranges of the guiding surface 50B of the first opening 56 of the casing 50 and the slanted surfaces 40B of the detecting portions 41 of the male housing 30.

Particularly, loose movement of the slide 80 is prevented while the leading end of the mounting piece 92 is locked in the narrowed section 87, and, in its turn, a loose movement of the casing 50 is prevented. Thus, the casing 50 can be guided securely to a position where it can receive the male housing 30.

Figure 33:
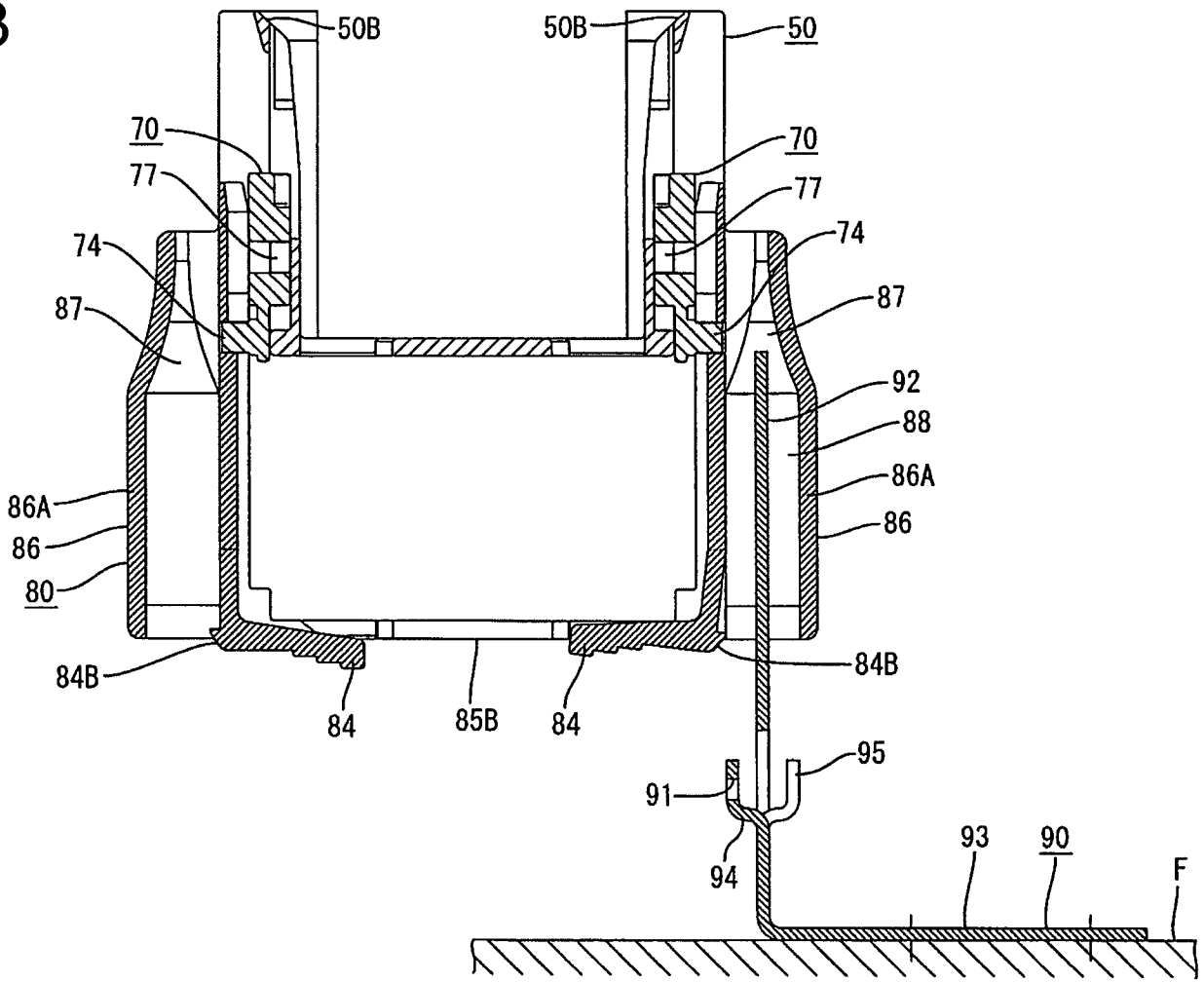
FIG. 33 is a side view in section showing a state where the leading end of the holding member is retreated from a narrowed section.

The slide 80 is pushed further and the leading end of the mounting piece 92 exits from the narrowed section 87 of the mounting box 86 as shown in FIG. 33. Thus, the leading end of the mounting piece 92 is disengaged from the narrowed section 87, permitting loose movements of the slide 80 and the casing 50. At this time, the bottom surface of the male housing 30 substantially faces the first opening 56 of the casing 50. Even if there is a positioning error between the first opening 56 and the bottom surface of the male housing 30, a displacement between the casing 50 and the male housing 30 can be corrected by loosely moving the casing 50 to a position to face the male housing 30.

A slant area is formed from the narrowed section 87 to the widened section 88. Therefore a loose movement range of the slide 80 gradually increases as the leading end of the mounting piece 82 retreats from the slant area. The male housing 30 can be guided into the casing 50 substantially along the guiding surface 50B formed at the first opening 56. Thus, an operation of correcting the displacement between the casing 50 and the male housing 30 can be performed automatically in conjunction with the pushing operation of the slide 80 thus improving overall operability of the connector device.

Figure 3:
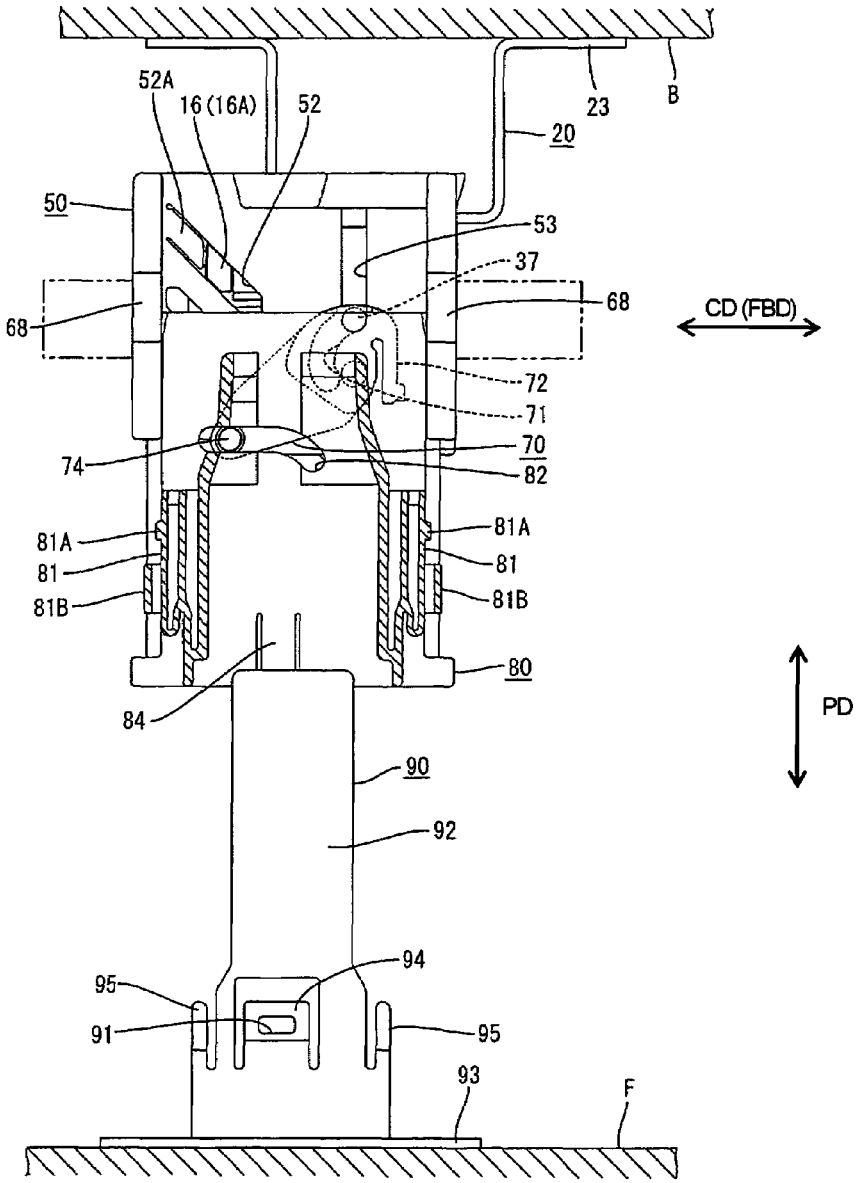
FIG. 3 is a side view with an essential portion shown in section, showing a state reached by pushing the slide toward a male housing together with a casing.
Figure 4:
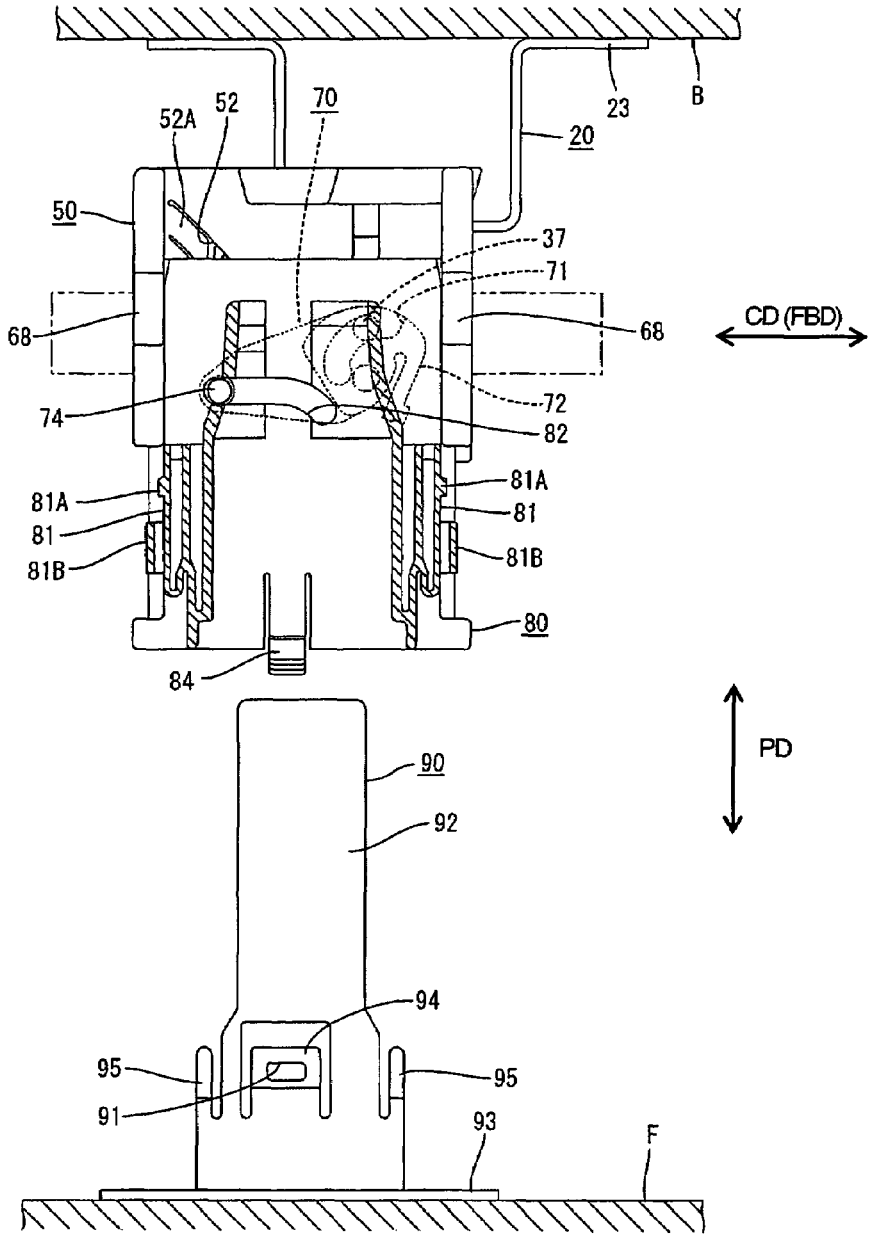
FIG. 4 is a side view with an essential portion shown in section, showing a state where the slide is completely separated from the fitting.

In this way, the male housing 30 is guided into the casing 50 substantially along the guiding surface 50B of the first opening 56 to insert the guide ribs 38 of the male housing 30 into the respective guide receiving grooves 54 of the casing 50, the cams 37 of the male housing 30 into the respective cam introducing grooves 53 of the casing 50 and the guiding portions 39 of the male housing 30 into the respective guiding grooves 55 of the casing 50, whereby the male housing 30 is inserted into the casing 50. While the male housing 30 is being inserted into the casing 50, the leading end of the mounting piece 92 of the fitting 90 exits from the narrower space section 87 of the mounting box 86 as shown in FIGS. 2 to 4. However, the male housing 30 and the casing 50 have been positioned completely until then. Thus, the succeeding operation cannot be hindered and can be performed smoothly.

Figure 9:
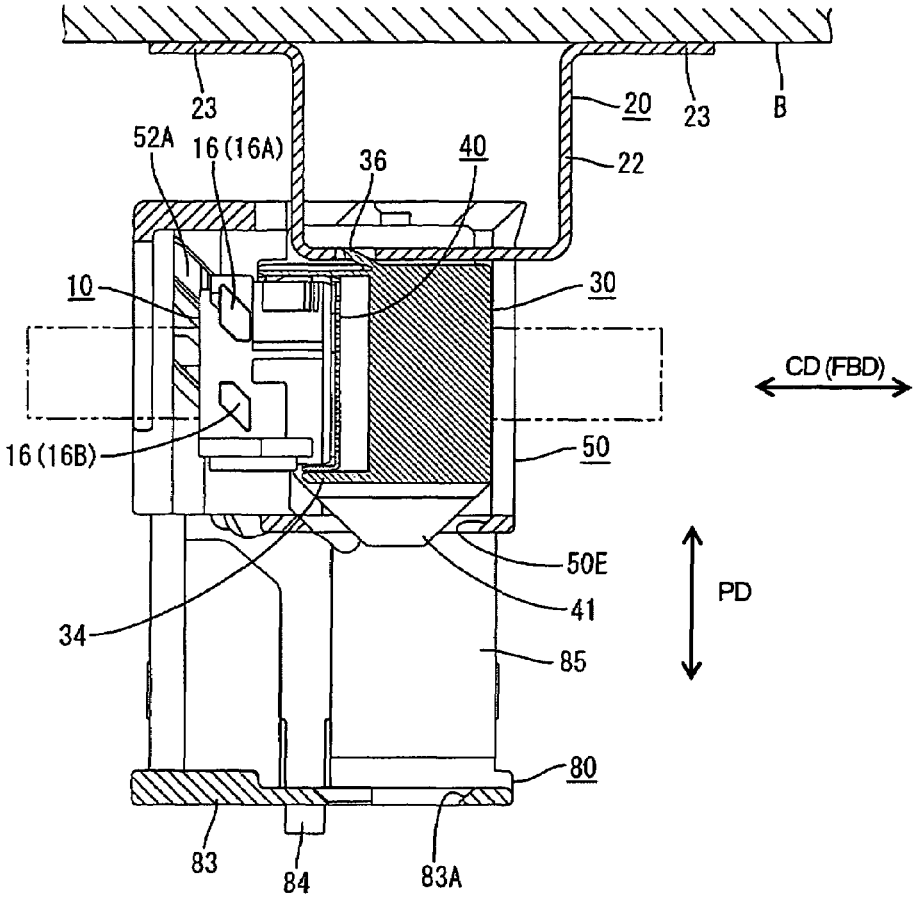
FIG. 9 is a side view in section showing a state in the process of bringing two housings closer to each other.
Figure 12A:
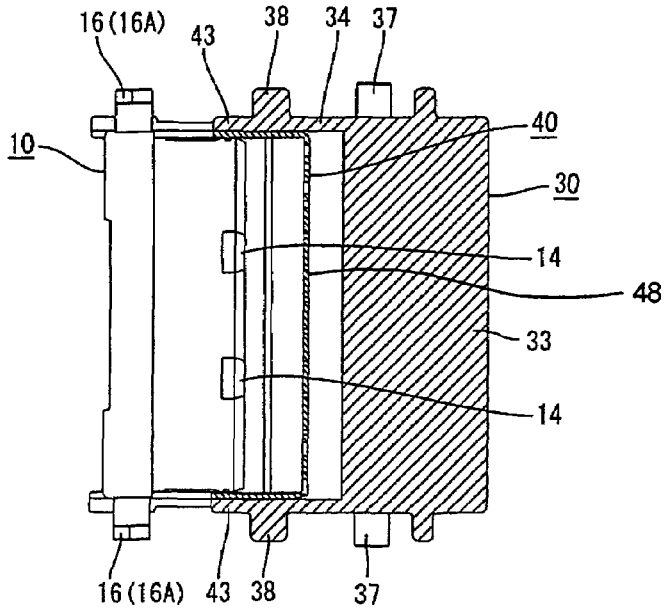
FIGS. 12(A) and 12(B) are an enlarged horizontal section and an enlarged side view in section showing an essential portion in a state where the two housings are engaged with the female housing temporarily held.
Figure 12B:
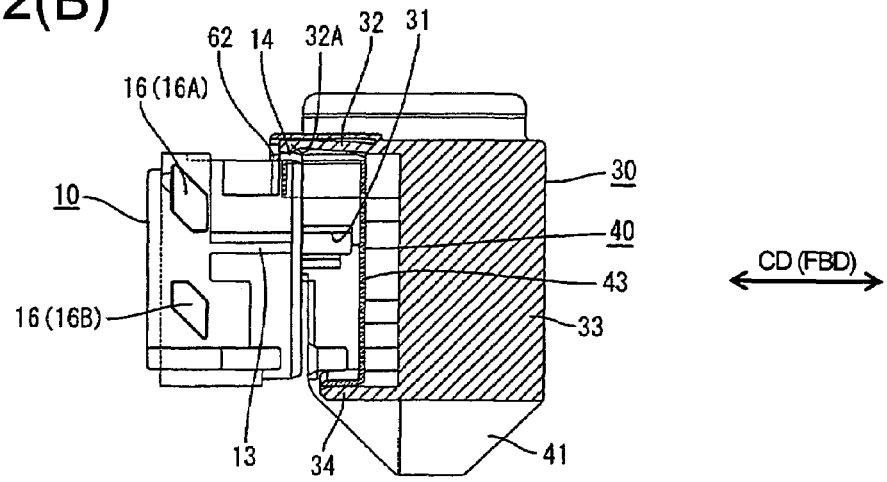

Further, as shown in FIG. 8, in the process of inserting the male housing 30 into the casing 50, the female housing 10 reaches the mount position through the opening 61A of the guiding wall 61 of the moving plate 40 and the covering wall 43 of the male housing 30 at least partly covers the front half 10A of the female housing 10. In other words, the covering wall 43 of the male housing 30 comes to at least partly cover the front portion of the female housing 10 via the guiding wall 61 of the moving plate 40. The male housing 30 is displaced down along the guiding grooves 55 relative to the casing 50 with the two housings 10, 30 held engaged, as shown in FIG. 9. At this time, the female housing 10 is disengaged from the temporary holding arms 52A to move substantially along the guiding cam grooves 52. As a result, the two housings 10, 30 start moving closer to each other along the connecting direction CD. In the meantime, as shown in FIG. 12(B), the resilient locking pieces 32 are pushed up to release the moving plate 40 from the locked state, thereby permitting the moving plate 40 to move.

The guiding portions 39 inserted into the guiding grooves 55 cancel the locked state by the resilient locks 72 of the levers 70, when the male housing 30 is mounted to the unlocking position, thereby permitting the levers 70 to rotate as shown in FIGS. 3 and 4. Simultaneously, the slide 80 is permitted to be pushed toward the casing 50. At this time, some of the female and male terminals accommodated in two housings 10, 30 have started being connected by having their leading ends overlap each other.

Figure 10:
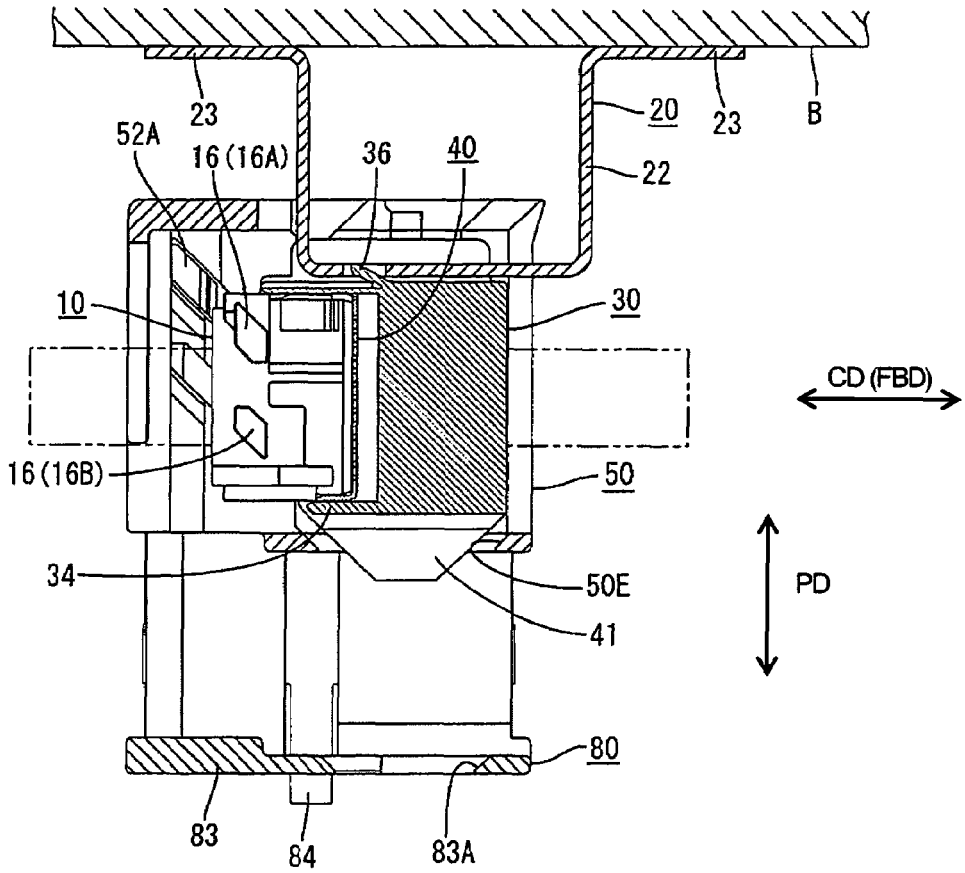
FIG. 10 is a side view in section showing a state reached by bringing the two housings further closer to each other.
Figure 11:
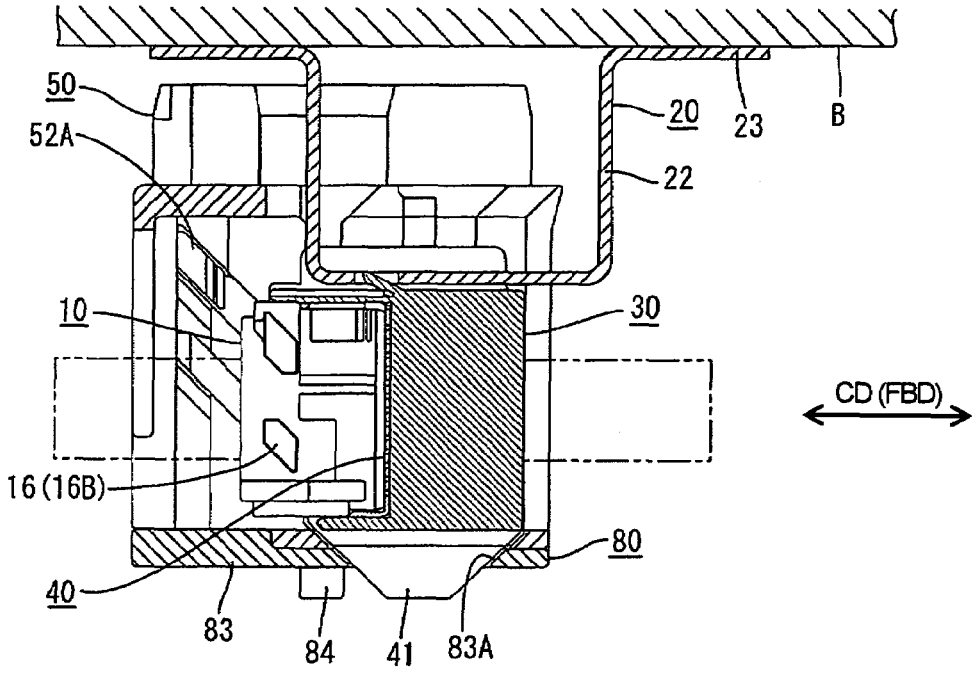
FIG. 11 is a side view in section showing a state where the two housings are properly connected.
Figure 13A:
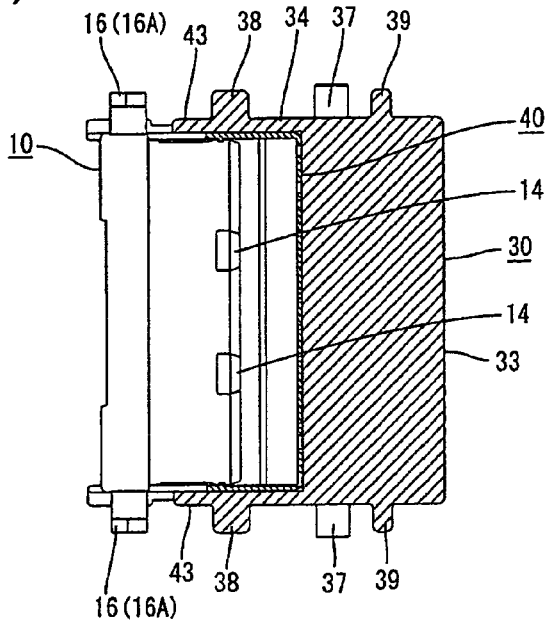
FIGS. 13(A) and 13(B) are an enlarged horizontal section and an enlarged side view in section showing an essential portion in a state reached by bringing the female housing toward the male housing by canceling the temporarily held state of the female housing.
Figure 13B:
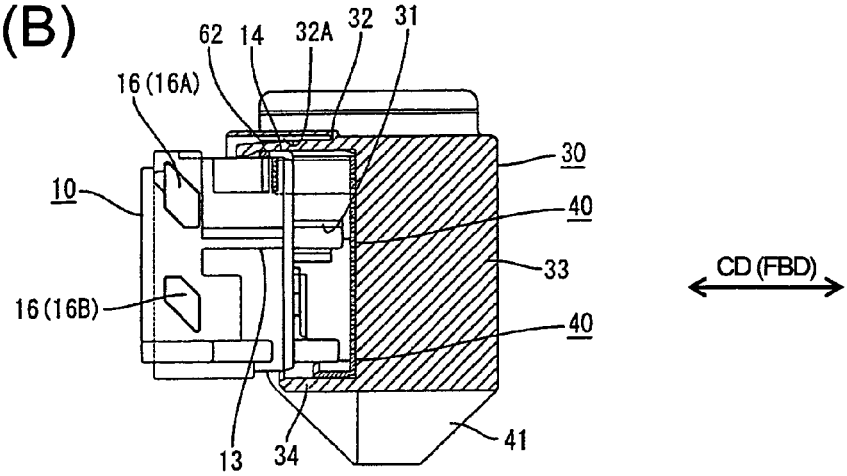
Figure 14A:
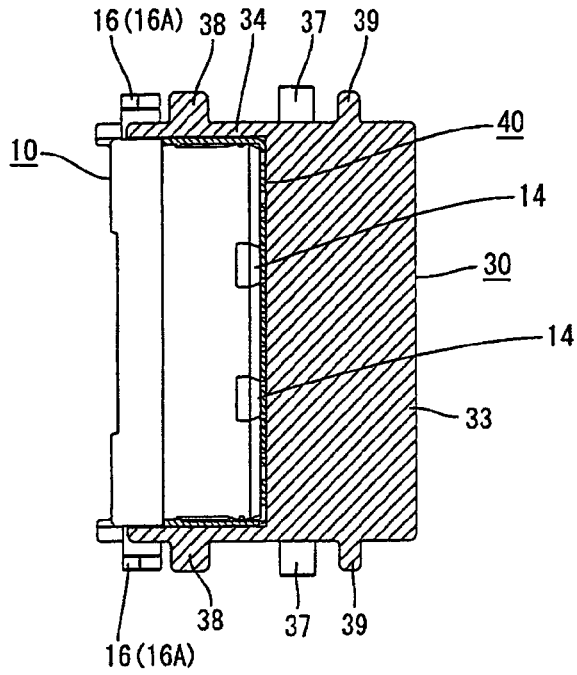
FIGS. 14(A) and 14(B) are an enlarged horizontal section and an enlarged side view in section showing an essential portion in a state where the two housings are properly connected.
Figure 14B:
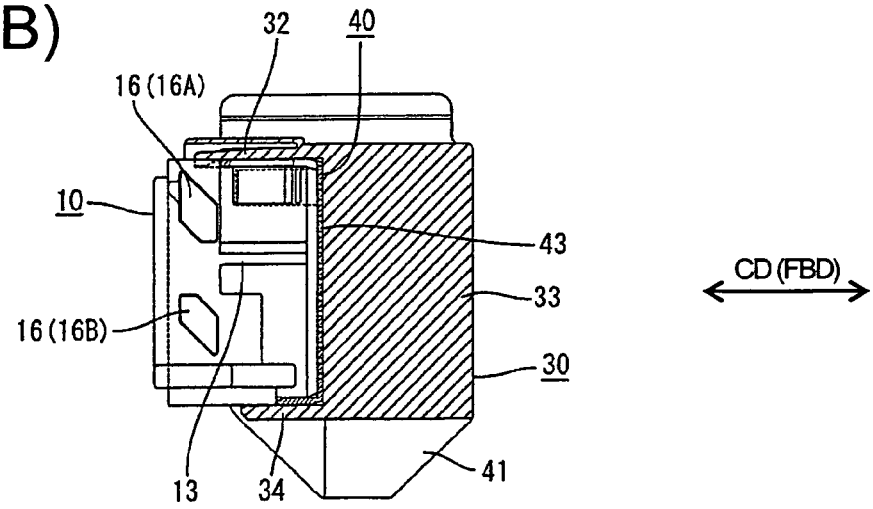

The slide 80 then is pushed towards the casing 50. As a result, the operating-cams 74 of the levers 70 relatively move along the operating-cam receiving portions 82 of the slide 80, and the levers 70 start rotating clockwise in the shown example about the supporting pins 77. Then, as shown in FIGS. 10 and 11, the cams 37 of the male housing 30 relatively move along the cam receiving portions 71 of the levers 70 and, accordingly, the male housing 30 is displaced downward along the guiding grooves 55 relative to the casing 50. Further, the female housing 10 engaged with the male housing 30 via the guiding wall 61 and the covering wall 43 is moved along the guiding grooves 55. At this time, the casing 50 is pulled up gradually, and the female housing 10 is moved horizontally to the right on the surface, as shown in FIGS. 12 to 14. Contrary to this, the male housing 30 constantly is held fixed to the mounting surface B, as described above.

Figure 5:
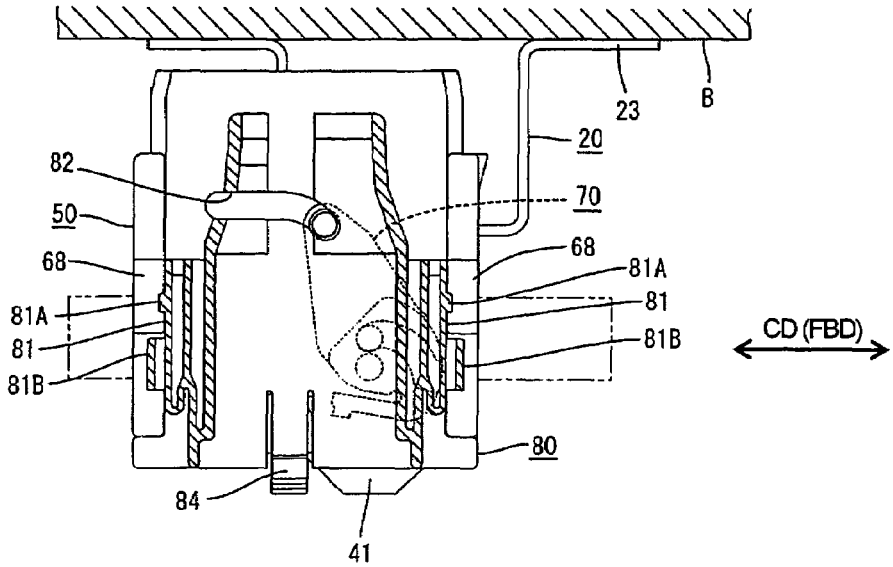
FIG. 5 is a side view with an essential portion shown in section, showing a state where the slide is locked into the casing by being pushed.
Figure 5:
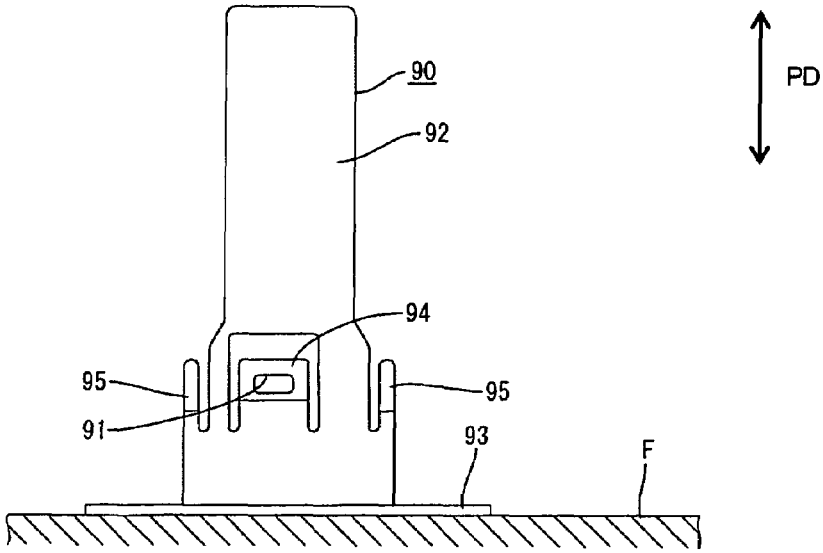

In this way, when the operating portion 83 of the slide 80 reaches a position where it is stopped while being held in contact with the bottom wall of the casing 50 as shown in FIGS. 5 and 11, the rotations of the levers 70 are completed and the two housings 10, 30 are connected properly. At this time, the detecting portions 41 project through the detection windows 83A of the slide 80, and the proper connection of the two housings 10, 30 can be known e.g. by visually confirming this state. On the other hand, if the two housings 10, 30 are not properly connected, the male housing 30 has not reached the bottom ends of the guiding grooves 55 yet. Thus, the detecting portions 41 either do not project from the detection windows 83A or projecting amounts thereof are smaller than planned. It can be known e.g. by visually confirming this state that the two housings 10, 30 are left insufficiently connected. Since such visual confirmations can be made by the operator looking at the operating surface or the pushable surface 83B of the slide 80 located at the front side toward him, visibility is good.

When the operating portion 83 of the slide 80) reaches the position where it is stopped by the bottom wall of the casing 50, the casing locks 81 of the slide 80 are resiliently engaged with the casing-lock receiving portions 68 of the casing 50. Thus, the slide 80 is locked while having the disengagement from the casing 50 prevented.

According to this embodiment, the guiding wall 61 contacts the upper surface and the opposite side surfaces of the female housing 10 that has substantially reached the mount position. Thus, the female housing 10 is positioned while having a loose movement thereof prevented. Therefore, the female housing 10 can be moved smoothly from the mount position to the connected position.

Further, since the guiding wall 61 is formed on the fittable tube 49 of the moving plate 40, the construction can be simplified. Furthermore, when the female housing 10 reaches the mount position, the disengaging portions 14 contact the resilient locks 32, thereby deforming the resilient locks 32 out of engagement with the engageable portions 62. This cancels the partly locked state by the resilient locks 32 and the engageable portions 62, permitting a movement of the moving plate 40. Thus, the partly locked state of the moving plate 40 is canceled by taking advantage of the mounting operation of the female housing 10, obviating the need for separately performing an operation of canceling the partly locked state.

The engaging projections 61B and the engaging recesses 10F are engaged with each other when the female housing 10 reaches the mount position, and the moving plate 40 is moved toward the back side of the receptacle 34 together with the female housing 10 while keeping this engaged state. Thus, a mechanism for moving the moving plate 40 is constructed by taking advantage of the mounting operation of the female housing 10, obviating the need for separately providing such a moving mechanism.

Accordingly, an operation of positioning two connector housings with respect to each other before the connection thereof is started can be facilitated, Moreover, the leverage having the point of force at the engaged positions of the operating-cams 74 and the operating-cam receiving portions 82 and the point of action located at the engaged positions of the cams 37 and the cam receiving portions 71 is constructed to rotate the levers 70 by pushing the slide 80, the two housings 10, 30 can be connected with a small operating force. As a result, this embodiment can be suitably utilized even if the number of contacts of the connector is increased.

Further, even if the male housing 30 should be fixed to the mounting surface B set at an inner position of the vehicle, the male housing 30 is substantially guided into the casing 50 by the at least one guiding surface 50B formed at the first opening 56 of the casing 50. Thus, the male housing 30 can be inserted smoothly into the casing 50. Further, when the female housing 10 is inserted into the casing 50 through the second opening 57, the upper or outer surface of the female housing 10 is at least partly covered by the protection wall 59. Therefore, a situation can be avoided where the female housing 10 interferes with external matter to inadvertently move in the casing 50.

The locked states of the levers 70 by the resilient locks 72 are canceled by taking advantage of the mounting operation of the male housing 30 into the casing 50. Thus, it is not necessary to perform an independent operation of unlocking the levers 70. Further, the guiding cams 16 are moved along the two substantially parallel guiding cam grooves 52 on each of the opposite side surfaces. Thus, the female housing 10 can be moved in a stable posture.

Further, the casing-locks 81 and the casing-lock receiving portions 68 are engaged when the two housings 10, 30 are properly connected. Thus, it is not necessary to provide the two housings 10, 30 with locking means. Furthermore, since the slide 80 preferably is coupled to the casing 50 via the levers 70, the number of parts can be reduced.

Accordingly, an operating force upon connecting two housings is reduced.

Moreover, as described above, the cockpit-side module is held temporarily by the fitting 90 before being brought closer to the vehicle-side module. Thus, panels can be assembled at a cockpit side and a movable side beforehand, improving operability. Further, a displacement that can occur between the two modules can be corrected while the slide 80 is moved.

Further, the resilient arm 84 can be pushed to disengage the holding projection 84B from the engaging portion 91 and, in this state, the slide 80 can be brought closer to the male housing 30. Thus, an operation of canceling the partly held state and an operation of moving the slide 80 easily can be performed by one motion.

Furthermore, the casing 50 is guided to the engaged position with the male housing 30 while having a loose movement prevented by engagingly introducing the leading end of the mounting piece 92 into the narrowed section 87. When being engaged with the male housing 30, the casing 50 can correct a displacement with respect to the male housing 30 within such a range permitting the loose movement thereof by the leading end of the mounting piece 92 exiting from the narrowed section 87 to be disengaged therefrom.

Further, the male housing 30 is guided into the casing 50 by the guiding surface 50B formed at the inner edge of the first opening 56, and can be inserted automatically into the casing 50 while correcting the displacement with respect to the casing 50 as the slide 80 is moved.

Accordingly, a vehicle-side module that includes a male housing 30 can be assembled more efficiently to a cockpit-side module that includes a female housing 10.

A second embodiment of the invention is described with reference to FIGS. 34 to 53. The second embodiment is provided with a female housing 10Q, a male housing 30Q, a casing 50Q, a slide 80Q and levers 70Q. The slide 80Q is fit into the casing 50Q in which the female housing 10Q is at least partly mounted. The male housing 30Q is inserted into the casing 50Q at an intermediate stage of this pushing operation. The two housings 10Q, 30Q are brought toward each other along a direction CD at an angle and preferably substantially normal to a pushing direction PD of the slide 80Q by a cam mechanism realized by the levers 70Q. The two housings 10Q, 30Q then reach a properly connected state by further pushing the slide 80Q. The basic construction of the second embodiment and a connecting mechanism of the two housings 10Q, 30Q are similar or the substantially same as in the first embodiment. Hence, repetitive description is avoided as much as possible by identifying the same structural parts as in the first embodiment by the same reference numerals, and differences from the first embodiment are described in detail.

Figure 38:
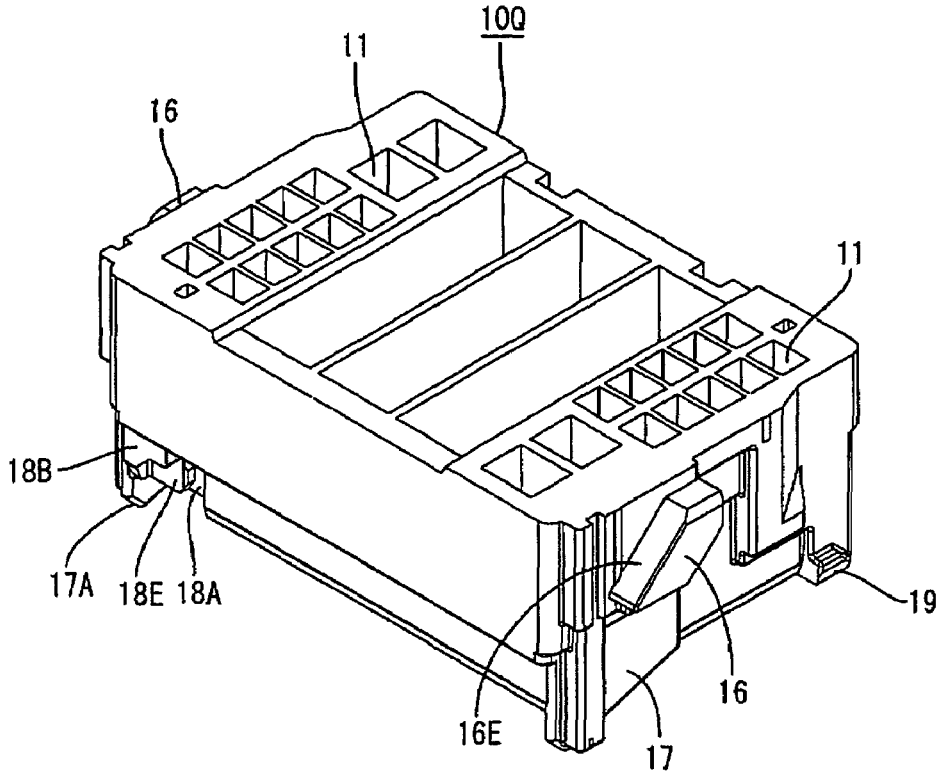
FIG. 38 is a perspective view of the female housing.
Figure 39:
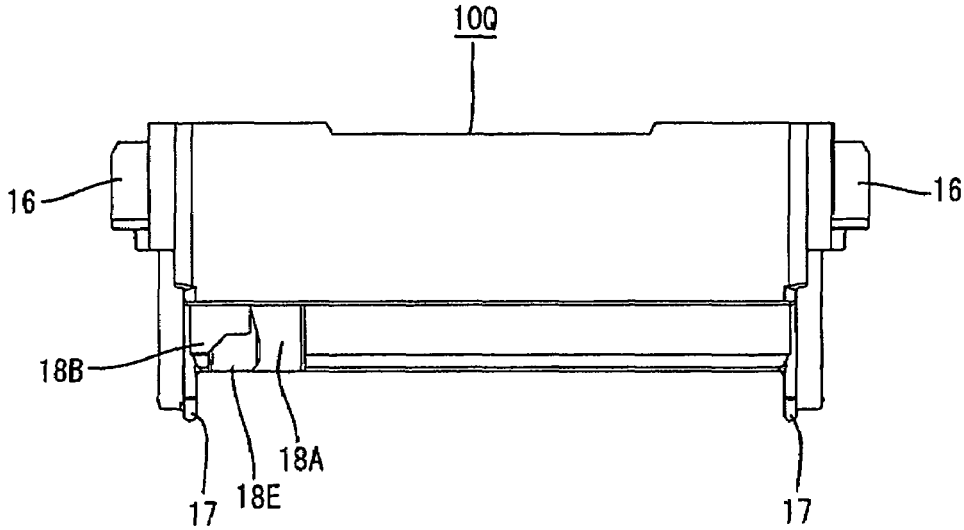
FIG. 39 is a bottom view of the female housing.
Figure 40:
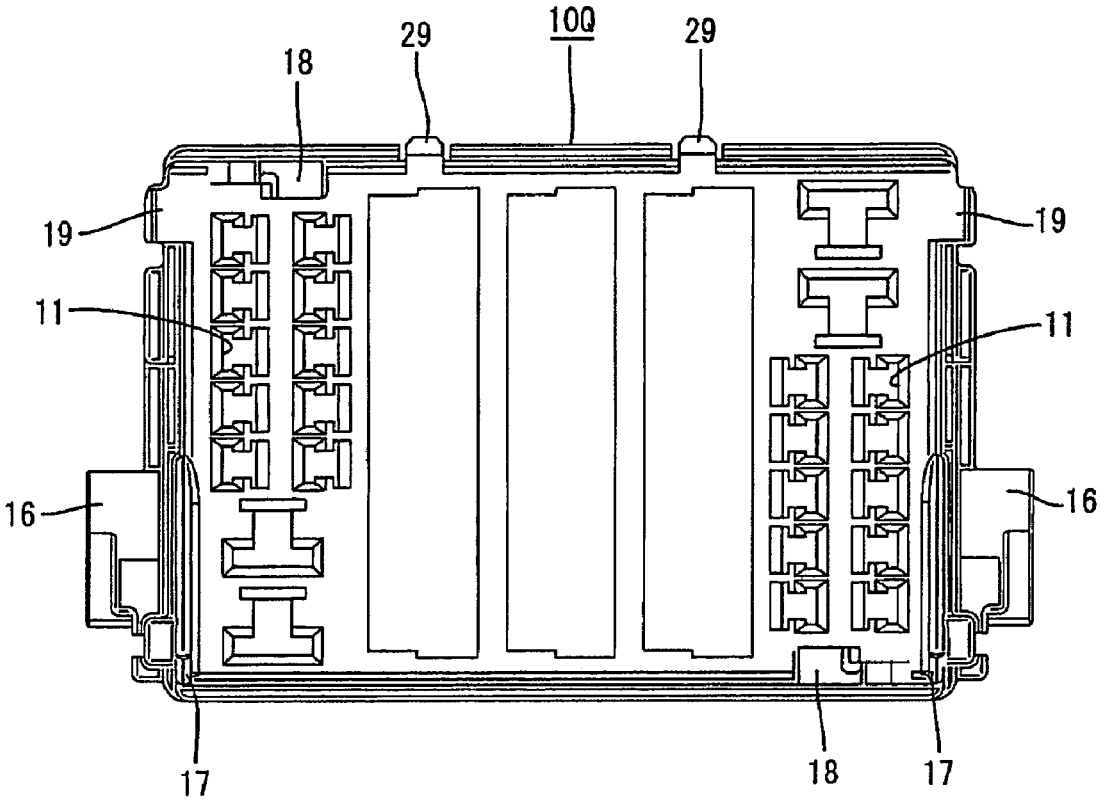
FIG. 40 is a front view of the female housing.

As shown in FIGS. 38 to 40, left and right guiding cams 16 project on the opposite side surfaces of the female housing 10Q. The number of the guiding cams 16 preferably is smaller by one on each of the left and right sides as compared to the first embodiment. The guiding cams 16 are fit into guiding cam grooves 52 formed in the casing 50Q for movement along an extending direction of the guiding cam grooves 52. Upper and lower surfaces thereof 16E are arranged substantially in parallel with each other and slide in surface contact with the lateral edges of the guide cam grooves 52, thereby preventing a pivoting or rotational movement of the female housing 10Q in the casing 50. The female housing 10Q is displaceable between an initial position where each guiding cam 16 is at one end of the corresponding guiding cam groove 52 and an end position where it is located at the other end of the corresponding guiding cam groove 52, and the female housing 10Q is connected properly with the male housing 30Q at the end position. Left and right temporary holding projections 19 are formed at the upper front ends of the opposite side surfaces of the female housing 10Q. The female housing 10Q is held temporarily at the initial position by the engagement of the temporarily holding projections 19 with respective temporarily engaging portions 52Q provided in the casing 50Q.

As shown in FIG. 40, upper and lower plate unlocking portions 18 are formed by recessing at two diagonal positions at the opposite sides of the center or intermediate portion of the front surface of the female housing 10Q. As shown in FIG. 39, each plate unlocking portion 18 has an escaping recess 18A for permitting the entrance of plate locking portions 32R, 32Q to be described later. The escaping recesses 18A are formed by recesses in the front and upper surfaces of the female housing 10Q. Each escaping recess 18A also has an unlocking element 18B, 18E located on the inner surface of) the escaping recess 18A for canceling a locked state by contacting locking structure portions of the plate unlocking portion 32R, 32Q. The unlocking element 18B, 18E has an earlier unlocking element 18E that contacts the plate locking portion 32R, 32Q relatively earlier and a later unlocking element 18B that contacts the plate locking portion 32R, 32Q relatively later. The earlier and later unlocking elements 18E, 18B differ in height or projecting distance.

Figure 50:
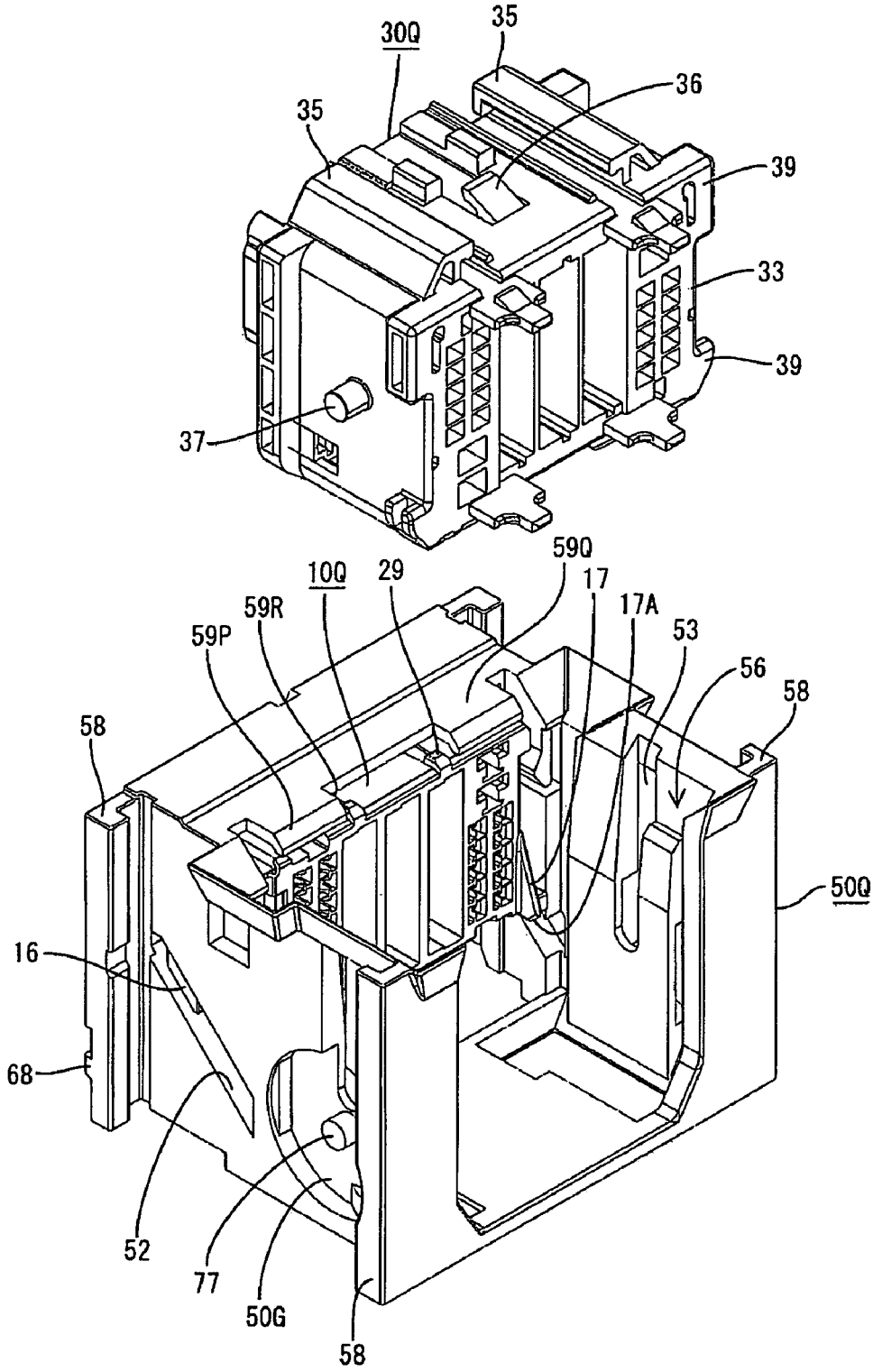
FIG. 50 is a perspective view showing a state before the male housing is inserted into the casing.
Figure 51:
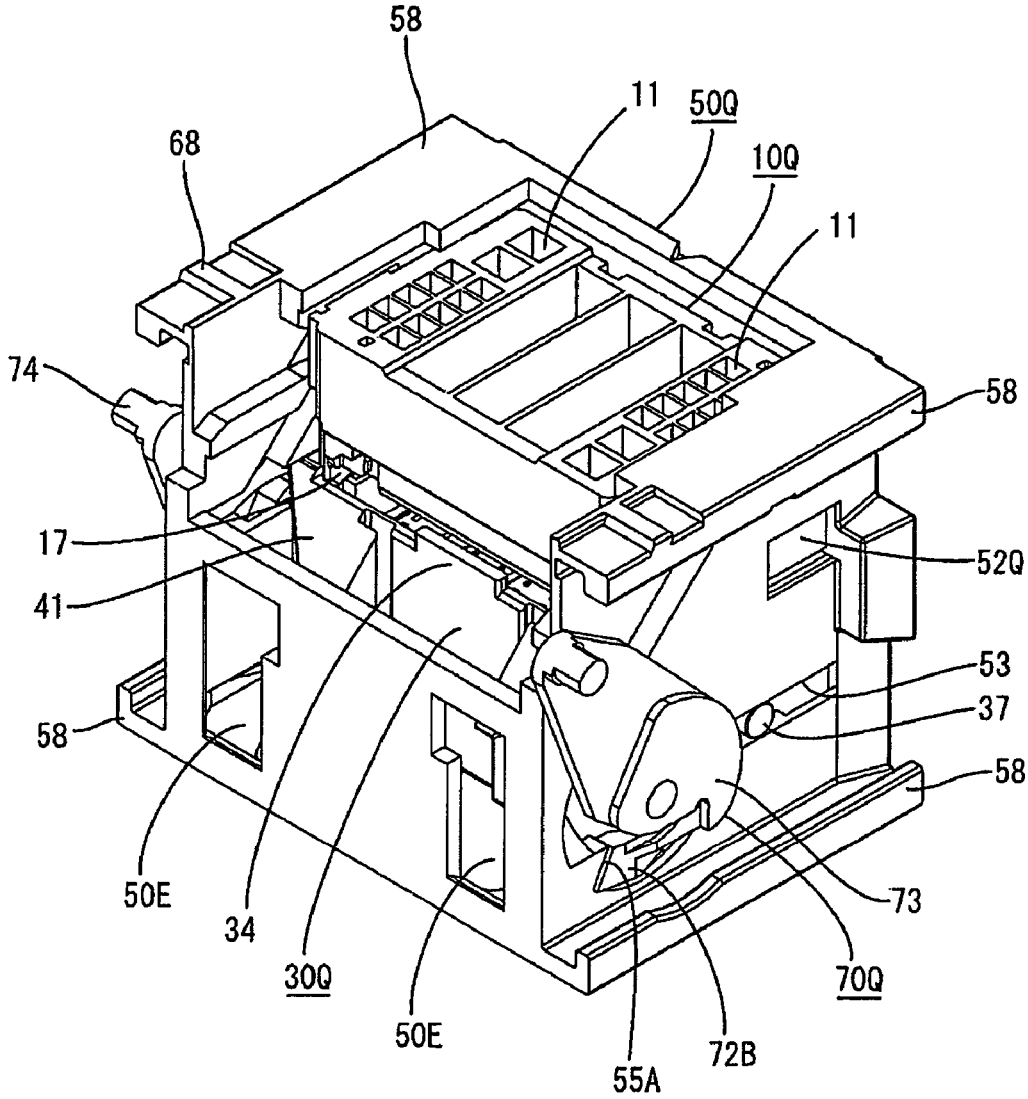
FIG. 51 is a perspective view showing a state where the male housing is inserted in the casing.
Figure 52:
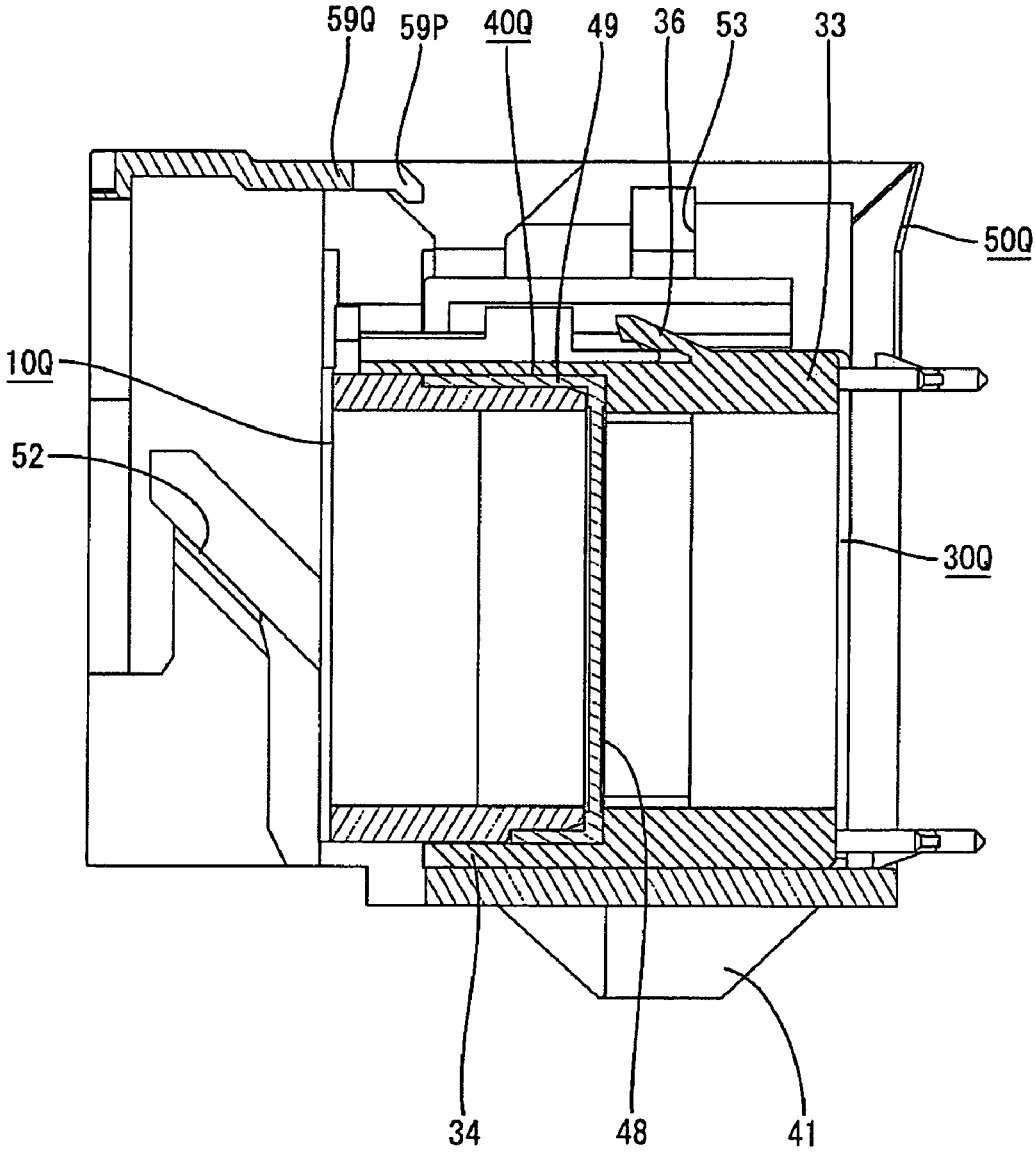
FIG. 52 is an enlarged side view with an essential portion shown in section showing a state where the two housings are properly connected.

Left and right rests 17 are formed to project at positions of the front surface of the female housing 10Q near the opposite side surfaces. As shown in FIG. 50, each rest 17 has a polygonal shape projecting forward when viewed sideways, and is at least partly located in a receptacle 34 of the male housing 30Q when the two housings 10Q, 30Q are connected. The rests 17 slide in contact with a contact portion 34A at the bottom edge of the opening of either the receptacle 34 or a moving plate 40Q during an operating of separating the two housings 10Q, 30Q, and hence the rests 17 guide the female housing 10Q to the initial position while being held in sliding contact. The rests 17 have slanted surfaces 17A that slope up towards the front. The slanted surfaces 17A are at positions substantially opposite to the contact portion 34A in a moving direction toward the initial position and are held substantially in sliding contact with the contact portion 34A. Thus, the female housing 10Q can be moved smoothly to the initial position along the guiding cam grooves 52. It should be noted that the contact portion 34A and the rests 17 are not in contact any longer when the female housing 10Q returns to the initial position.

Figure 41:
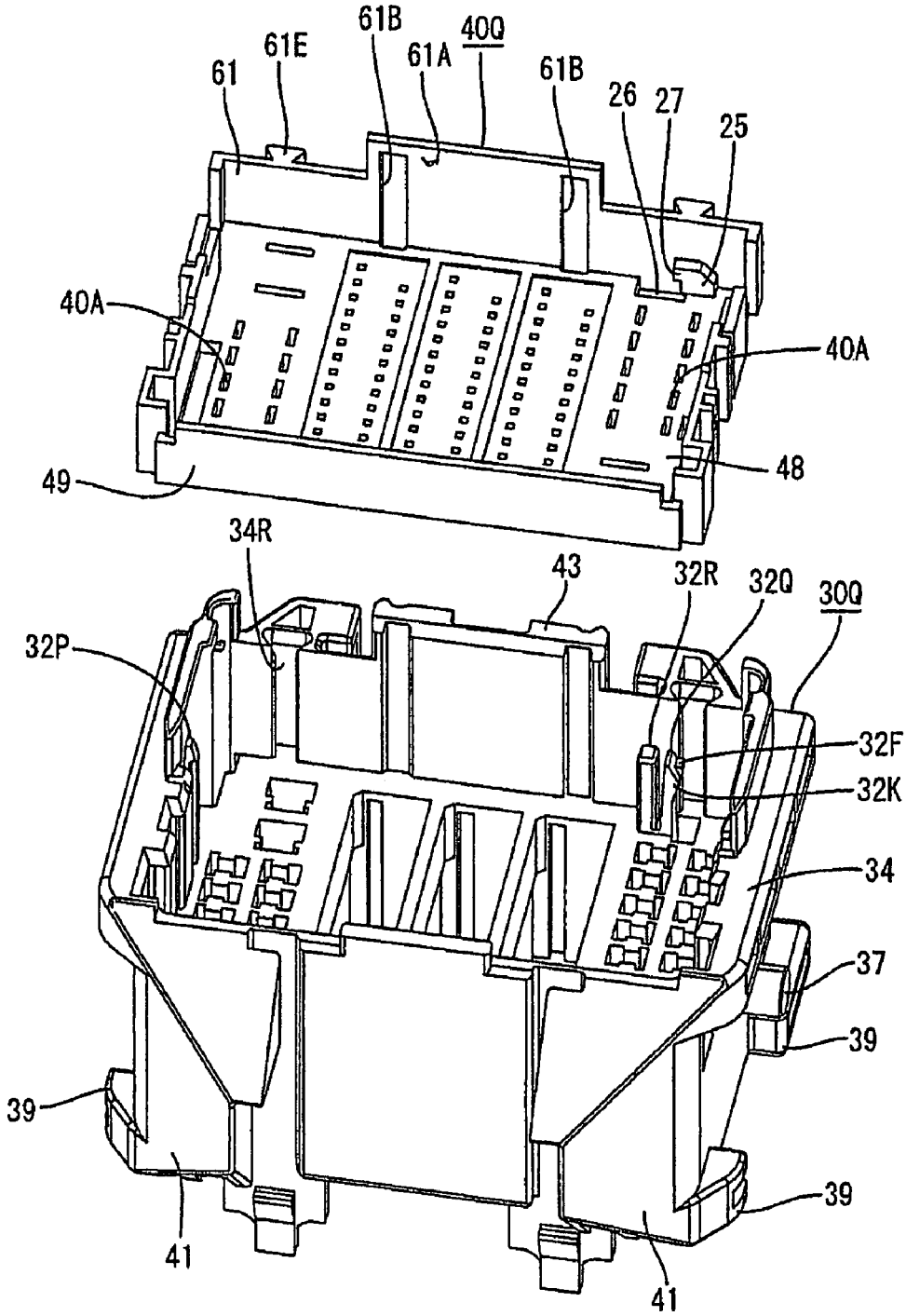
FIG. 41 is an exploded perspective view of the male housing and a moving plate.
Figure 42:
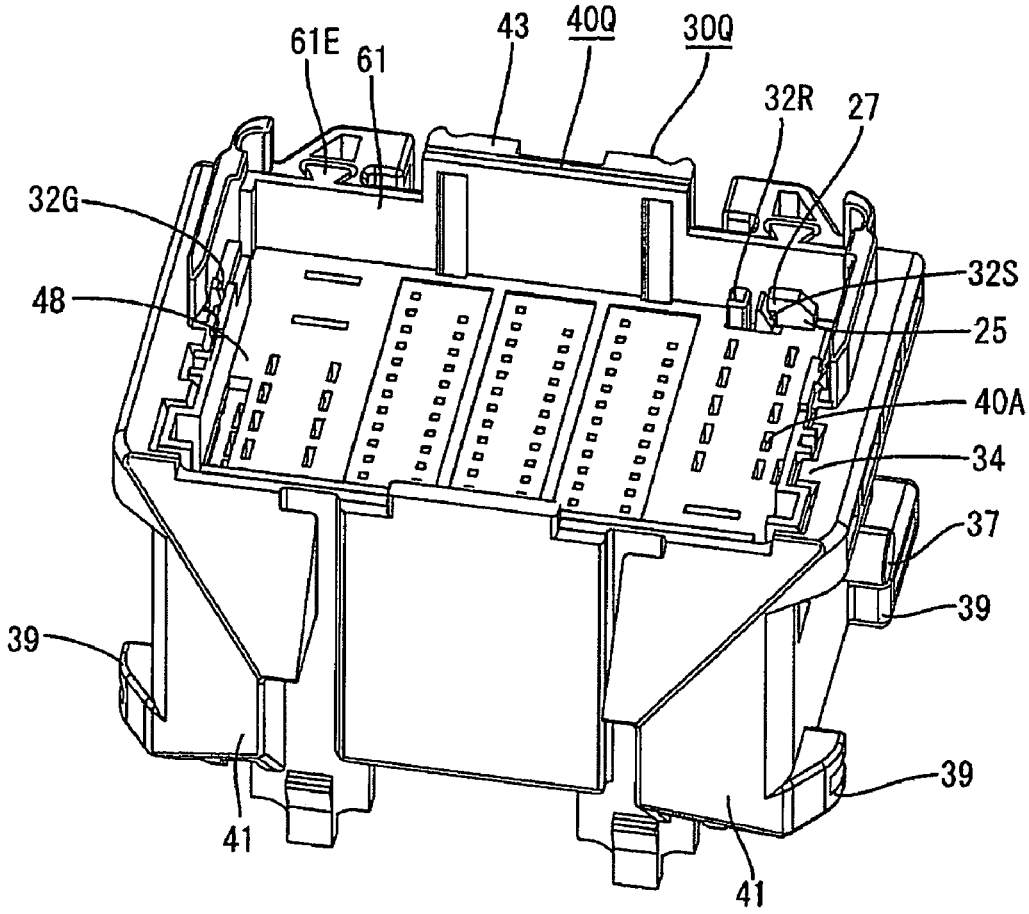
FIG. 42 is a perspective view of the male housing having the moving plate assembled thereinto.
Figure 43:
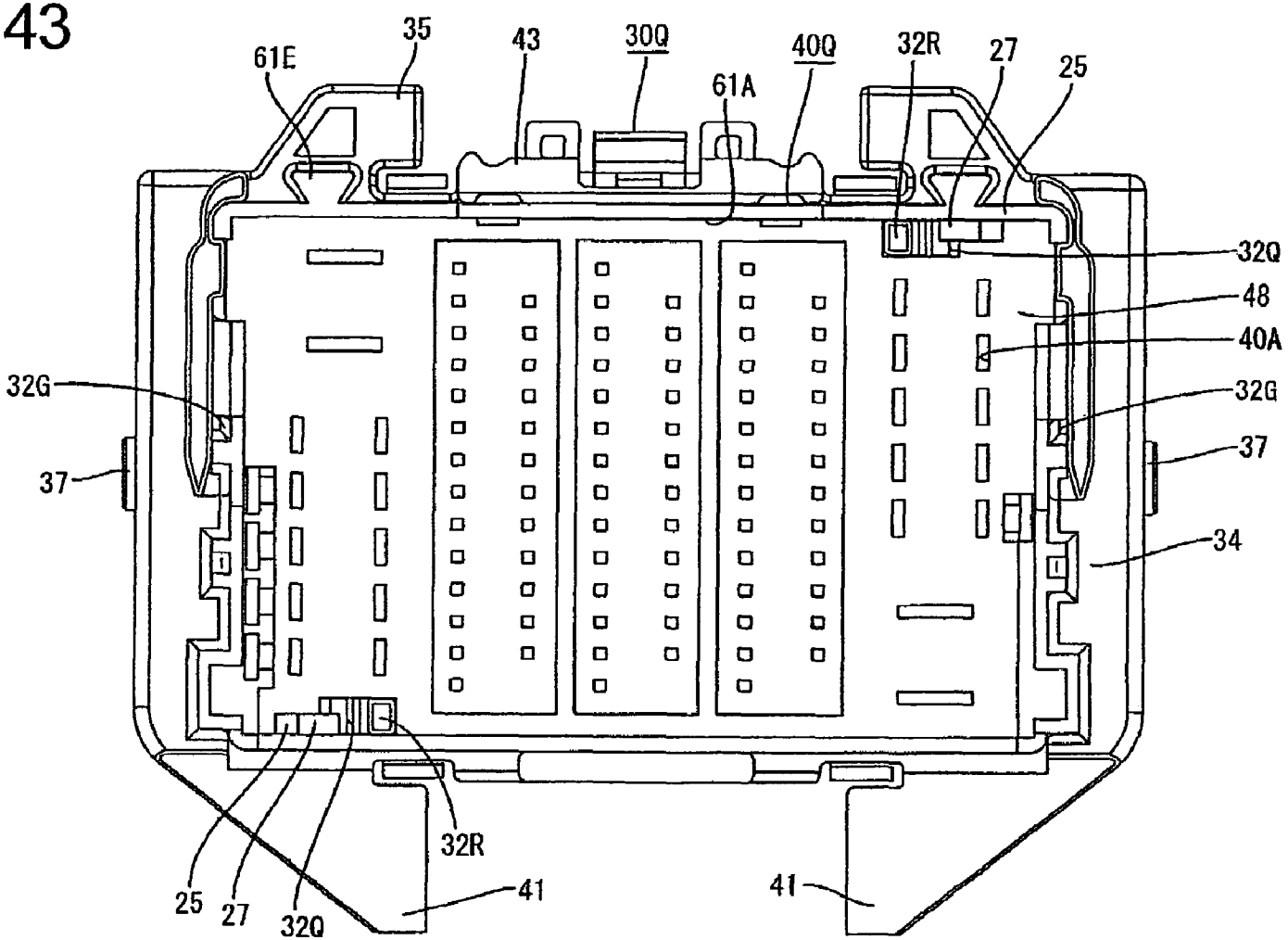
FIG. 43 is a front view of the male housing having the moving plate assembled thereinto.
Figure 49:
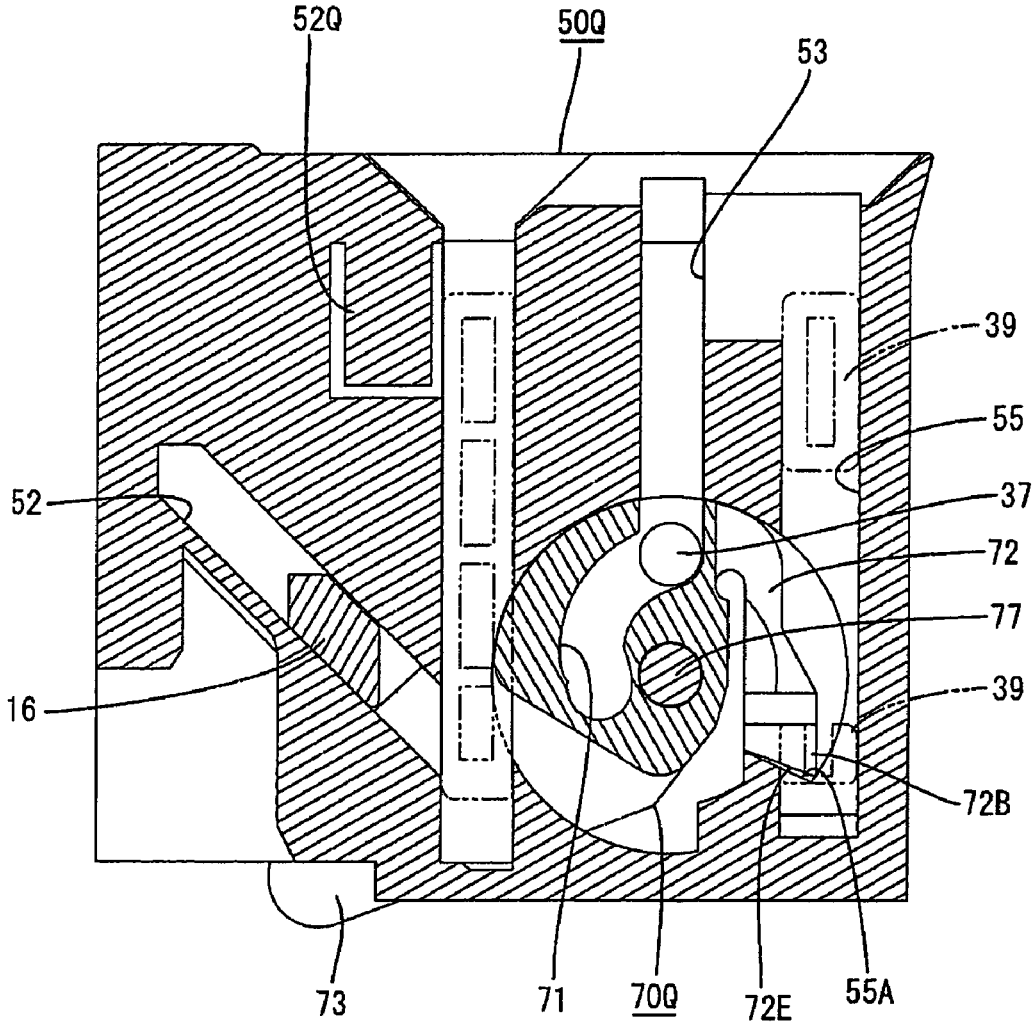
FIG. 49 is a side view in section showing a state where the resilient lock of the lever and a lever receiving portion of the casing are engaged.

As shown in FIG. 41, left and right guides 39 project at the rear ends of the opposite side surfaces of the male housing 30Q. As shown in FIG. 49, the guides 39 enter guiding grooves 55 formed in the casing 50Q to be guidedly moved. The guides 39 then resiliently engage resilient locks 72 provided on the levers 70Q to resiliently deform the resilient locks 72 in unlocking directions. Tabs of unillustrated male terminals are arranged in the receptacle 34 of the male housing 30Q. A covering wall 43 having an open bottom side is formed on the upper wall of the receptacle 34, and the moving plate 40Q can be assembled at least partly inside this covering wall 43.

As shown in FIG. 41, the moving plate 40*q* has a plate main body 48 formed with insertion holes 40A for receiving the respective tabs of the male terminals. A fittable tube 49 projects forward from the peripheral edge of the plate main body 48 and is to be arranged in sliding contact with the inner surface of the receptacle 34. The moving plate 40Q is movable between a terminal localizing position where the plate main body 48 is distanced from the back surface of the receptacle 34 and a terminal connecting position where the plate main body 48 can be held close to or in contact with the back surface of the receptacle 34 (state shown in FIG. 52). The moving plate 40Q is pushed to the terminal connecting position by moving backward from the terminal localizing position by the female housing 10Q while causing the tabs of the male terminals to project from the insertion holes 40A.

A substantially bridge-shaped guiding wall 61 projects substantially forward from an upper part of the fittable tube 49 of the moving plate 40Q. The female housing 10Q is fit into the inside of the guiding wall 61 from below, thereby being brought to a position where the connection thereof with the male housing 30Q can be started. At least one bulge 61A projects substantially forward from at least one intermediate position of the upper wall of the guiding wall 61. When the two housings 10Q, 30Q are engaged, the bulge 61A enters a recess 59R formed at a rear portion 59Q of the upper surface of the casing 50Q from above and contacts the upper surface of the female housing 10Q to press this upper surface.

Left and right slots 61B extend substantially in forward and backward directions FBD in the bulge 61A of the moving plate 40Q. Left and right engaging projections 29 on the upper surface of the female housing 10Q fit into both slots 61B when the bulge 61A contacts the upper surface of the female housing 10Q. The engaging projections 29 hook the edges of the slots 61B during separation of the housings 10Q, 30Q so that the moving plate 40Q is returned from the terminal connecting position to the terminal localizing position as the female housing 10Q is displaced. Further, left and right plate mounting ribs 61E of dovetailed or undercut cross section extend in forward and backward directions FBD on the upper wall of the guiding wall 61 of the moving plate 40Q. Left and right plate mounting grooves 34R are formed in the inner surface of the receptacle 34 so as to substantially correspond to the plate mounting ribs 61E. The moving plate 40Q is guided in forward and backward directions FBD while the plate mounting grooves 34R and the plate mounting ribs 61E are engaged with each other.

Upper and lower plate-locking receiving portions 25, 26 are formed in the moving plate 40Q at two diagonal positions at the substantially opposite side of the center of the plate main body 48. Each plate-locking receiving portion 25, 26 is comprised of a substantially flat receiving base 25 arranged from the front surface of the plate main body 48 to the inner side surface of the fittable tube 49, and a locking-portion introducing hole 26 located near the base end of the receiving base 25 and designed to introduce the plate locking portions 32R, 32Q therethrough. The receiving base 25 has an engaging element 27 at a position to face the front side of the hole plane of the locking-portion introducing hole 26. The engaging element 27 can be brought substantially into contact with the leading end surface of the plate locking portion 32R, 32Q.

Holding means are provided on the inner surface of the receptacle 34 for holding the moving plate 40Q at the terminal localizing position while preventing the moving plate 40Q from moving. As shown in FIG. 41, this holding means is comprised of left and right cantilevered plate locking pieces 32P projecting substantially forward from the opposite left and right surfaces of the receptacle 34, and upper and lower cantilevered plate locking portions 32R, 32Q similarly projecting substantially forward at positions corresponding to the lock receiving portions 25, 26 at the opposite upper and lower surfaces of the receptacle 34. The plate locking pieces 32P prevent a forward movement of the moving plate 40Q by engaging the front ends of the left and right sides of the fittable tube 49 of the moving plate 40Q, and the plate locking portions 32R, 32Q prevent a backward movement of the moving plate 40Q by engaging the lock receiving portions 25, 26 of the moving plate 40Q.

The plate locking pieces 32P define deformation spaces to the corresponding side walls of the receptacle 34 so as to be resiliently deformable, and claws 32G at the leading ends thereof can be brought resiliently into contact with the moving plate 40Q. Each plate locking portion 32R, 32Q has a cantilevered resilient deforming piece 32Q projecting substantially forward from the back surface of the receptacle 34. An excessive deformation preventing portion 32R substantially in the form of a rectangular bar prevents an excessive deformation of the resilient deforming piece 32Q by being arranged substantially parallel to the resilient deforming piece 32Q while defining a deformation space therebetween. The plate locking portions 32R, 32Q are introduced through the corresponding locking-portion introducing hole 26 of the moving plate 40Q and further are inserted into the corresponding escaping recess 18A of the female housing 10Q.

At least one locking element 32F is formed at the leading end of each resilient deforming piece 32Q, and a locking surface 32H thereof can be brought substantially into surface contact with the engaging element 27 of the locking-portion receiving portion 25, 26 in a direction substantially normal to the moving direction of the moving plate 40Q. An unlock guide 32K is formed at the leading end of the resilient deforming piece 32Q and has a guiding surface 32S inclined with respect to a retreating direction of the moving plate 40Q. The unlock guiding portion 32K is at a height different from that of the locking element 32F, and the guiding surface 32S thereof is not in contact with the locking-portion receiving portion 25, 26.

Figure 44:
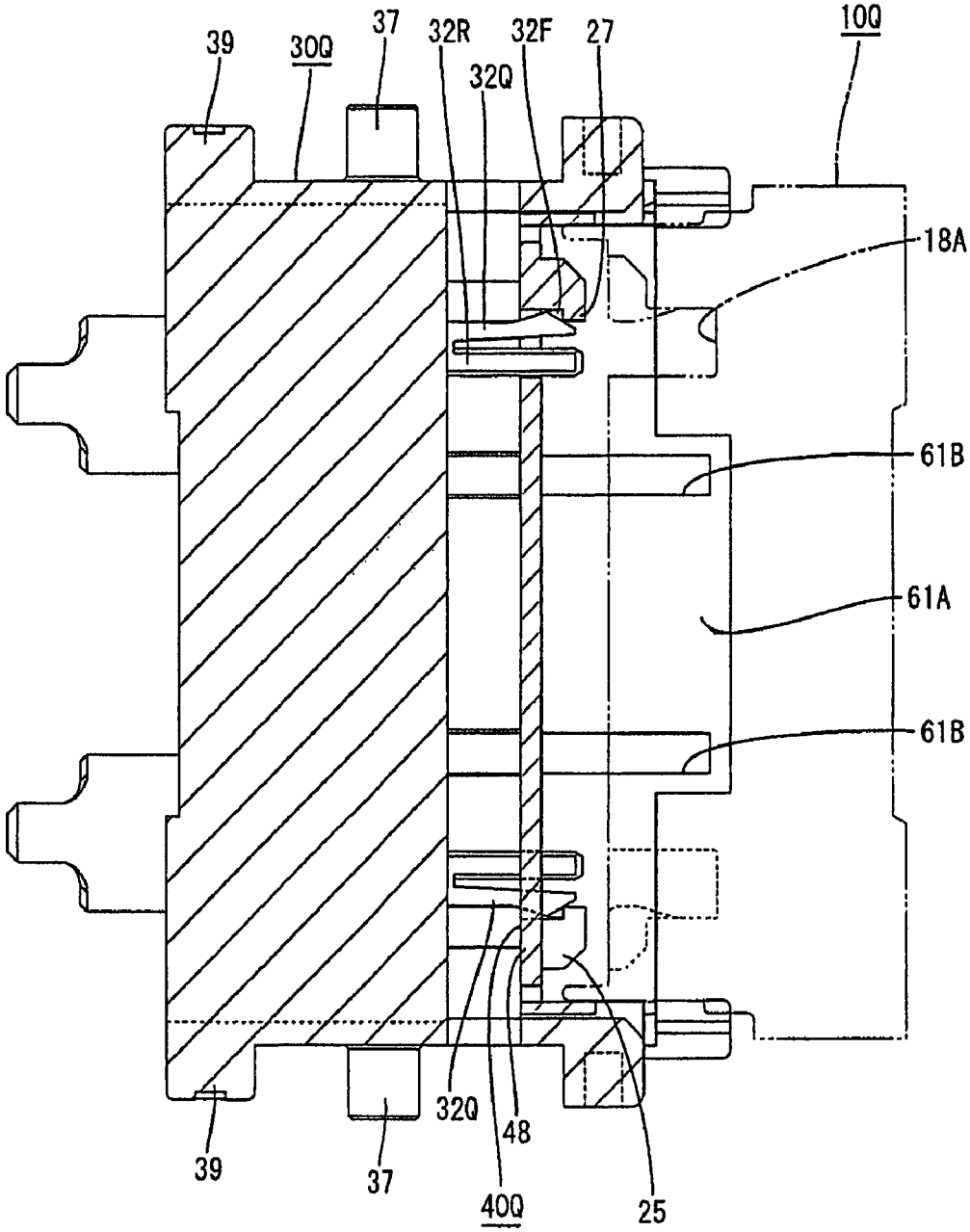
FIG. 44 is a horizontal section of the male housing having the moving plate assembled thereinto.
Figure 45:
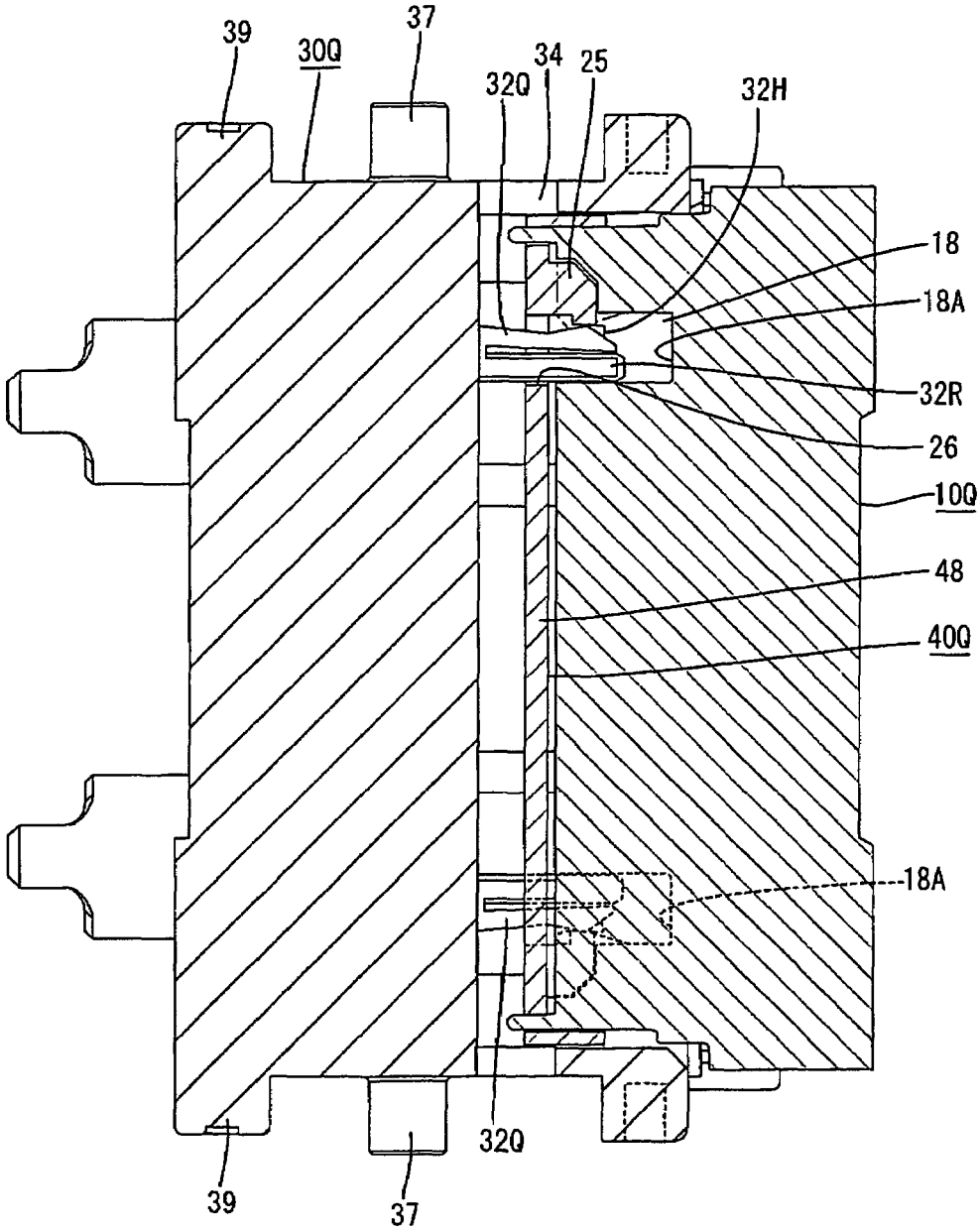
FIG. 45 is a horizontal section showing a state where the moving plate is released from a temporarily held state as the housings are connected.

As shown in FIG. 44, the moving plate 40Q is held temporarily at the terminal localizing position while having a backward movement prevented by the engagement of the engaging elements 27 thereof with the locking elements 32F of the resilient deforming pieces 32Q. Thereafter, when the connecting operation of the two housings 10Q, 30Q is started and the female housing 10Q is fit partly into the receptacle 34, the front surfaces of the earlier unlocking elements 18E of the female housing 10Q slide on the guiding surfaces 32S of the unlock guiding portions 32K of the resilient deforming pieces 32Q, thereby resilient deforming the resilient deforming pieces 32Q towards the deformation spaces to cancel the locked state by the locking elements 32F. When the female housing 10Q is fit further into the receptacle 34, the later unlocking elements 18B of the female housing 10Q engage the receiving bases 25 of the locking-portion receiving portions 25, 26, and the moving plate 40Q is moved backward while being pushed by the later unlocking pieces 18B. As a result, the plate locking portions 32R, 32Q enter the escaping recesses 18A of the female housing 10Q to be arranged so as not to contact the front surface of the female housing 10Q.

Figure 46:
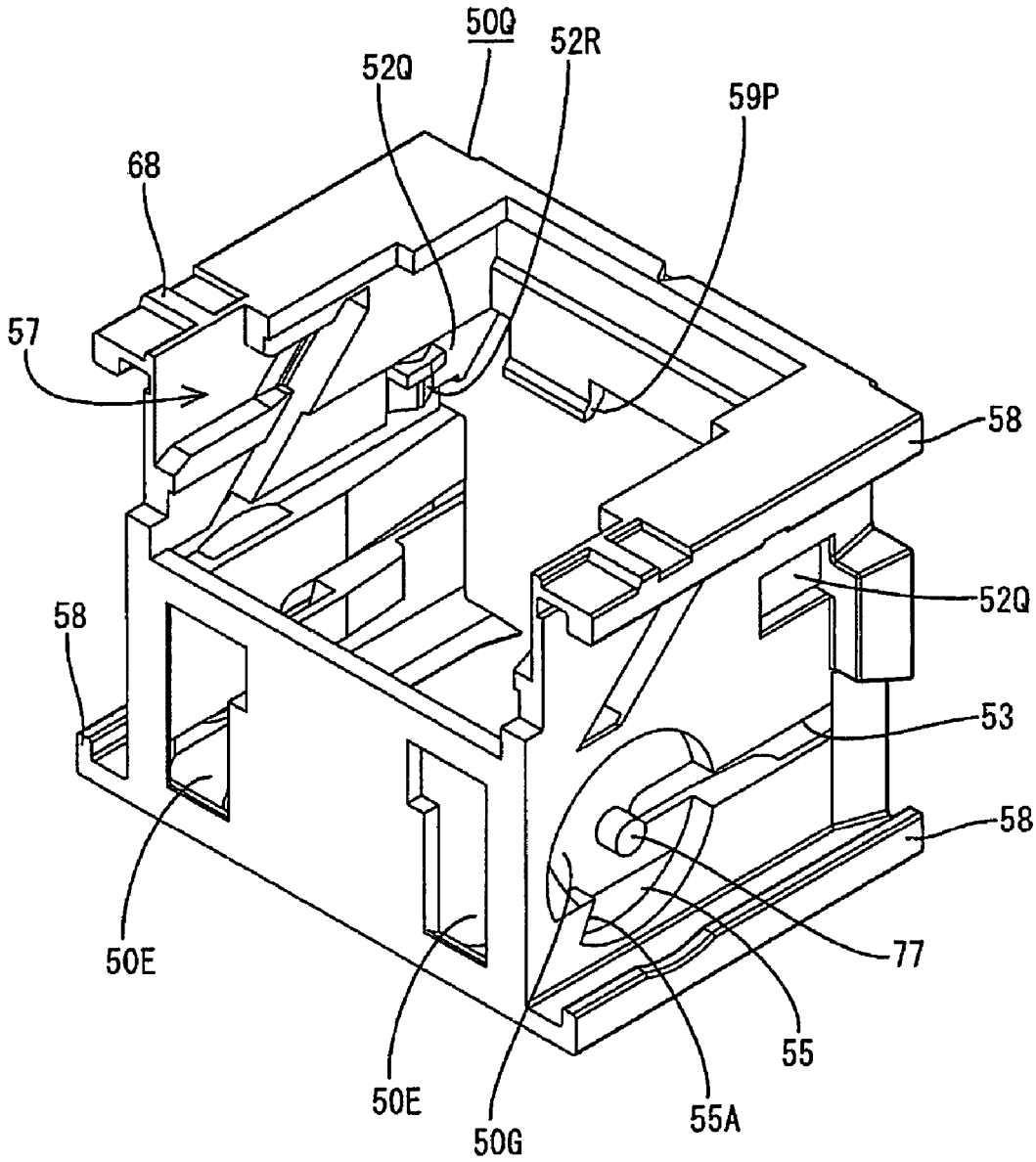
FIG. 46 is a perspective view of the casing.

As shown in FIGS. 46 and 50, the casing 50Q is substantially in the form of a box having open front and rear surfaces, an open front portion of the upper surface and an open rear portion of the bottom surface. The male housing 30Q can be received from above through a first opening 56 in the front portion of the upper surface and the female housing 10Q can be received from below through a second opening 57 in the rear portion of the bottom surface. Two slide guides 58 project over substantially the entire vertical range on the outer surface of each of the opposite side walls of the casing 50. A movement of the slide 80Q is guided along the slide guides 58. Left and right casing-lock receiving portions 68 project at the substantially opposite sides of the opening in the rear surface of the casing 50Q and corresponding to the slide guiding portions 58. The guiding cam grooves 52 engageable with the guiding cams 16 of the female housing 10Q are formed to penetrate the opposite side walls of the casing 50Q in thickness direction and to extend in a specified direction. The guiding cam grooves 52 are substantially straight grooves inclined down toward the front and formed in the rear portions of the opposite side walls of the casing 50Q, and the female housing 10Q is moved toward the male housing 30Q by being obliquely moved forward along these substantially straight grooves.

U-shaped cuts are made in correspondence to the guiding cam grooves 52 in the opposite side walls of the casing 50A to form temporarily engaging portions 52Q that are resiliently deformable in and out. A temporary engaging projection 52R projects inward of the casing 50Q at the leading end of each temporarily engaging portion 52Q. Each temporary engaging projection 52R is engageable with the corresponding temporary holding projection 19 of the female housing 10Q. The female housing 10Q is pushed down in a state where it is held at the initial position by the engagement of the temporary holding projections 19 and the temporary engaging projections 52R as being engaged with the male housing 30Q. Thus, the temporary engaging portions 52Q are deformed resiliently outward to disengage the temporarily engaging projections 52R from the temporary holding projections 19, thereby permitting a movement of the female housing 10Q.

Substantially circular recesses are formed before or adjacent to the guiding cam grooves 52 in the outer surfaces of the opposite side walls of the casing 50Q to define lever mounting portions 50G. A substantially cylindrical supporting pin 77 for rotatably supporting the lever 70Q substantially coaxially stands substantially in the center of each lever mounting portion 50G. A vertical cam introducing groove 53 is formed in each of the opposite side walls of the casing 50Q above the supporting pin 77 and opens at the upper edge of the casing 50Q. The entrances of cam receiving portions 71 of the levers 70Q substantially face the cam introducing grooves 53 when the levers 70Q are at rotation starting positions. Cams 37 of the male housing 30Q enter the cam introducing grooves 53 from above and further enter the entrances of the cam receiving portions 71.

The guiding grooves 55 are formed by recessing adjacent to the cam introducing grooves 53 in the inner surfaces of the opposite side walls of the casing 50Q. The bottom ends of the guiding grooves 55 open in the bottom surfaces of the lever mounting portions 50G, and lever receiving portions 55A are formed at the bottom ends of the guiding grooves 55, as shown in FIG. 46. The lever receiving portions 55A taper along directions normal to the rotating direction of the levers 70Q. The levers 70Q are held at the rotation starting positions by the engagement of the resilient locks 72 with the lever receiving portions 55A, whereas the guiding portions 39 of the male housing 30Q having entered the guiding grooves 55 contact and deform the resilient locking portions 72 resiliently in unlocking directions, thereby permitting the levers 70Q to move from the rotation starting positions.

As shown in FIG. 50, the rear portion 59Q of the upper surface of the casing 50Q is arranged to at least partly cover the upper surface of the female housing 10Q at the initial position from above, and the substantially U-shaped recess 59R substantially in conformity with the bulge 61A of the male housing 30Q is formed in a widthwise intermediate part of the rear portion 59Q. The engaging projections 29 of the female housing 10Q at the initial position are in the recess 59R. Left and right flexible pieces 59P are formed at the opposite sides of the recess 59R in the rear portion 59Q of the upper surface of the casing 50Q, and these flexible pieces 59P can resiliently contact the upper surface of the female housing 10Q.

Figure 47:
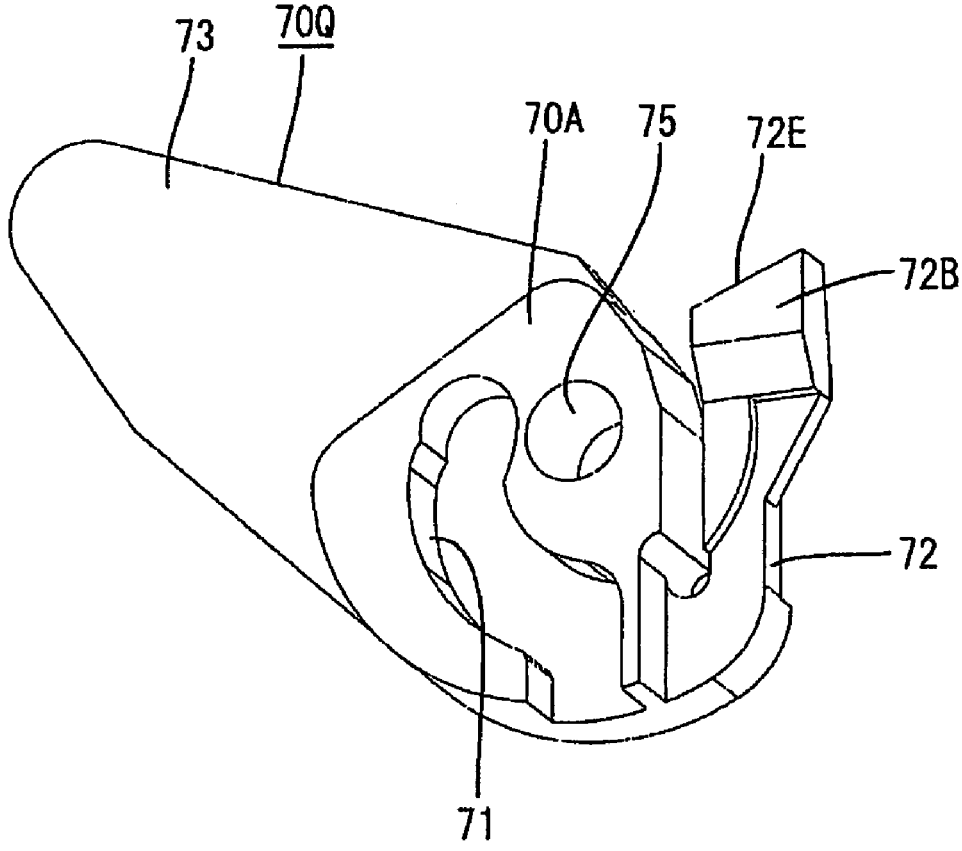
FIG. 47 is a perspective view of a lever.

As shown in FIG. 47, each lever 70Q includes a plate-like arm 73, and a lever main body 70A having an increased thickness or rigidity is formed on the inner surface of the arm 73. This lever main body 70A is fit slidably into the corresponding lever mounting portion 50G. The cam receiving portion 71 is recessed in the inner surface of the arm 73 and extends in a curved manner in a specified direction. A substantially circular bearing 75 engageable with the corresponding supporting pin 77 is formed by recessing at a position near the cam receiving portion 71.

Figure 48:
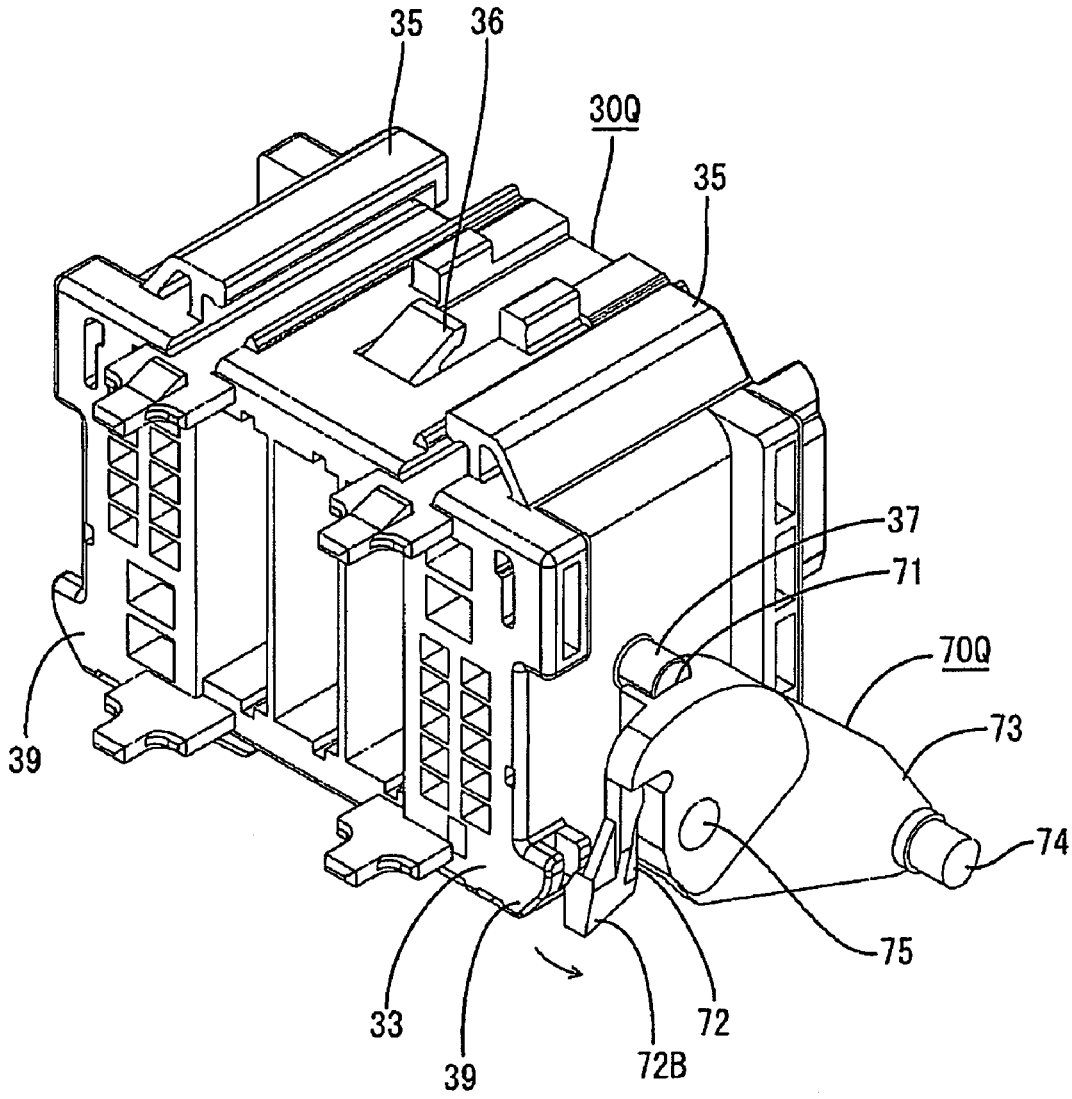
FIG. 48 is a perspective view showing a state where a resilient locking portion of the lever is resiliently deformed upon coming into contact with a guide of the male housing.

The cantilevered resilient lock 72 is formed at the peripheral edge of the arm 73 and extends substantially along this peripheral direction. The resilient lock 72 is deformable inward and outward about the base end thereof. A leading-end lock 72B having increased width and/or thickness is formed close to the leading end of the resilient lock 72. The end surface of the lock 72B defines a rotation-preventing surface 72E extending along a direction substantially normal to the rotating direction of the lever 70Q, and contacts the lever receiving portion 55A in the casing 50Q in the rotating direction of the lever 70Q when the lever 70Q is at the rotation starting position. As shown in FIG. 48, the resilient lock 72 is deformed away from the female housing 30Q in a direction of an arrow of FIG. 48 by the leading-end lock 72B being pushed from above by the guide 39 of the male housing 30Q, with the result that the rotation-preventing surface 72E is disengaged from the lever receiving portion 55A.

An operating-cam 74 projects from the outer surface of an end of the arm 73 distanced from the bearing 75. The operating-cam 74 engages an operating-cam receiving portion 82 formed in the slide 80Q and is movable substantially along an extending direction of the operating-cam receiving portion 82.

The slide 80Q has an operating portion 83 and left and right slide mounts 85 project from the opposite ends of the operating portion 83. The slide 80Q is movable between a retreated position where the operating portion 83 is distanced from the casing 50Q and an advanced position where a distance between the operating portion 83 and the casing 50 is shorter, and preferably is held by a fitting 90Q fixed to a mounting surface F of a cockpit side when at the retreated position.

Figure 37:
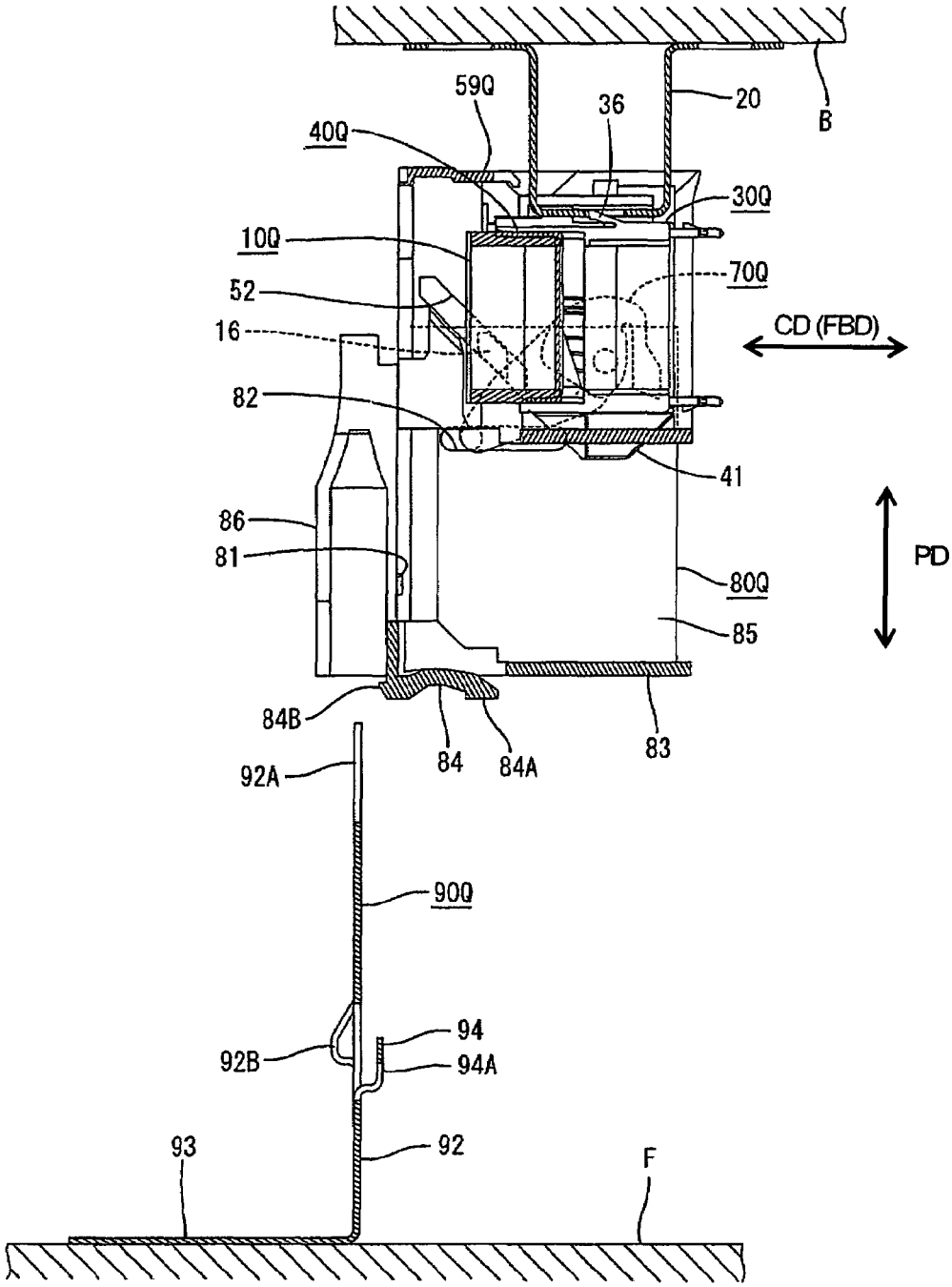
FIG. 37 is a side view in section showing a state where the two housings are engaged.

A resilient arm 84 is resiliently deformable between slits formed at the substantially opposite sides thereof and is exposed at the operating portion 83. As shown in FIG. 37, the resilient arm 84 cantilevers from one end towards the other end while having the base end thereof connected with an intermediate part of the one end of the operating portion 83. A claw-shaped holding projection 84B is formed at the base end of the resilient arm 84 and is engageable with an engaging portion 94 on the fitting 90Q to hold the slide 80Q on the fitting 90Q. A disengaging portion 84A is formed at or close to the free end of the resilient arm 84, and the holding projection 84B and the engaging portion 94 are disengaged by pushing this disengaging portion 84A upward, i.e. in a disengaging direction.

The opposite front and rear edges of the sliding mounts 85 are slidable substantially along the slide guides 58, and the operating-cam receiving portions 82 engageable with the operating-cams 74 of the levers 70Q penetrate the slide mounts 85 in thickness direction while horizontally extending substantially straight. The slide 80Q and the casing 50Q are coupled via the levers 70 by keeping the engaged state of the operating-cams 74 and the operating-cam receiving portions 82. The levers 70Q are prevented from rotating to the rotation starting position by the engagement of the resilient locking portions 72 and the lever receiving portions 55A while the operating-cams 74 and the operating-cam receiving portions 82 are held engaged. Thus, the slide member 80Q is held at the retreated position.

Left and right vertically hollow tunnel-shaped mounting boxes 86 are formed at positions of the outer surfaces of the slide mounts 85 corresponding to the fitting 90. The inner space of each mounting box 86 is an insertion space into which the fitting 90Q is insertable substantially from below. The insertion space of the mounting box 86 has a narrower space tapered towards the upper end, and the leading end of the fitting 90Q is sandwiched between the facing surfaces of this narrowed space. A resiliently deformable casing-lock 81 is formed at the inner bottom surface of each mounting box 86. When the slide 80Q reaches the advanced position, the casing-locks 81 resiliently engage the casing-lock receiving portions 68 of the casing 50Q to retain the slide 80Q in the casing 50Q.

The fitting 90Q is substantially L-shaped and is comprised of a mounting piece 92 and a fixing piece 93. The mounting piece 92 is insertable into the insertion space of the mounting box 86, whereas the fixing piece 93 is to be fixed to the mounting surface F of the cockpit side by at least one fixing device, such as a bolt. Left and right projecting pieces 92A are formed at the leading end of the mounting piece 92, and are inserted into the insertion spaces of the corresponding mounting box portions 86 to be pressed between the facing surfaces of the narrower space. Left and right resilient pieces 92B are formed at the opposite lateral edges of the mounting piece 92 by cutting and bending. Both resilient pieces 92B are held resiliently in contact with the inner surface of the mounting box 86 when the slide 80Q is at the retreated position. The engaging portion 94 is formed in an intermediate position of the mounting piece 92 at a position substantially corresponding to the resilient arm 84 of the slide 80Q. The engaging portion 94 has a substantially flat surface located in a plane different from a reference surface of the mounting piece 92, and an engaging hole 94A is formed in an intermediate position of this flat surface. The holding projection 84B of the resilient arm 84 is fitted into the engaging hole 94A when the slide 80Q is at the retreated position, and the slide 80Q is kept in a temporarily held state.

The movable-side module is assembled prior to connecting the female and male housings 10Q, 30Q. Specifically, the female housing 10Q is inserted into the casing 50Q to fit the guiding cams 16 into the respective guiding cam grooves 52 and to engage the temporary holding projections 19 with the respective temporarily engaging portions 52Q. Thus, the female housing 10Q is held at the initial position. The female housing 10Q at the initial position is in a state where each guiding cam 16 is at one end of the corresponding guiding cam groove 52 and the upper surface of the female housing 10Q substantially contacts the rear half 59Q of the upper surface of the casing 50Q, as shown in FIG. 50. Then, the resilient locks 72 of the levers 70Q are engaged resiliently with the lever receiving portions 55A of the casing 50Q to hold the levers 70Q at the rotation starting positions and to cause the entrances of the cam receiving portions 71 to face the cam introducing grooves 53 of the casing 50Q. Further, the slide 80Q is held temporarily at the retreated position with respect to the casing 50Q.

Figure 34:
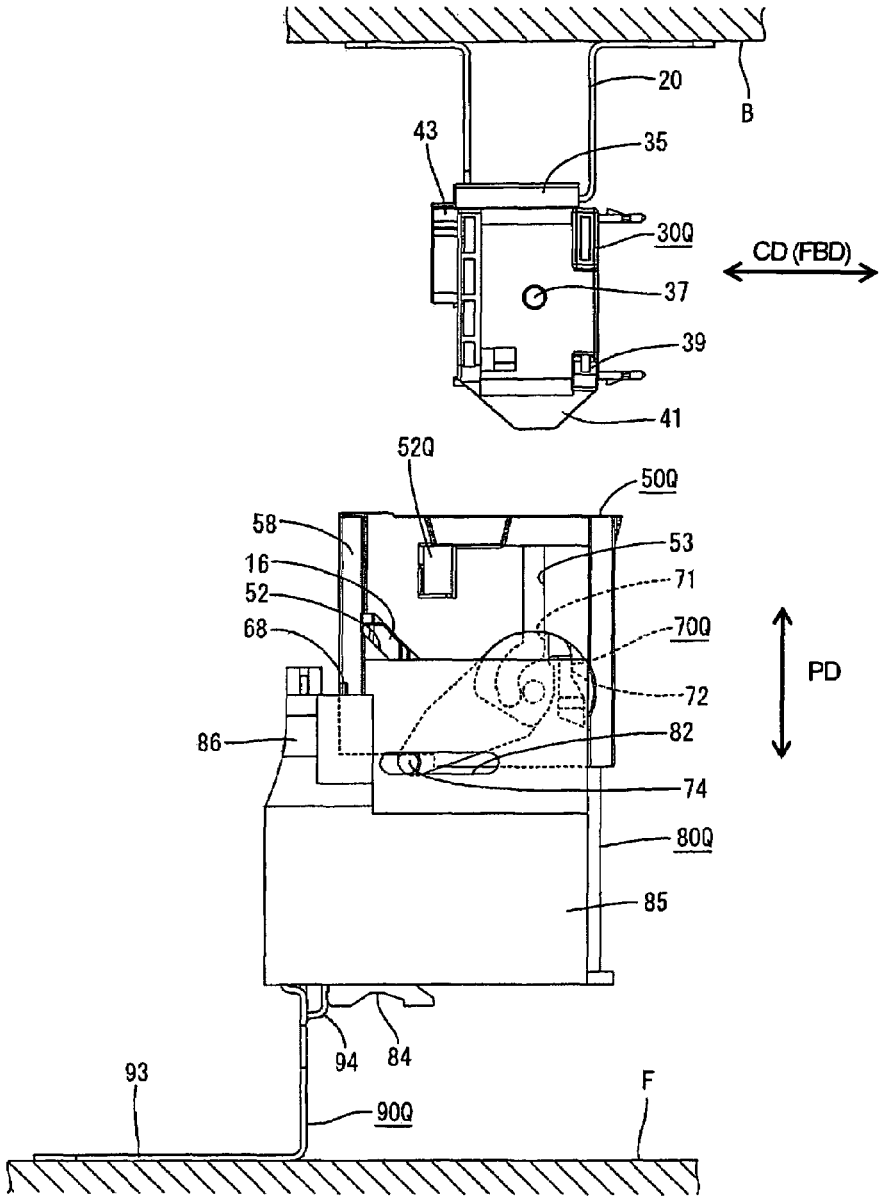
FIG. 34 is a side view showing a state where a cockpit-side module and a vehicle-side module are opposed to each other in a connector device according to a second embodiment of the invention.

At an operation site where the two housings 10Q, 30Q are connected, rails 35 of the male housing 30Q are slid relative to a mounting member 20 fixed to a mounting surface B of an engine compartment, thereby fixing the male housing 30Q to the mounting surface B. Further, the moving plate 40Q is assembled into the receptacle 34 of the male housing 30Q and is held at the terminal localizing position by the holding means of the moving plate 40Q. For the movable-side module, the leading end of the fitting 90Q is inserted into the insertion of the mounting boxes 86, and the engaging portion 94 of the fitting 90Q is engaged resiliently with the resilient arm 84 of the slide 80Q. In this way, the first opening 56 of the casing 50Q is opposed at a specified distance to the bottom surface of the male housing 30Q, as shown in FIGS. 34 and 50.

In this state, the disengaging portion 84A of the resilient arm 84 of the slide 80Q is pushed to release the slide 80Q from the locked state, and the operating surface of the operating portion 83 is pushed to move the slide 80Q towards the male housing 30Q together with the casing 50Q. Then, during this movement, the male housing 30Q enters the casing 50Q through the first opening 56 and the cams 37 of the male housing 30Q slide substantially along the groove surfaces of the cam introducing grooves 53 of the casing 50Q and the guiding portions 39 of the male housing 30Q slide substantially along the groove surfaces of the guiding grooves 55 of the casing 50Q.

The covering wall 43 of the male housing 30Q presses the guiding wall 61 of the moving plate 40Q and the female housing 10Q. Thus, the engaging projections 29 of the female housing 10Q enter the slots 61B of the moving plate 40Q and the temporarily held state by the temporarily holding projections 19 of the female housing 10Q is canceled by the pressing forces of the engaging projections 29.

As the male housing 30Q is inserted further into the casing 50Q, the earlier unlocking elements 18E of the female housing 10Q engage the plate locking portions 32R, 32Q of the receptacle 34 to deform the resilient deforming pieces 32Q in unlocking directions, and successively the later unlocking elements 18B of the female housing 10Q engage the lock receiving portions 25, 26 of the moving plate 40Q. Thus, the moving plate 40Q is moved backward substantially along the plate mounting grooves 34R while substantially keeping the engaged state.

Before or after the start of the backward movement of the moving plate 40Q, the cams 37 enter the entrances of the cam receiving portions 71 of the levers 70Q, as shown in FIG. 49. Then, the guiding portions 39 contact the leading-end locks 72B of the resilient locks 72 to resiliently deform the resilient locks 72 outward. Thus, the leading-end locks 72B are disengaged from the lever receiving portions 55A to enable the levers 70Q to start rotating. At this time, female and male terminals have started being connected by having the leading ends thereof partly overlap each other. Further, the rests 17 of the female housing 10Q enter the receptacle 34 by a relative displacement of the female housing 10Q oblique to the moving direction of the male housing 30Q.

Figure 35:
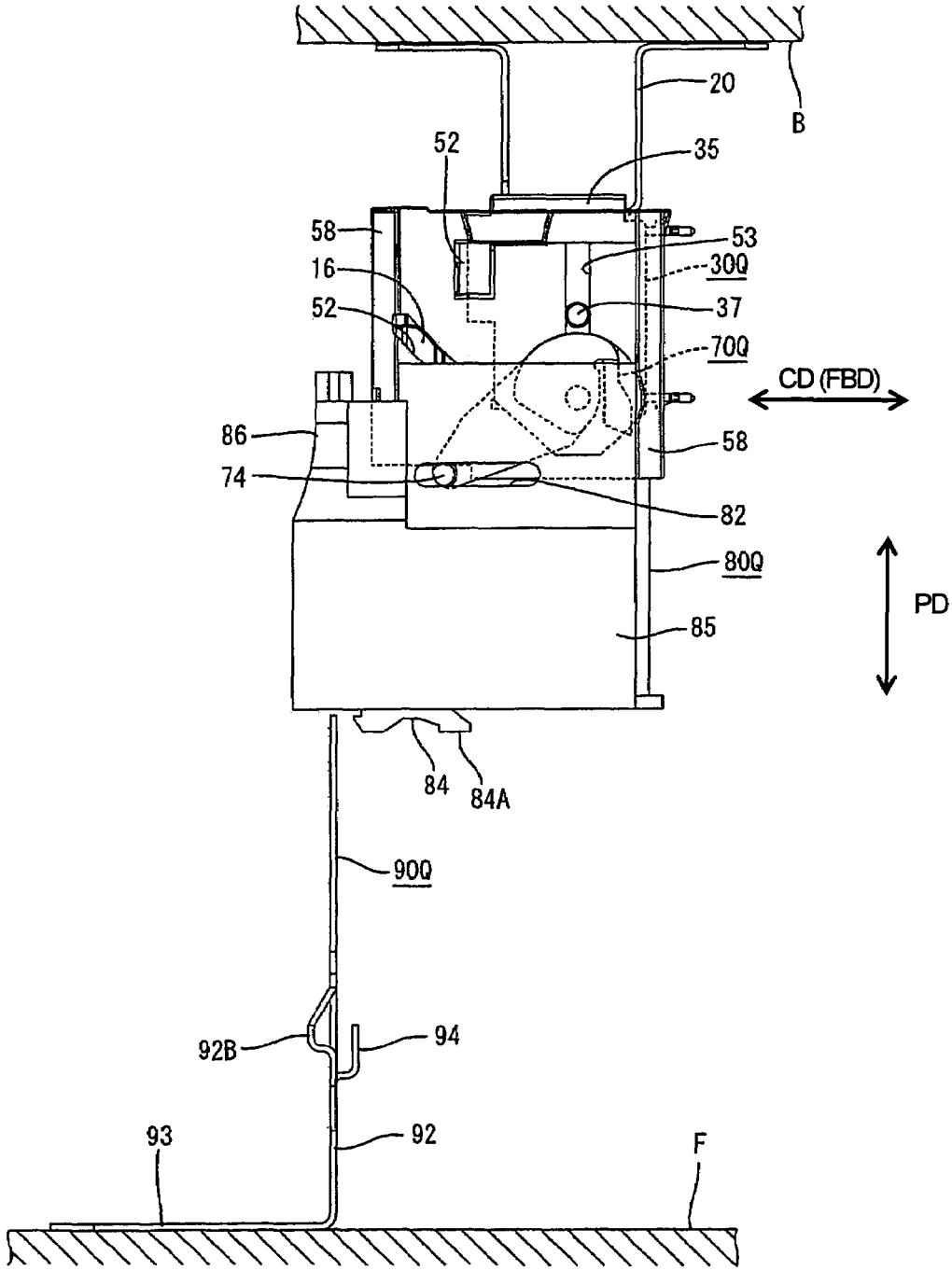
FIG. 35 is a side view showing a state where a male housing is inserted in a casing.
Figure 36:
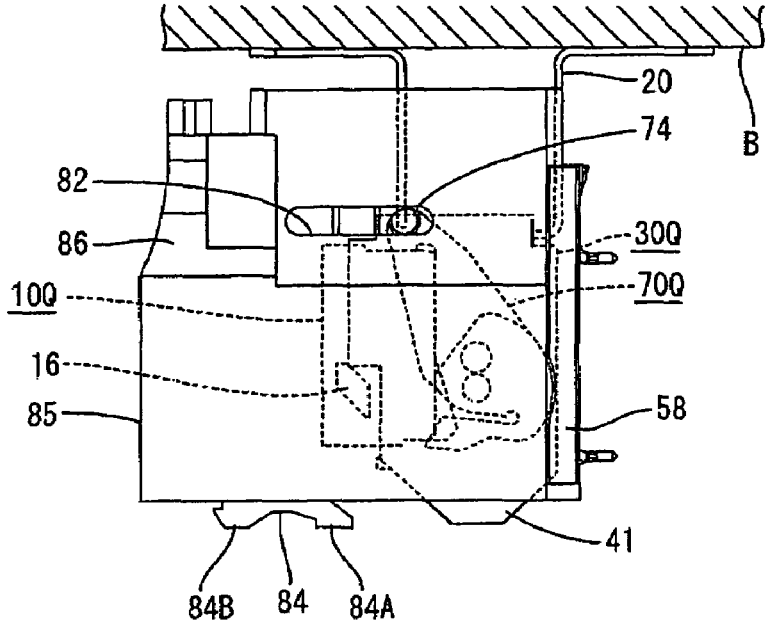
FIG. 36 is a side view showing a state where two housings are properly connected.
Figure 36:
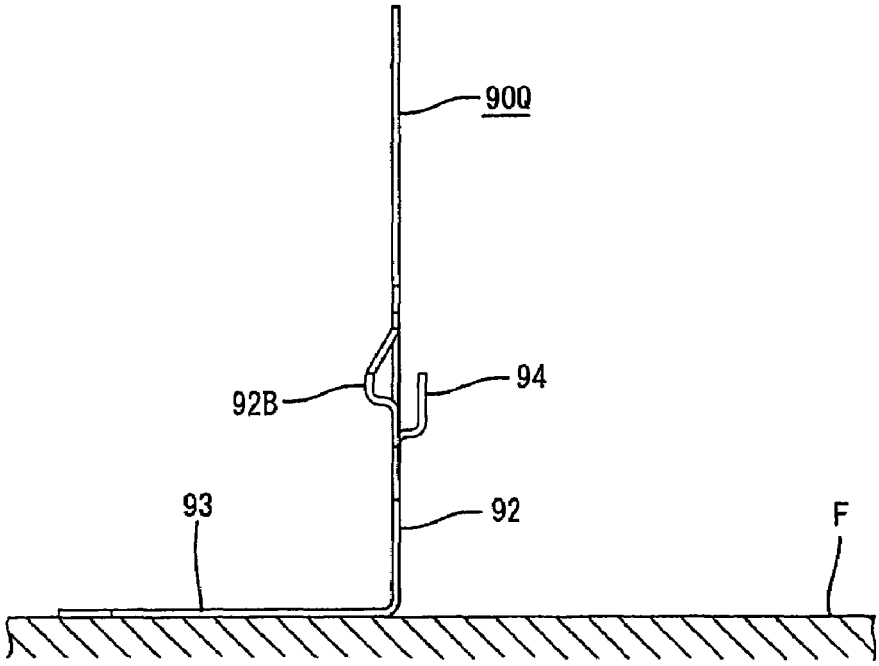

Thereafter, the slide 80Q is pushed further, and the operating-cams 74 of the levers 70Q are displaced along the operating-cam receiving portions 82 of the slide 80Q, and the levers 70Q are rotated clockwise in FIG. 35 about the supporting pins 77. The slide 80Q then is moved from the retreated position to the advanced position, and the cams 37 of the male housing 30 are displaced along the cam receiving portions 71 of the levers 70Q, with the result that the connecting operation of the female and male housings 10Q, 30Q progresses. The operating portion 83 of the slide 80Q reaches a position where it is stopped by the bottom wall of the casing 50Q. At this point, the rotations of the levers 70Q are completed and the two housings 10Q, 30Q are connected properly, as shown in FIG. 36. When the slide 80Q reaches the advanced position in this way, the casing-locks 81 of the slide 80Q resiliently engage with the casing-lock receiving portions 68 of the casing 50Q. Therefore, the slide 80Q is locked while having the separation thereof from the casing 50Q prevented.

Upon separating the two housings 10Q, 30Q properly connected in this way, the slide 80Q is moved from the advanced position back to the retreated position by disengaging the casing-locks 81 and the casing-lock receiving portions 68. The operating-cams 74 then are displaced in a direction substantially opposite to the connecting direction of the two housings 10Q, 30Q along the operating-cam receiving portions 82, and the levers 70Q are rotated in an opposite direction, e.g. counterclockwise in FIG. 36, about the supporting pins 77. As the levers 70Q are rotated, the cams 37 are displaced towards the entrances of the cam receiving portions 71, and the guiding cams 16 are moved obliquely up along the guiding cam grooves 52, with the result that the female housing 10Q is separated from the male housing 30Q. Further, the engaging projections 29 of the female housing 10Q are hooked with the edges of the slots 61B of the moving plate 40Q. As a result, the moving plate 40Q is moved towards the terminal localizing position as the female housing 10Q is moved. During the separation of the two housings 10Q, 30Q, the moving plate 40Q is held at the terminal localizing position by the engagement of the plate locks 32R, 32Q and the plate locking pieces 32P.

Figure 53:
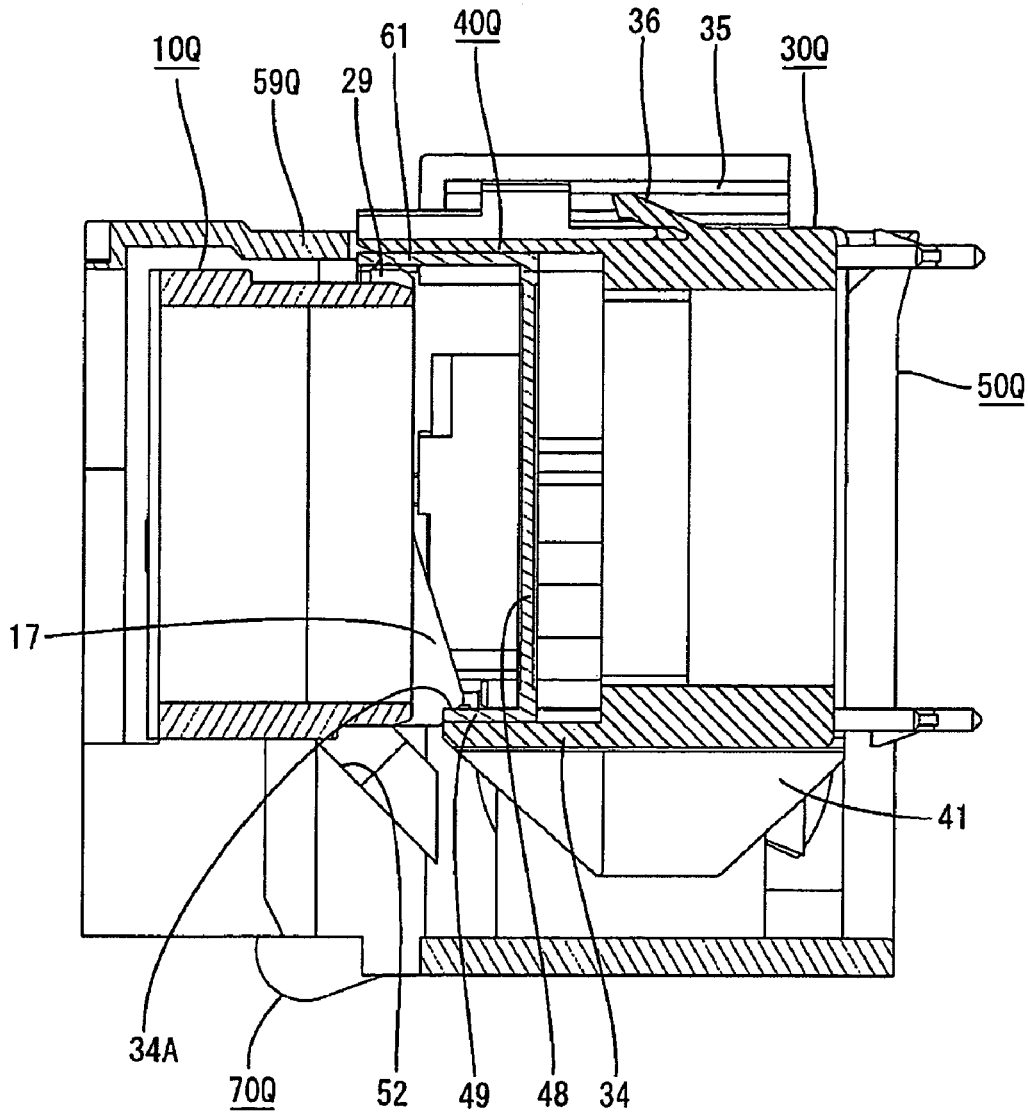
FIG. 53 is an enlarged side view with an essential portion shown in section showing a state where resting portions are lifted up by a contact portion.

Upon the arrival of a final stage of the separating operation of the two housings 10Q, 30Q, the rests 17 of the female housing 10Q and the contact 34A of the male housing 30Q come into contact as shown in FIG. 53, to define a propelling construction for pulling the female housing 10Q to the initial position. Specifically, when the male housing 30Q is displaced up relative to the casing 50Q in a state shown in FIG. 53, the female housing 10Q is pushed obliquely upward along the guiding cam grooves 52 while the contact portion 34A slides along the slanted surfaces 17A of the rests 17, with the result that the female housing 10Q reaches the initial position. At this time, when the female housing 10Q is lifted up a little more than necessary, the upper surface of the female housing 10Q contacts the rear portion 59Q of the upper surface of the casing 50Q to resiliently deform this rear portion 59Q, which, however, is restored resiliently later, thereby enabling the female housing 10Q to return to the initial position.

As described above, upon separating the two housings 10Q, 30Q, the rests 17 on the female housing 10Q are lifted up by the contact 34A at the male housing 30Q as the male housing 30Q is displaced relative to the casing 50Q. Accordingly, the female housing 10Q is returned forcibly to the initial position. Thus, a succeeding operation can be started quickly, and this connector device is suitable for the repeated and continuous use, thus improving overall operability. Further, the rests 17 project forward from the front surface of the female housing 10Q and can be inserted into the receptacle 34 of the male housing 30Q when the housings 10Q, 30Q are connected. Thus, a moving stroke of the female housing 10Q desirably can be set merely by adjusting a projecting amount of the rests 17.

If the rests 17 are lifted up a little more than necessary by the contact 34A, the rear half 59Q of the upper surface of the casing 50Q can receive the female housing 10Q while undergoing a substantially resilient deformation. Thus, even if the moving stroke of the female housing 10Q is deviated from a set value, such a deviation can be taken up or compensated. Further, the female housing 10Q can reach the initial position as the rear portion 59Q is resiliently restored.

The locking constructions by the plate locking portions 32R, 32Q provided at the receptacle 34 and the locking-portion receiving portions 25, 26 provided at the moving plate 40Q are provided in a pair at the diagonal positions at the opposite sides of the center of the plate main body 48 of the moving plate 40Q. Thus, the plate main body 48 is movable while maintaining its vertical posture. As a result, the male and female terminals can be connected in stable postures, thereby improving connection reliability.

Further, the resilient locks 72 of the levers 70Q extend in directions substantially tangent to the rotating directions of the levers 70Q and are resiliently deformable along the thickness direction thereof, and the rotation-preventing surfaces 72E that contact the lever receiving portions 55A of the guiding grooves 55 in the casing 50Q in the rotating directions of the levers 70Q are provided at the free leading ends of the resilient locks 72. Thus, the locking strength of the resilient locks 72 can be increased. This can avoid a situation where the locked states by the resilient locks 72 are inadvertently canceled when the levers 70Q are at the rotation starting positions.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The covering wall has resilient locks and the engageable portions are on the guiding wall in the foregoing embodiment. However, the covering wall can have engageable portions and the guiding wall can have resilient locks according to the invention.

The moving plate has the engaging projections and the female housing has the engaging recesses in the foregoing embodiment. However, the moving plate can have the engaging recesses and the female housing can have the engaging projections according to the invention.

The male housing is in the vehicle-side module and the female housing is in the cockpit-side module in the foregoing embodiment. However, the female housing may be in the vehicle-side module and the male housing may be in the cockpit-side module according to the invention.

The invention is widely applicable to connector devices with a female housing mounted into a male housing at an angle to a connecting direction and, thereafter, a connecting operation of the two housings is started.

Levers are the movable members in the above-described embodiment. However, the invention is applicable to a slider as a movable member that displays a cam action or to other movable members having different movement paths such as linear, bent, elliptic or the like paths.

The operating-cams are relatively moved substantially along the operating-cam receiving portions in the foregoing embodiment. However, the operating-cam receiving portions may be relatively moved along groove-shaped operating-cams according to the present invention.

The one or more levers are mounted rotatably on the casing in the foregoing embodiment. However, the levers may be mounted rotatably on the slide according to the present invention. In such a case, the operating-cam receiving portions may be provided in the casing.

The operating surface of the slide is a flat surface in the foregoing embodiment. However protection ribs may stand around the openings of the detection windows in the operating surface of the slide. The protection ribs can be used as indices for the connection detection by visually comparing the projecting ends of the protection ribs and those of the detecting portions, and can serve to protect the detecting portions.

The moving plate is assembled in the receptacle in the foregoing embodiment. However, the moving plate may be dispensed with. In such a case, the covering wall of the receptacle serves as the guiding wall.

Two substantially parallel guiding cam grooves are formed in the opposite side surfaces in the foregoing embodiment. However, three or more substantially parallel guiding cam grooves may be formed, and in some cases, only one guiding cam groove may be formed.

The male housing is in the vehicle-side module and the female housing is in the cockpit-side module in the foregoing embodiment. However, the female housing may be in the vehicle-side module and the male housing may be in the cockpit-side module according to the present invention.

The cockpit-side module is the movable-side module and the vehicle-side module is the waiting-side module in the foregoing embodiment. However, the cockpit-side module may be the waiting-side module and the vehicle-side module may be the movable-side module.

The slide has at least one resilient arm and the holding member has at least one engaging portion in the foregoing embodiment. However, the slide may have the at least one engaging portion and the holding member may have the at least one resilient arm or both may be formed with one or more engaging portions and resilient arms according to the present invention.

The connecting direction of the male and female housings is at an angle to the mounting directions thereof in the foregoing embodiments. However, these directions may be same according to the present invention.

The resting portions project towards the contact portion in the second embodiment. However, the contact portion may project towards the resting portions according to the present invention.

The locking constructions defined by the plate locks on the receptacle and the lock receiving portions on the moving plate may be provided in pairs at four diagonal positions at opposite sides of the center of the moving plate.

What is claimed is:

1. A connector comprising a first housing with a receptacle having a front end, a top guiding wall and side guiding walls projecting forward from the front end of the receptacle, a second housing fittable into the receptacle along a connecting direction, the second housing being configured for being moved between the side guiding walls along a mounting direction aligned at an angle intersecting the connecting direction and into a mount position where the second housing substantially abuts the top guiding wall, the second housing being movable between the side guiding walls from the mount position towards a back end of the receptacles substantially along the connecting direction, wherein the top guiding wall contacts a front surface of the second housing with respect to the mounting direction and the side guiding walls contact opposite side surfaces of the second housing to position the second housing before connection along the connecting direction is started.

2. The connector of claim 1, further comprising a moving plate assembled in the receptacle and having insertion holes for receiving tabs of male terminals, the moving plate being movable towards the back end of the receptacle so that the tabs project through the insertion holes as the housings are connected, at least one of the guiding wall being formed on the moving plate.

3. The connector of claim 2, wherein a covering wall projects forward from the opening edge of the receptacle, the guiding wall of the moving plate being arranged inside the covering wall.

4. The connector of claim 3, wherein the guiding wall of the moving plate has at least one engageable portion and the covering wall has at least one lock, the moving plate being kept partly locked by a resilient locking action of the engageable portion and the lock.

5. The connector of claim 4, wherein the second housing has at least one disengaging portion for disengaging the lock from the engageable portion as the second housing substantially reaches the mount position.

6. The connector of claim 2, wherein at least one engaging projection is formed on one of the second housing and the guiding wall of the moving plate, and an engaging recess being formed in the other of the second housing and the guiding wall of the moving plate, the engaging projection and the engaging recess being engaged with each other as the second housing reaches the mount position.

7. The connector device of claim 6, wherein the engaging projection and the engaging recess are engaged with each other so that the moving plate moves together with the second housing as the second housing is pushed towards the back end of the receptacle.

8. The connector of claim 1, wherein the front end of the receptacle is substantially normal to the connecting direction and substantially parallel to the mounting direction.

* * * * *